US011998814B2

(12) United States Patent
Milleman et al.

(10) Patent No.: US 11,998,814 B2
(45) Date of Patent: Jun. 4, 2024

(54) FAIRWAY WOOD GOLF CLUB HEAD WITH LOW CG

(71) Applicant: Karsten Manufacturing Corporation, Phoenix, AZ (US)

(72) Inventors: Travis D. Milleman, Portland, OR (US); David A. Higdon, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/447,331

(22) Filed: Sep. 10, 2021

(65) Prior Publication Data

US 2022/0072399 A1 Mar. 10, 2022

Related U.S. Application Data

(60) Provisional application No. 63/217,695, filed on Jul. 1, 2021, provisional application No. 63/076,766, filed on Sep. 10, 2020.

(51) Int. Cl.
*A63B 53/04* (2015.01)
*A63B 53/08* (2015.01)

(52) U.S. Cl.
CPC ..... *A63B 53/08* (2013.01); *A63B 53/0433* (2020.08); *A63B 53/0437* (2020.08); *A63B 53/0466* (2013.01); *A63B 2053/0491* (2013.01); *A63B 2209/02* (2013.01)

(58) Field of Classification Search
CPC . A63B 53/08; A63B 53/0433; A63B 53/0437; A63B 53/0466; A63B 2053/0491; A63B 2209/02
See application file for complete search history.

(56) References Cited

U.S. PATENT DOCUMENTS 4,085,934 A * 4/1978 Churchward ..... A63B 53/04 473/338
4,895,367 A * 1/1990 Kajita ..... A63B 53/047 473/287
5,851,160 A * 12/1998 Rugge ..... A63B 60/00 473/349
5,935,020 A * 8/1999 Stites ..... A63B 60/00 473/345
6,033,318 A * 3/2000 Drajan, Jr. ..... A63B 60/54 473/309
6,254,494 B1 * 7/2001 Hasebe ..... A63B 53/04 473/345
6,605,007 B1 8/2003 Bissonnette
(Continued)

OTHER PUBLICATIONS

International Search Report and Written Opinion for Int'l Patent Application No. PCT/US2021/049794, filed on Sep. 10, 2021.

*Primary Examiner* — William M Pierce

(57) ABSTRACT

The present invention is directed to a fairway-type golf club head combing (or comprising) features selected from the group consisting of lightweight crown inserts, main body of weight reducing features, a high density sole insert, a removable, adjustable, interchangeable rear weight assembly, or a combination thereof to enable a low center of gravity of the club head thereby increasing forgiveness, reducing spin, and positioning the center of gravity at or near the force line impact point axis of the fairway-type golf club head.

18 Claims, 22 Drawing Sheets

(56) References Cited

U.S. PATENT DOCUMENTS 6,716,114 B2 * 4/2004 Nishio ..... A63B 53/0466 473/345
6,875,129 B2 * 4/2005 Erickson ..... A63B 60/02 473/345
6,988,960 B2 1/2006 Mahaffey
7,029,403 B2 4/2006 Rice
7,070,512 B2 * 7/2006 Nishio ..... A63B 53/0466 473/319
7,077,762 B2 * 7/2006 Kouno ..... A63B 53/0466 473/345
7,207,898 B2 4/2007 Rice
7,303,488 B2 * 12/2007 Kakiuchi ..... A63B 53/0466 473/345
7,377,860 B2 5/2008 Breier
7,500,926 B2 3/2009 Rae
7,524,249 B2 4/2009 Breier
7,559,854 B2 7/2009 Harvell
7,632,195 B2 12/2009 Jorgensen
7,632,196 B2 12/2009 Reed
7,731,603 B2 * 6/2010 Beach ..... A63B 60/02 473/335
7,758,452 B2 7/2010 Soracco
7,806,781 B2 10/2010 Imamoto
7,857,713 B2 12/2010 Yokota
7,887,436 B2 * 2/2011 Hirano ..... A63B 53/0466 473/345
8,083,609 B2 * 12/2011 Burnett ..... A63B 53/0466 473/345
8,088,021 B2 * 1/2012 Albertsen ..... A63B 53/0466 473/345
8,187,115 B2 5/2012 Bennett
8,206,244 B2 * 6/2012 Honea ..... A63B 53/00 473/345
8,235,844 B2 * 8/2012 Albertsen ..... A63B 53/047 473/345
8,337,319 B2 * 12/2012 Sargent ..... A63B 60/02 473/307
8,353,786 B2 * 1/2013 Beach ..... A63B 60/02 473/345
8,388,465 B2 3/2013 De La Cruz
8,517,858 B2 8/2013 Soracco
8,517,860 B2 * 8/2013 Albertsen ..... A63B 53/047 473/332
8,523,705 B2 9/2013 Breier
8,617,000 B2 12/2013 Ferguson
8,636,609 B2 1/2014 Chao
8,636,610 B2 1/2014 Golden
8,801,541 B2 * 8/2014 Beach ..... A63B 60/10 473/282
8,821,312 B2 * 9/2014 Burnett ..... A63B 53/0475 473/345
8,827,831 B2 * 9/2014 Burnett ..... A63B 60/52 473/332
8,986,133 B2 * 3/2015 Bennett ..... A63B 60/00 473/344
9,011,267 B2 * 4/2015 Burnett ..... A63B 60/00 473/332
9,089,749 B2 * 7/2015 Burnett ..... A63B 53/0466
9,220,956 B2 12/2015 Beach
9,636,552 B2 * 5/2017 Cleghorn ..... A63B 60/54
9,662,545 B2 * 5/2017 Beach ..... A63B 60/52
9,675,849 B2 * 6/2017 Beach ..... A63B 60/06
9,707,457 B2 * 7/2017 Mata ..... A63B 60/52
9,839,817 B1 12/2017 Johnson
9,908,014 B1 3/2018 Wester
9,943,734 B2 * 4/2018 James ..... A63B 60/00
9,975,011 B1 5/2018 Wester
10,035,049 B1 * 7/2018 Nielson ..... A63B 60/52
10,052,530 B2 8/2018 Greaney
10,086,240 B1 * 10/2018 Hoffman ..... A63B 53/0466
10,188,916 B2 * 1/2019 Harbert ..... A63B 60/00
10,245,474 B2 * 4/2019 Boggs ..... A63B 53/0466
10,293,220 B2 5/2019 Schweigert
10,343,033 B2 * 7/2019 Frame ..... A63B 60/54
10,463,926 B2 11/2019 Greaney
10,532,254 B1 1/2020 Evans
10,569,144 B2 * 2/2020 Nielson ..... A63B 60/00
10,632,350 B2 4/2020 Beach
10,653,926 B2 * 5/2020 Story ..... A63B 60/04
10,653,928 B2 5/2020 Parsons
10,695,623 B2 6/2020 Parsons
10,721,339 B2 7/2020 Rae
10,751,585 B2 8/2020 Johnson
10,773,135 B1 9/2020 Hoffman
10,780,327 B2 9/2020 Chao
10,828,540 B2 11/2020 Beach
10,843,048 B1 * 11/2020 Hoffman ..... A63B 60/00
10,843,051 B2 11/2020 Parsons
10,850,168 B2 12/2020 Kato
10,874,914 B2 * 12/2020 Johnson ..... A63B 53/08
10,874,916 B2 12/2020 Willet
10,881,917 B2 1/2021 Greensmith
10,881,918 B2 1/2021 Beach
10,881,920 B2 1/2021 Beach
10,881,921 B2 1/2021 Wester
10,888,742 B2 1/2021 Greensmith
10,888,753 B2 1/2021 Greaney
11,027,178 B2 6/2021 Sugimae
11,083,936 B2 8/2021 Boyd
11,213,728 B2 * 1/2022 Greaney ..... A63B 60/00
11,298,599 B2 * 4/2022 Mata ..... A63B 53/02
11,331,548 B2 * 5/2022 Johnson ..... A63B 53/08
2003/0130059 A1 * 7/2003 Billings ..... A63B 53/04 473/332
2005/0239576 A1 * 10/2005 Stites ..... A63B 53/0466 473/345
2006/0014592 A1 * 1/2006 Sugimoto ..... A63B 53/0466 473/345
2007/0117648 A1 * 5/2007 Yokota ..... A63B 53/0466 473/328
2008/0081709 A1 * 4/2008 Hirano ..... A63B 53/0466 473/346
2008/0096688 A1 * 4/2008 Yokota ..... A63B 60/02 473/345
2008/0161127 A1 * 7/2008 Yamamoto ..... A63B 60/00 473/345
2009/0005190 A1 * 1/2009 Hirano ..... A63B 53/0466 473/345
2009/0017938 A1 * 1/2009 Yokota ..... A63B 53/0466 473/349
2011/0159986 A1 * 6/2011 Chao ..... A63B 53/0466 473/345
2013/0324304 A1 12/2013 Soracco
2014/0274457 A1 * 9/2014 Beach ..... A63B 53/02 473/335
2016/0023062 A1 1/2016 Willet
2016/0271462 A1 9/2016 Knuth
2018/0078832 A1 * 3/2018 Stokke ..... A63B 53/04
2018/0280770 A1 10/2018 Wester
2019/0336834 A1 11/2019 Greaney
2020/0023245 A1 * 1/2020 Story ..... A63B 53/06
2020/0139208 A1 5/2020 Johnson
2020/0188741 A1 6/2020 Golden
2020/0188746 A1 6/2020 Sugimae
2020/0206586 A1 7/2020 Yamamoto
2020/0246667 A1 8/2020 Honea
2020/0282271 A1 9/2020 Harbert
2020/0322462 A1 10/2020 Rae
2020/0324182 A1 10/2020 Bennet
2020/0346079 A1 11/2020 Story
2020/0353322 A1 11/2020 Hoffman
2022/0184471 A1 * 6/2022 Greaney ..... A63B 53/0445
2022/0347526 A1 * 11/2022 Cleghorn ..... A63B 53/042

* cited by examiner

FAIRWAY WOOD GOLF CLUB HEAD WITH LOW CG

CROSS REFERENCE PRIORITIES

This claims priority to U.S. Provisional Application No. 63/217,695 filed Jul. 1, 2021, and to U.S. Provisional Application No. 63/076,766 filed Sep. 10, 2020, all of which are incorporated in their entirety.

FIELD

This disclosure relates to golf equipment, and more particularly, to a multi-material fairway type golf club having specific mass properties.

BACKGROUND

With a driver, the golfer can set the ball height to match their swing by setting the tee height to their preference. With a fairway-type club, the golfer is striking the ball from whatever golf ball ground lie exists. From that existing golf ball lie, the leading edge of the fairway-type golf club head is "what the ball sees" when the ball is struck. That is, the bounce depth of the sole of the fairway-type club is essentially BELOW the actual ground plane upon which the golf ball sits because the bounce is digging through the soil, creating a divot. The optimal impact is essentially constant in terms of the height of the golf ball as it lies, and therefore, essentially does not change with bounce depth and face height of various fairway-type golf club heads.

That means, in turn, that the best force impartation is along an axis of the fairway-type golf club head that is not model specific but driven by the geometry of the golf ball lie and also driven by maximizing the impact force at a specific point on the golf ball. Thus, locating the center of gravity (CG) of a fairway-type golf club head on that axis or as close as possible to that axis maximizes the force transmitted to the golf ball upon impact.

The invention is not directed to a driver-type golf club head because the impact point of a driver-type golf club head is variable when the golf ball is placed on a tee. The invention is not directed to a hybrid-type golf club head because the hybrid-type golf club head lacks sufficient depth in a front-to-rear measurement. Similarly, the invention is not directed to an iron-type club head because the iron-type golf club head lacks sufficient depth in a front-to-rear measurement. Further, the invention is not directed to putter-type club heads. The present embodiments are directed to fairway-type golf club heads with multi-material constructions that increase or maximize force transference to a golf ball by positioning the fairway-type club head CG in a low and rearward position body position along a force line axis perpendicular to the strike face at an expected, optimal impact position. A golf ball struck there will transmit the most energy to the golf ball. Because a fairway-type golf club head is used to hit a golf ball lying directly on the turf, instead of teed up, the point of impact is always at a fixed distance above the turf or ground plane. Further, the desirable location is also approximately near the center of the strike face. Therefore, an impact point where the most force will be transmitted to the golf ball is a force line impact point (FLIP). An axis extending rearward from the FLIP and perpendicular to the strike face is the FLIP axis. The FLIP axis is derived from the fairway-type club head's geometry and is congruent to a vector of force that most efficiently transmits force to a golf ball. The location of the fairway-type club head CG in relation to this FLIP axis will cause higher/lower ball speed, higher/lower launch, and higher/lower spin. Further, if the CG is located along the FLIP axis but comparatively closer to the strike face, the fairway-type golf club head will have a lower total moment of inertia (MOI). If the CG is located along the FLIP axis but comparatively farther toward the rear, the fairway-type golf club head will have a higher total moment of inertia (MOI). To achieve this optimized CG position, the fairway-type club head components are formed from various materials and carefully arranged to position the CG on or near the FLIP axis.

Various fairway-type golf club head design parameters, such as volume, a center of gravity position, and moment of inertia, affect impact performance characteristics (e.g., spin, launch angle, speed, forgiveness). Often, fairway-type club head designs that improve performance in one regard impact some other performance characteristics as well. The improvement of one performance characteristic can adversely affect other performance characteristics. Accordingly, there is a need in the art for a fairway-type club head, having enhanced but balanced impact performance characteristics.

DEFINITIONS

Figure 1A:
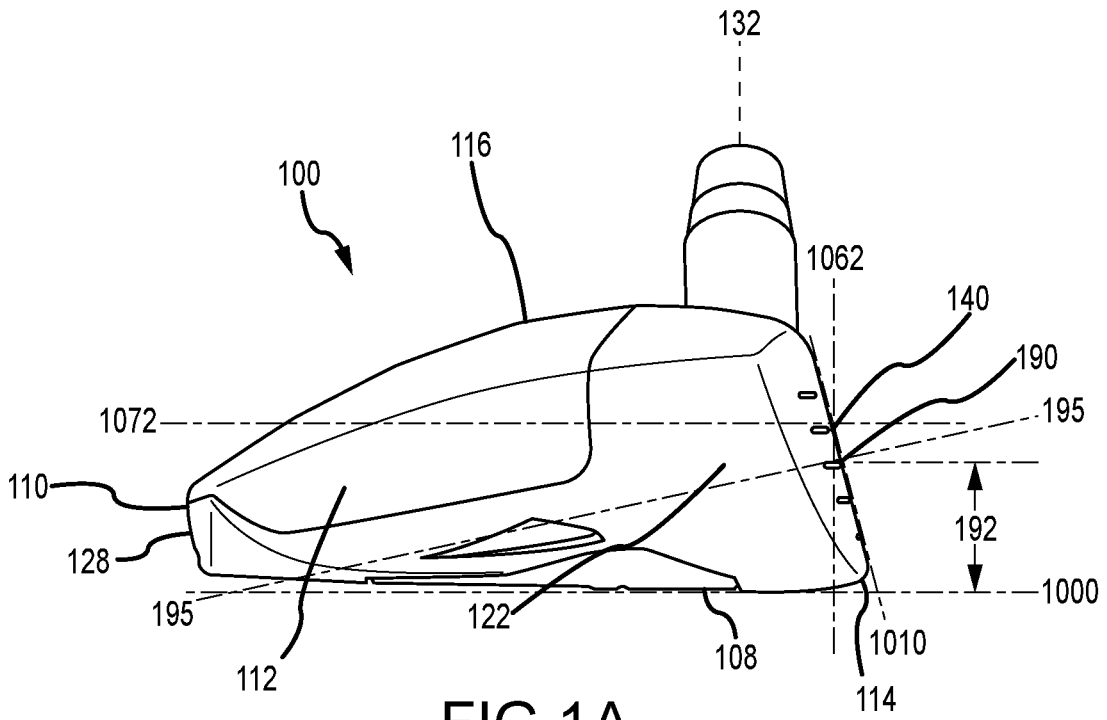
FIG. 1A illustrates a side view of a fairway-type golf club head.

The fairway-type golf club head comprises a main body, a face cup, a crown insert, a sole insert, and a rear weight, or any combination thereof. There are various embodiments of a fairway-type golf club head that achieves a low and rearward CG on the FLIP axis. The crown insert and main body are preferably formed from a low density material to provide additional discretionary mass to be redistributed to a golf club head lower portion. The main body and the face cup can comprise a metallic material such as a titanium alloy, or the main body can comprise a composite material such as a fiber reinforced polymer or a fiber reinforced composite. The crown insert can comprise a composite material such as a carbon composite material, a fiber reinforced polymeric material, a natural fiber composite, or any other suitable, low density material. The club head can comprise a large, high-density sole insert that drives the CG down closer to the sole. The sole insert can comprise a mass pad or a thickened region that balances the CG position on the force line in a front-to-rear direction. The sole insert can allocate a large percentage of the club head mass near the central portion of the sole to improve CG, and the sole insert can further also extend upwards along the main body toward the perimeter of the club head to improve MOI. The club head can further comprise a removable, adjustable, or interchangeable rear weight having a mass between 1 gram to 35 grams to further lower the CG and balance the CG along the FLIP axis. The sole insert and rear weight can comprise a dense metallic material such as titanium or steel.

The combination of a lightweight crown insert 800, main body 202, a high density sole insert 430, a removable, adjustable, or interchangeable rear weight assembly 1100, or a combination thereof provides a golf club head with a low center of gravity that is forgiving and reduces golf ball spin compared to a club head devoid of a sole insert. The fairway-type golf club head 100 described herein uses a high density sole insert 430, a lightweight crown insert 800, a removable, adjustable, or interchangeable rear weight assembly 1100, or a combination thereof, to balance the CG 172 along the FLIP axis 195.

I. General Terms

Features and aspects will become apparent by consideration of the following detailed description and accompanying drawings. Before any embodiments of the disclosure are explained in detail, it should be understood that the disclosure is not limited in its application to the details or construction and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents, and alternatives falling within the spirit and scope of the disclosure. Also, it is to be understood that the phraseology and terminology used herein is for the purpose of description and should not be regarded as limiting.

"The terms "left," "right," "front," "back," "top," "bottom," "over," "forward," "rearward," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein. In the interest of consistency and clarity, all directional references used herein assume that the referenced fairway-type golf club head is resting on a horizontally flat ground plane such that predefined loft and lie angles for the head are achieved. The "front" or "forward portion" of the fairway-type golf club head generally refers to the side of the fairway-type golf club head (when viewed normal to the ground plane) that includes the golf club strike face. Conversely, the rear portion of the club head can include anything behind the strike face and/or portions of the club that are trailing the strike face at impact.

A," "an," "the," "at least one," and "one or more" are described herein and interchangeable, indicating that at least one of the items is present; a plurality of such items can be present unless the context clearly indicates otherwise. All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that can arise from ordinary methods of measuring and using such parameters. In addition, disclosure of ranges includes disclosure of all values and further divided ranges within the entire range. Each value within a range and the endpoints of a range are hereby all disclosed as a separate embodiment. The terms "comprises," "comprising," "including," and "having" are inclusive and therefore specify the presence of stated items but do not preclude the presence of other items. As used in this specification, the term "or" includes any and all combinations of one or more of the listed items. When the terms first, second, third, etc., are used to differentiate various items from each other, these designations are merely for convenience and do not limit the items.

The terms "first," "second," "third," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but can include other elements not expressly listed or inherent to such process, method, system, article, device, or apparatus.

II. Fairway-Type Club Head

Figure 1B:
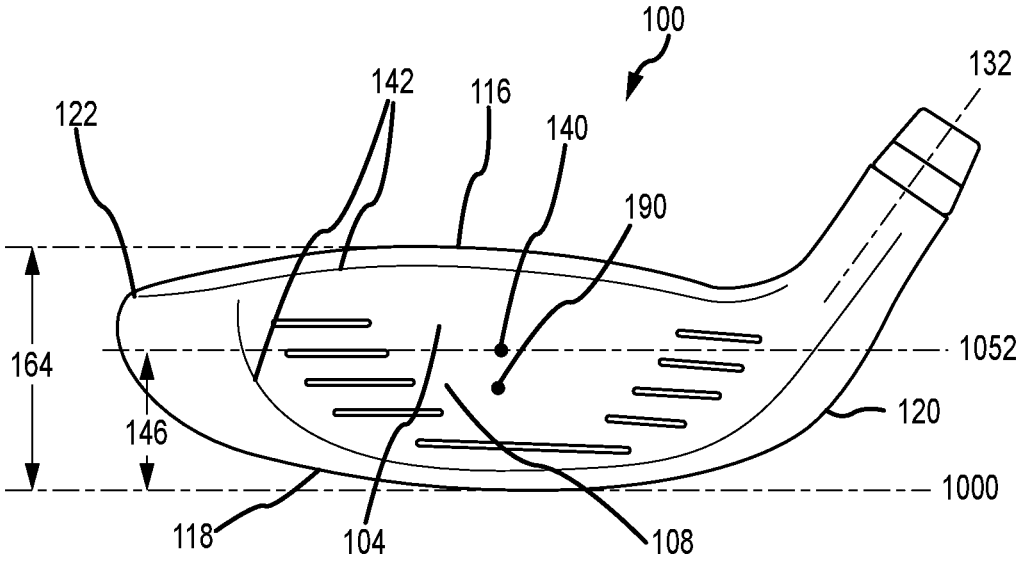
FIG. 1B illustrates a front view of a fairway-type golf club head.
Figure 1C:
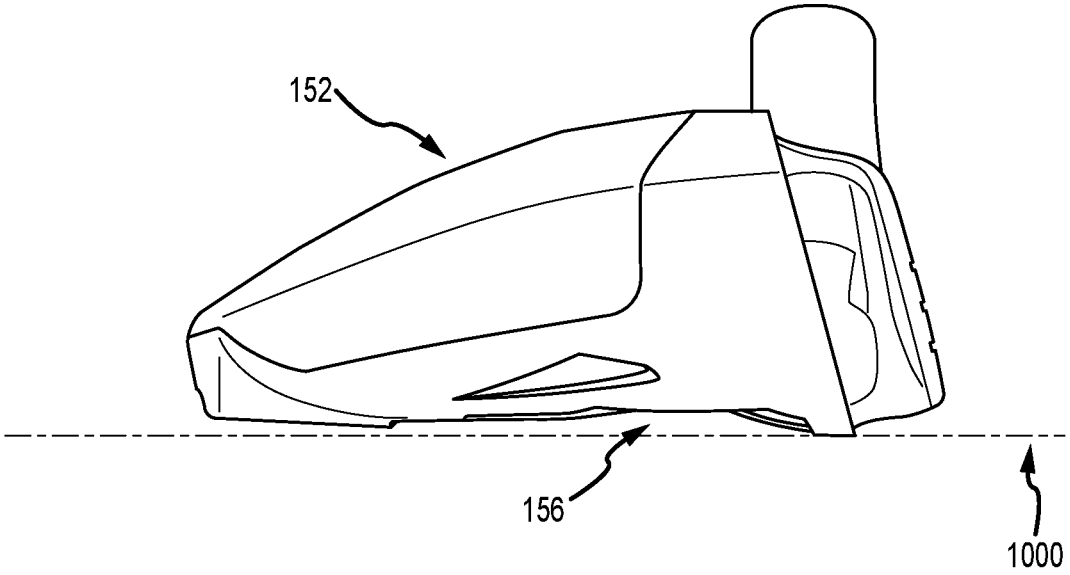
FIG. 1C illustrates a side view of a fairway-type golf club head with indicated ground plane.

A "fairway-type golf club head" as defined herein is a club head having particular lofts, volumes, and dimensions that can be defined by specific dimensional ranges. In particular, the fairway-type club head, as described with regard to the invention disclosed herein, includes a loft angle, volume, length, depth, height, and face height within the ranges defined below. The specified ranges below limit the fairway-type golf club head to a fairway-type club head. In other words, the fairway-type golf club head cannot be a driver type, a hybrid-type, an iron-type, or a putter-type golf club head. The fairway-type golf club head as defined herein and used below comprises features selected from the group consisting of a main body, a face cup, a crown insert, a sole insert, and a rear weight. FIGS. 1A and 1B illustrate a fairway-type golf club head 100 having a body 102 and a strike face 104. The body 102 of the club head 100 includes a front end 108, a rear end 110 opposite the front end 108, a crown 116, a sole 118 opposite the crown 116, a heel 120, and a toe 122 opposite the heel 120. The body 102 further includes a skirt or trailing edge 128 located between and adjoining the crown 116 and the sole 118, the skirt connecting from near the heel 120 to near the toe 122 of the club head 100.

The "loft angle" of the fairway-type club head as defined herein can be less than approximately 35 degrees, less than approximately 34 degrees, less than approximately 33 degrees, less than approximately 32 degrees, less than approximately 31 degrees, or less than approximately 30 degrees. In some embodiments, the loft angle of the fairway-type golf club head can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in some embodiments, the loft angle of the fairway-type golf club head can be between 14 degrees and 35 degrees, between 15 degrees and 35 degrees, between 20 degrees and 35 degrees, or between 12 degrees and 30 degrees.

The "volume" of the fairway-type club as described herein can be less than approximately 170 $cm^3$, less than approximately 180 $cm^3$, less than approximately 190 $cm^3$, or less than approximately 200 $cm^3$. However, the volume of the fairway-type club cannot be less than 160 $cm^3$. In some embodiments, the volume of the fairway-type club head can be between approximately 150 $cm^3$ to 200 $cm^3$, between approximately 160 $cm^3$ to 170 $cm^3$, between approximately 160 $cm^3$ to 180 $cm^3$, or between approximately 170 $cm^3$ to 190 $cm^3$. The volume of the fairway-type club cannot be greater than 200 $cm^3$. In one exemplary embodiment, the volume of the fairway-type club is 169 $cm^3$.

Figure 5A:
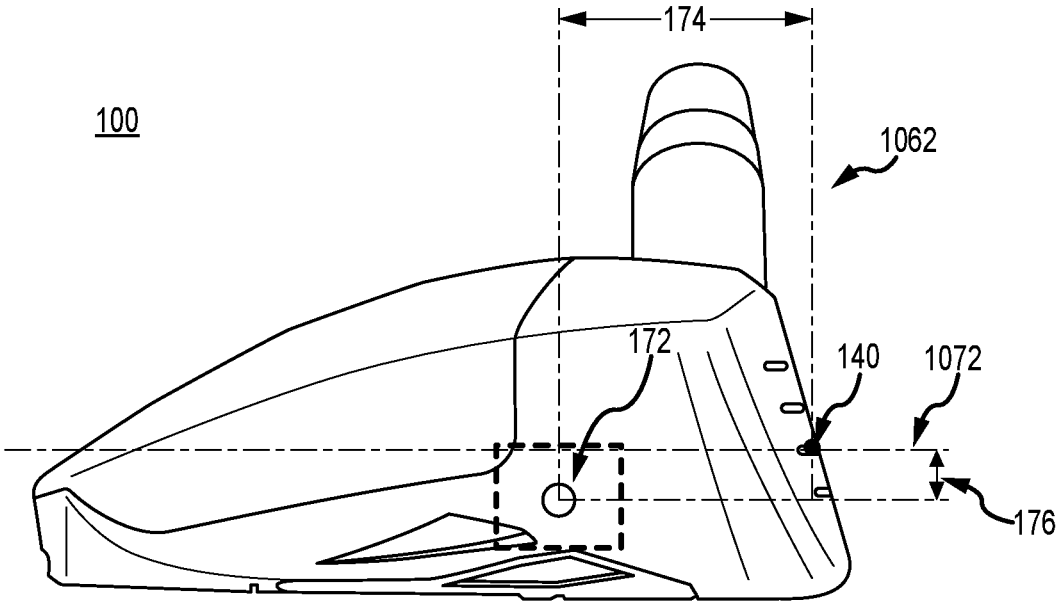
FIG. 5A illustrates a side view of a fairway-type golf club head with crown and sole inserts.
Figure 5B:
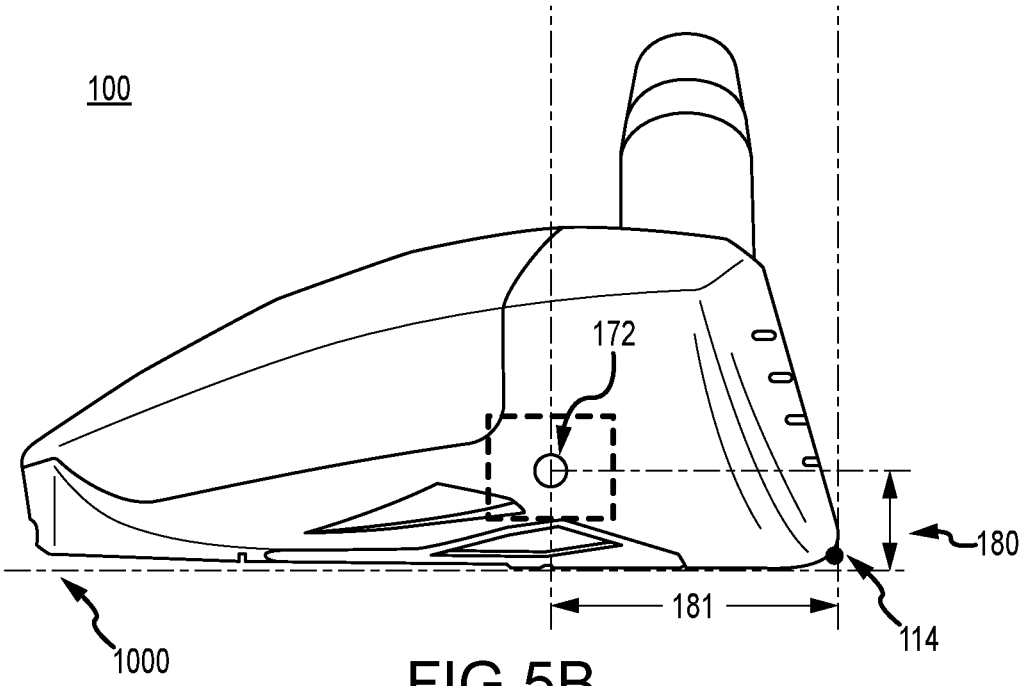
FIG. 5B illustrates a side view of a fairway-type golf club head with crown and sole inserts.
Figure 5C:
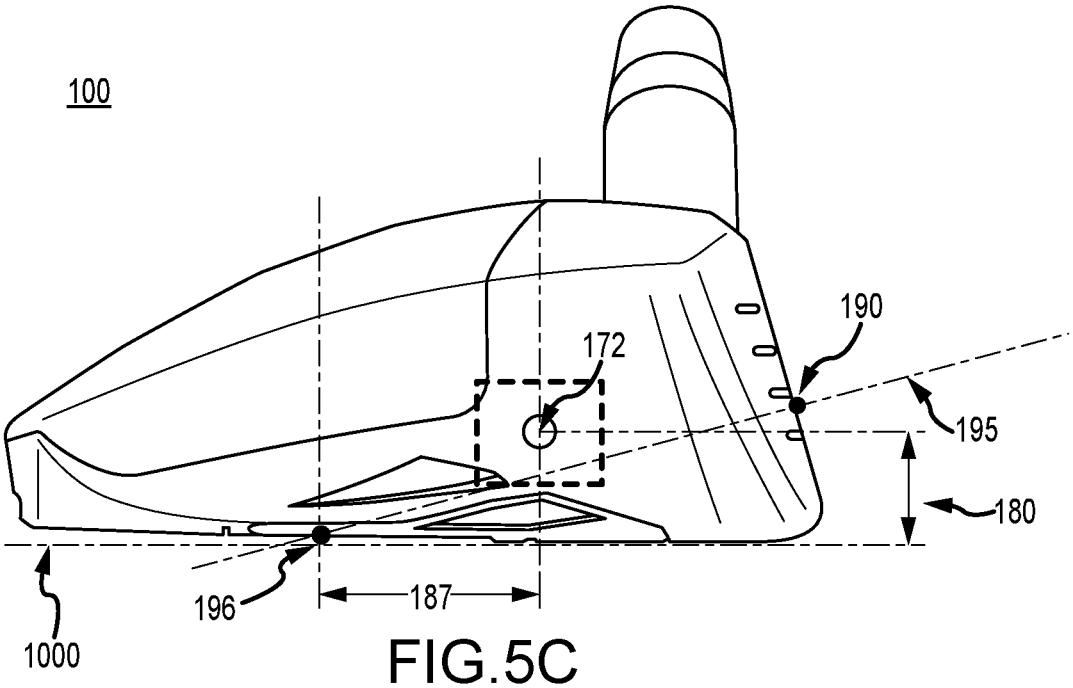
FIG. 5C illustrates a side view of a fairway-type golf club head with crown and sole inserts.
Figure 5D:
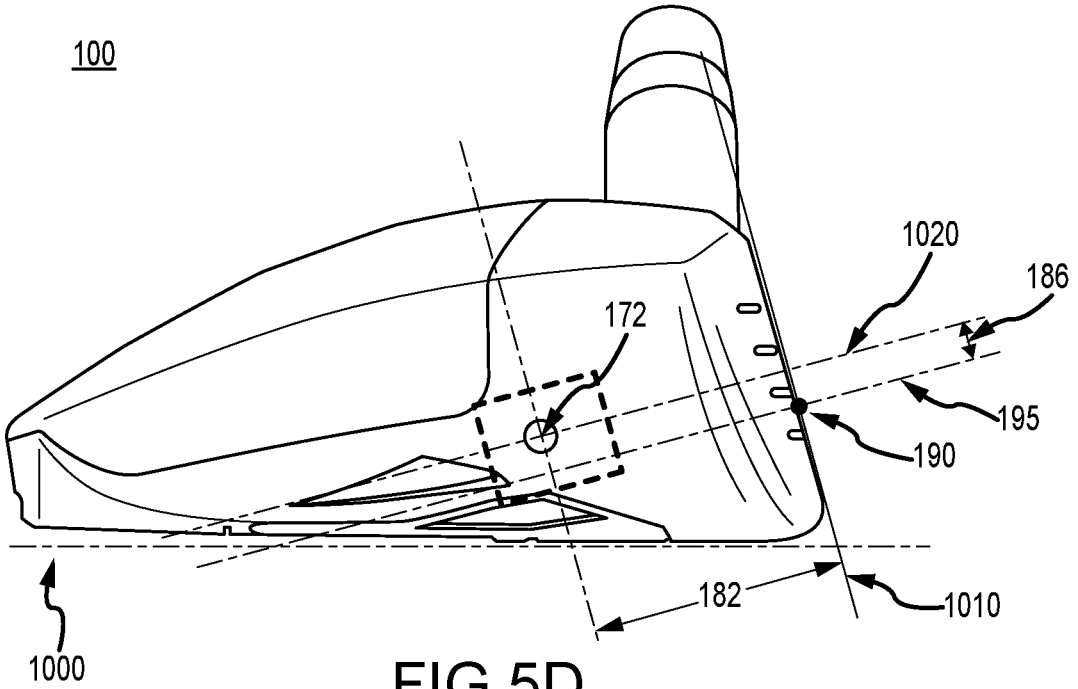
FIG. 5D illustrates a side view of a fairway-type golf club head with crown and sole inserts.
Figure 5E:
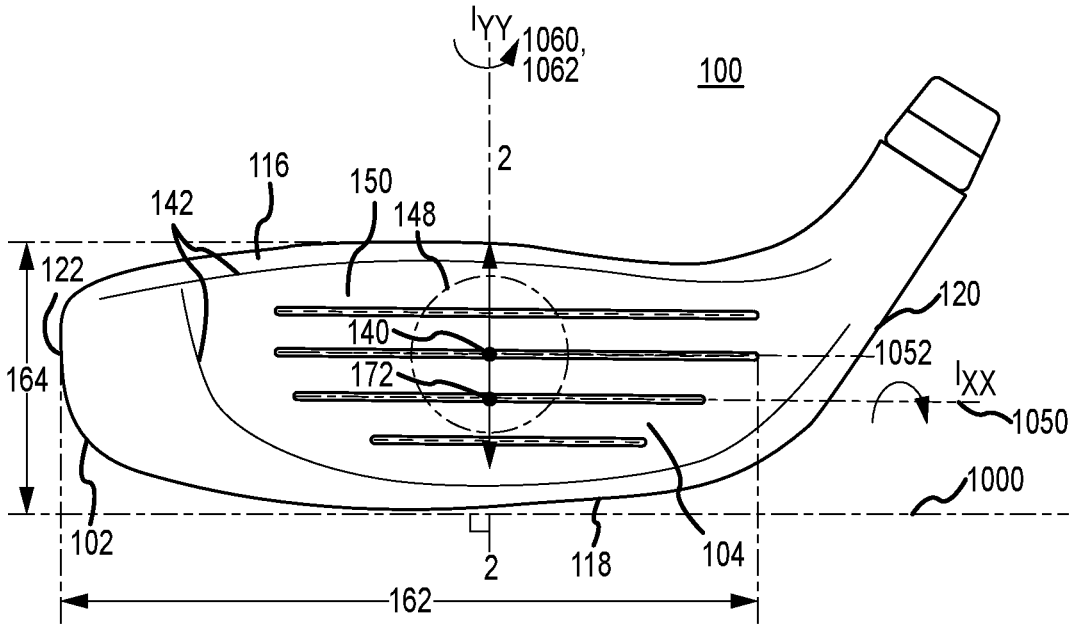
FIG. 5E illustrates a front view of a fairway-type golf club head.
Figure 5F:
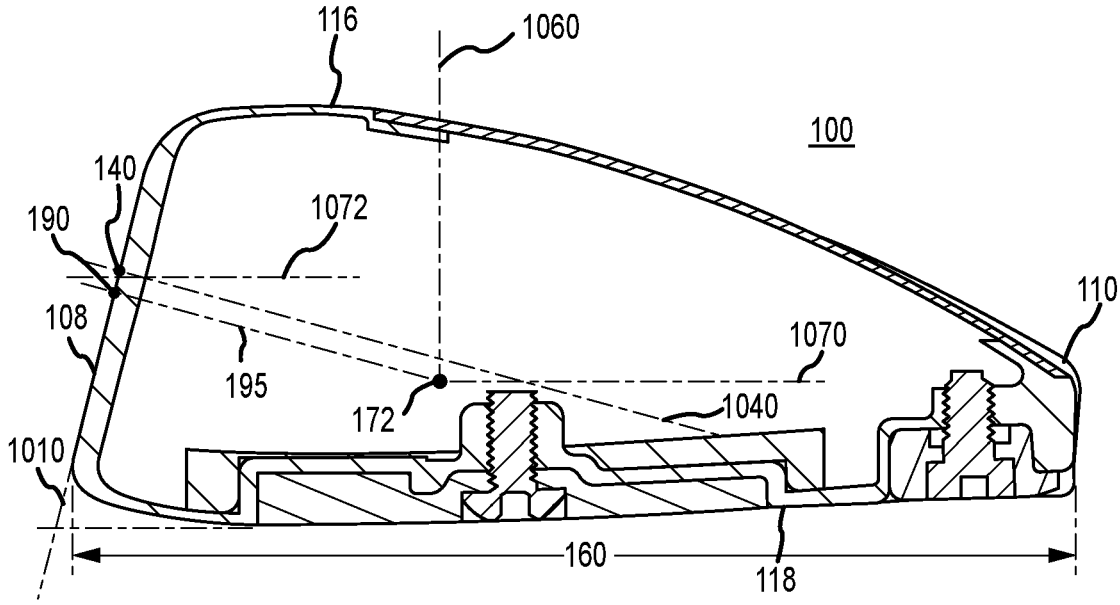
FIG. 5F illustrates a cross-sectional view of a fairway-type golf club head with crown and sole inserts.

The "fairway-type club head depth" 160 of the fairway-type golf club head as described herein can be defined as a front-to-rear dimension of the fairway-type golf club head. Referring to FIG. 5F, the depth 160 of the fairway-type club head is measured as the furthest extent of the club head from the front end 108 to the rear end 110, in a direction parallel to the Z axis 1072. The depth 160 can be in a range of between 3.00 inches to 4.00 inches. In some embodiments, the depth 160 can be between 3.00 inches to 3.40 inches, between 3.25 inches to 3.40 inches, between 3.30 inches to 3.50 inches, or between 3.50 inches to 4.00 inches. The depth 160 cannot be greater than 4.00 inches. In one exemplary embodiment, the depth 160 is 3.363 inches.

The "fairway-type golf club height" 164 of the fairway-type golf club head as described herein can be defined as a crown-to-sole dimension of the fairway-type club head. Referring to FIG. 5E, the height of the fairway-type golf club head 100 can be measured as the furthest extent of the fairway-type golf club head 100 from the crown 116 to the sole 118, in a direction parallel to the Y axis 1062, when viewed from the front view. In many embodiments, the height 164 of the club head 100 can be measured according to a golf governing body such as the United States Golf Association (USGA). For example, the height 164 of the club head 100 can be determined in accordance with the USGA's Procedure for Measuring the Club Head Size of Wood Clubs (USGA-TPX3003, Rev. 1.0.0, Nov. 21, 2003) (available at https://www.usga.org/content/dam/usga/pdf/Equipment/TPX3003-procedure-for-measuring-theclub-head-size-of-wood-clubs.pdf) (the "Procedure for Measuring the Club Head Size of Wood Clubs"). The height 164 can be in a range of between 1.25 inches to 2.00 inches. In some embodiments, the height 164 can be between 1.25 inches to 1.50 inches, between 1.30 inches to 1.50 inches, between 1.35 inches to 1.75 inches, between 1.45 inches to 1.80 inches, or between 1.50 inches to 2.00 inches. In one exemplary embodiment, the club head height 164 is 1.424 inches. The height 164 is not greater than 2.00 inches.

The "fairway-type club head length" 162 of the fairway-type golf club head as described herein can be defined as a heel-to-toe dimension of the fairway-type club head. Referring to FIG. 5E, the length 162 of the fairway-type golf club head 100 can be measured as the furthest extent of the club head 100 from the heel 120 to the toe 122, in a direction parallel to the X axis 1052, when viewed from the front view. In many embodiments, the length 162 of the club head 100 can be measured according to a golf governing body such as the United States Golf Association (USGA). For example, the length 162 of the club head 100 can be determined in accordance with the USGA's Procedure for Measuring the Club Head Size of Wood Clubs (USGA-TPX3003, Rev. 1.0.0, Nov. 21, 2003) (available at https://www.usga.org/content/dam/usga/pdf/Equipment/TPX3003-procedure-for-measuring-theclub-head-size-of-wood-clubs.pdf) (the "Procedure for Measuring the Club Head Size of Wood Clubs") (the "Procedure for Measuring the Club Head Size of Wood Clubs"). The length 162 can be in a range of between 3.00 inches to 4.60 inches. In some embodiments, the length 162 can be between 3.00 inches to 4.00 inches to 4.40 inches, between 4.25 inches to 4.40 inches, or between 4.30 inches to 4.60 inches. The length is not greater than 4.60 inches. In one exemplary embodiment, the length 162 is 4.384 inches.

Figure 3A:
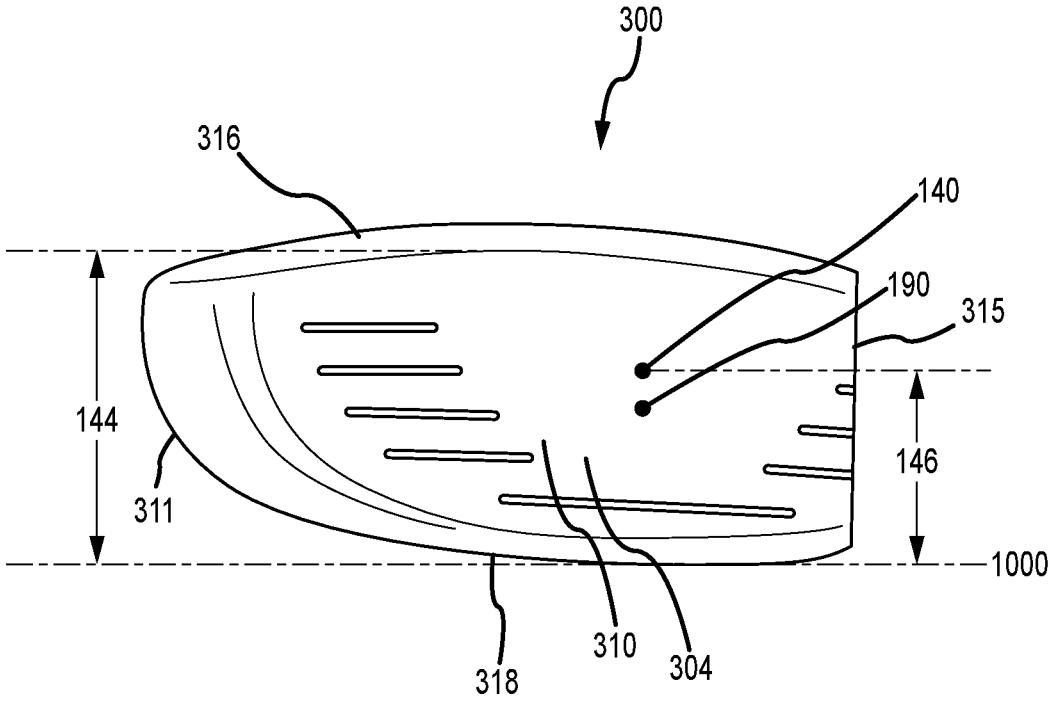
FIG. 3A illustrates a front view of a fairway-type golf club head face cup.
Figure 3B:
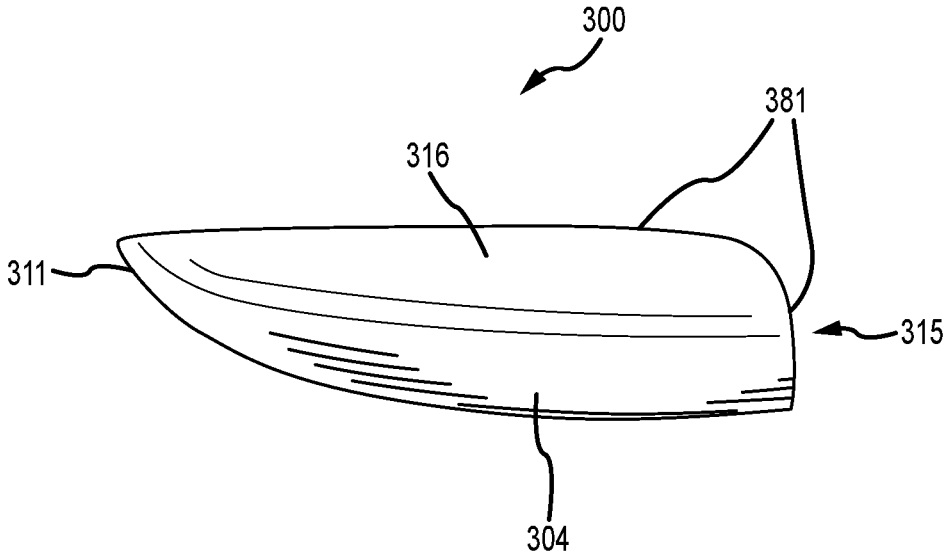
FIG. 3B illustrates a top view of a fairway-type golf club head face cup.

The "fairway-type face height" 144 of the fairway-type golf club head, as described herein, can be defined as a height measured parallel to loft plane 1010 between a top end of the strike face perimeter 142 near the crown 116 and a bottom end of the strike face perimeter 142 near the sole 118 (see FIG. 3A). In these embodiments, the strike face perimeter 142 can be located along the outer edge of the strike face 104, where the curvature deviates from the bulge and/or roll of the strike face 104. The face height 144 can range from 1.00 inches to 1.50 inches. In some embodiments, the face height 144 can be between 1.00 inches to 1.25 inches, between 1.00 inches to 1.15 inches, between 1.15 inches to 1.35 inches, or between 1.15 inches to 1.50 inches. In one exemplary embodiment, the face height 144 is 1.110 inches.

The "geometric center" 140 of the fairway-type golf club head, as described herein, is the geometric center point of a strike face perimeter 142. As another approach, the geometric center 140 of the strike face 104 can be located in accordance with the definition of a golf governing body such as the United States Golf Association (USGA). For example, the geometric center of the strike face can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The "geometric center height" 146 of the fairway-type golf club head, as described herein, is a height measured perpendicular from the ground plane 1000 to the geometric center of the fairway-type club head. The geometric center height 146 can range from 0.40 inch to 0.75 inch. For example, the geometric center height 146 can be between 0.40 inch to 0.60 inch, between 0.50 inch to 0.70 inch, or between 0.65 inch to 0.75 inch. In one exemplary embodiment, the geometric center height 146 is 0.661 inch.

The "leading edge" 114 of the fairway-type golf club head as described herein can be identified as the most sole-ward portion of the strike face perimeter 142. For example, a fairway-type golf club head leading edge 114 is the transition from the roll and bulge of the strike face to the sole of the fairway-type golf club head.

The "force-line impact point" (or FLIP) 190 of the fairway-type golf club head as defined herein and used below is the point on the strike face 104, at which point the force of the fairway-type golf club stroke is most efficiently transmitted to a golf ball.

The "FLIP height" 192 of the fairway-type golf club head, as described herein, can be a height measured perpendicular from the ground plane 1000 to the FLIP 190. The FLIP height 192 is within a range between 0.55 inch to 0.75 inch. The FLIP height 192 can be approximately 0.55 inch, approximately 0.56 inch, approximately 0.57 inch, approximately 0.58 inch, approximately 0.59 inch, approximately 0.60 inch, approximately 0.61 inch, approximately 0.62 inch, approximately 0.63 inch, approximately 0.64 inch, approximately 0.65 inch, approximately 0.66 inch, approximately 0.67 inch, approximately 0.68 inch, approximately 0.69 inch, approximately 0.70 inch, approximately 0.71 inch, approximately 0.72 inch, approximately 0.73 inch, approximately 0.74 inch, or approximately 0.75 inch.

The "force-line impact point axis" (or FLIP axis) 195 of the fairway-type golf club head as defined herein and used below is an axis originating at the FLIP 190, extending rearward from the strike face 104, and perpendicular to the strike face 104 at the FLIP 190.

A "perimeter" 112 of the fairway-type golf club head as defined herein comprises the transition from a club head upper portion 152 to a club head lower portion 156. The perimeter 112 is defined by a series of points around the golf club head, each having a tangent to a line drawn perpendicular to the ground plane 1000 when the fairway-type golf club head 100 is in the address position. The perimeter of the fairway-type golf club head 100 is the sum of all these points. The upper portion 152 of the fairway-type golf club head 100 is defined as that portion of the fairway-type golf club head 100, excluding the strike face 104, above the fairway-type golf club head perimeter. The lower portion 156 of the fairway-type golf club head 100 is defined as that portion of the fairway-type golf club head 100, excluding the strike face 104, that is below the fairway-type golf club head perimeter.

Figure 2A:
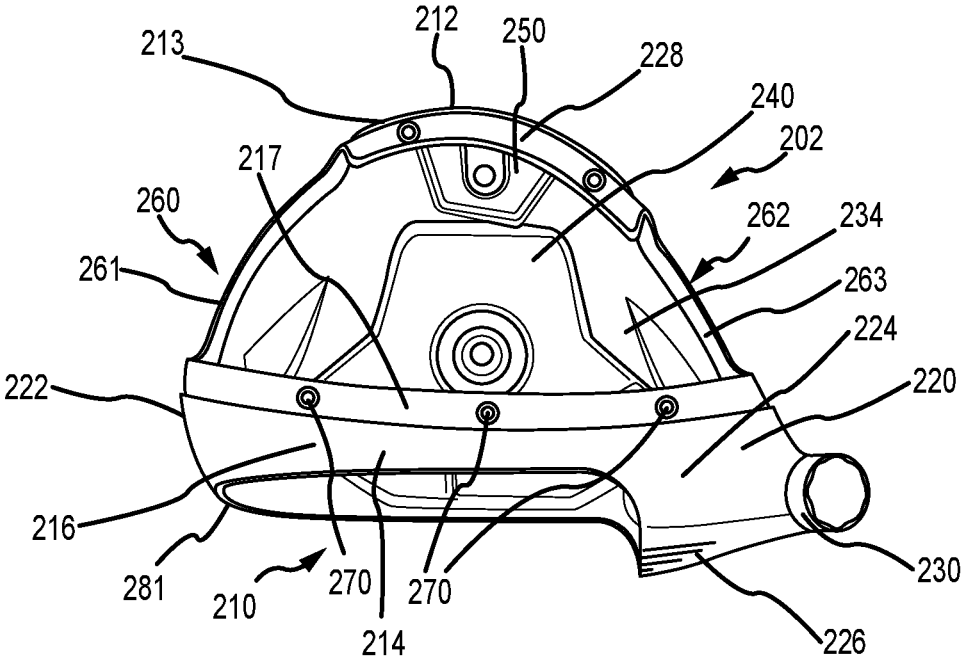
FIG. 2A illustrates a partial cut away top view of a fairway-type golf club head main body.
Figure 2B:
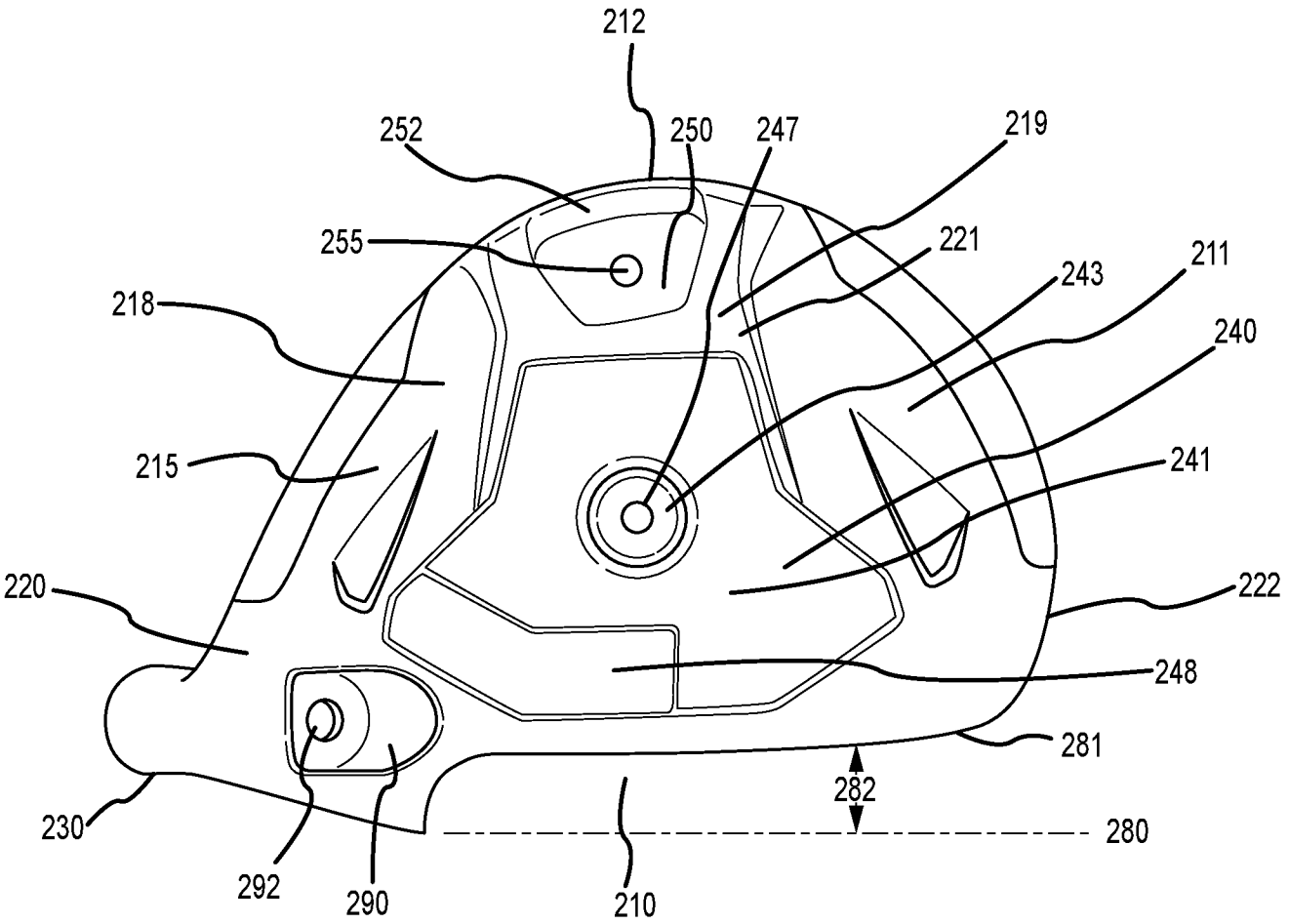
FIG. 2B illustrates a sole view of a fairway-type golf club head main body.
Figure 2C:
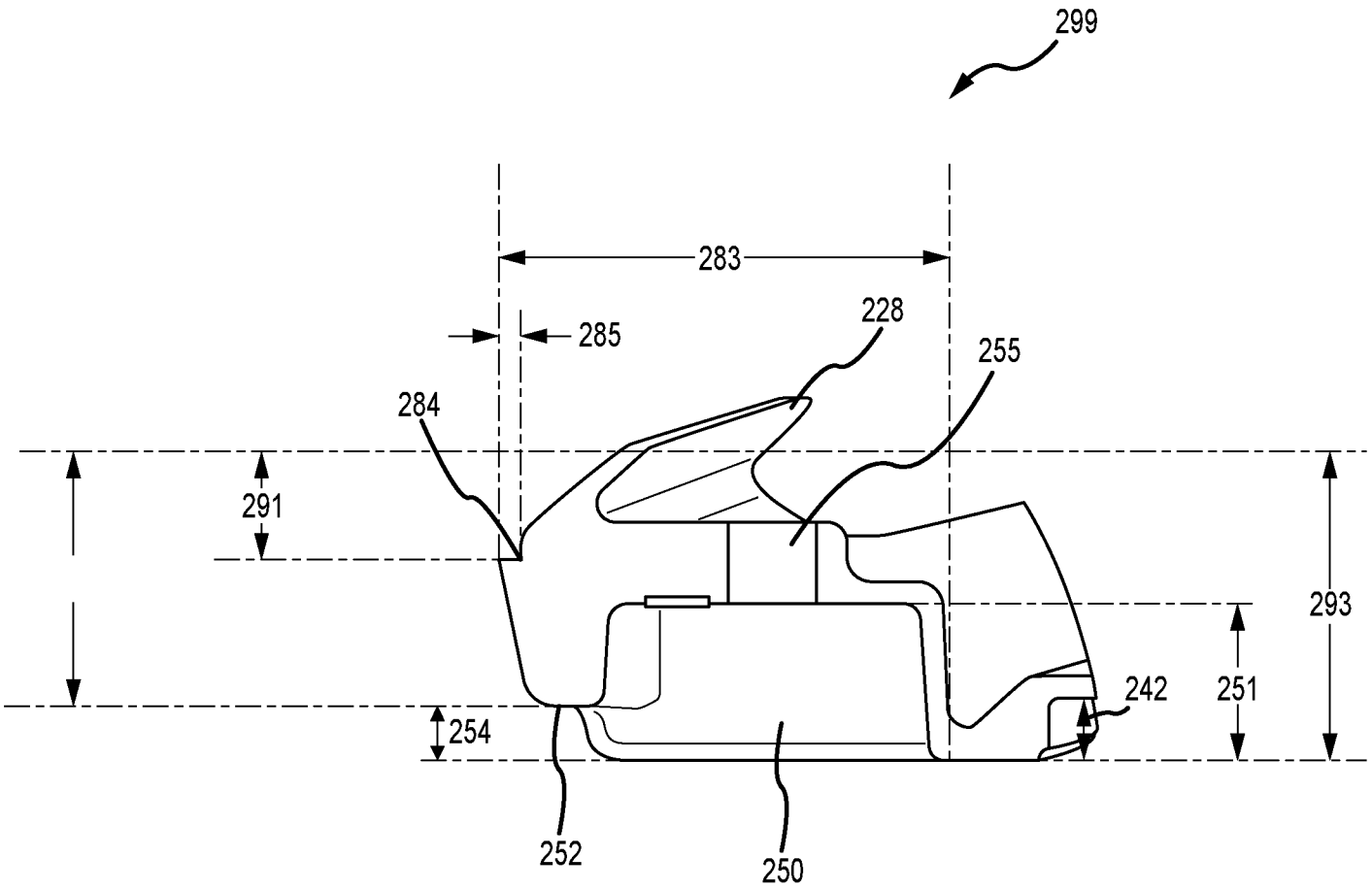
FIG. 2C illustrates a side view of a fairway-type golf club head rear weight support structure.

The "main body" 202 of the fairway-type golf club head as defined herein and used below provides the attachment and mechanical structure to which a crown insert, face cup, sole insert, and rear weight are attached to form the fairway-type golf club head 100. Referring to FIGS. 2A-2C, the fairway-type golf club head main body 202 comprises a main body front portion 214, a main body rear portion 212, a main body toe portion 222, a main body heel portion 220, and a sole 218, and a crown return 216. The main body heel portion 220 as defined herein and used below comprises a heel return 224, a heel strike face portion 226, and a hosel 230. The main body front portion 214 as defined herein and used below comprises a front aperture 210, the main body toe portion 222, the heel return 224, the heel strike face portion 226, the sole 218, and the crown return 216.

A "sole" 218 of the fairway-type golf club head as defined herein and used below is a lower, groundward facing portion of the main body and comprises a sole outer surface 219, a sole toeward portion 211, a sole heelward portion 215, and a sole central portion 221. The sole 218 comprises a sole insert recess 240. The sole 218 further comprises a rear weight recess 250. The sole central portion 221 is generally parallel to the ground plane 1000 in a heel-to-toe direction. The sole toeward portion 211 curves upwards in a crownward direction from the sole central portion 221. The sole heelward portion 215 curves upwards in a crownward direction from the sole central portion 221.

A "sole insert recess" 240 of the fairway-type golf club head as defined herein and used below is an indentation having its outermost surface inward from the sole outer surface 219. The sole insert recess 240 has a majority of its extent within the sole central portion 221. The sole insert recess 240 further comprises a sole insert recess floor 241, a sole insert fastener recess 243, a sole insert fastener aperture 247, and a sole insert forward mass pad recess 248. The mass pad recess 248 can be located in different locations of the sole insert recess 240. The sole insert comprises a sole insert recess floor depth 242 measured inwardly from the sole outer surface 219. The sole insert forward mass pad recess 248 further comprises a forward mass pad recess depth 249 (not shown) measured inwardly from the sole insert recess floor 241. The mass pad recess depth 249 corresponds to the sole insert thickness 448. The sole 218 further comprises a shaft attachment recess 290 and a shaft fastener aperture 292.

The "sole rear weight recess" 250 of the fairway-type golf club head, as defined herein and used below, is an inward indention in a rear portion of the sole 218 configured to receive a rear weight, having a sole rear weight recess depth 251 measured inwardly from the adjacent sole outer surface 219. The sole rear weight recess 250 comprises a weight recess rear ledge 252 having a ledge depth 254 measured inwardly from the adjacent sole outer surface 219 less than the weight recess depth 251. The rear weight recess 250 comprises a rear weight fastener aperture 255.

Figure 7A:
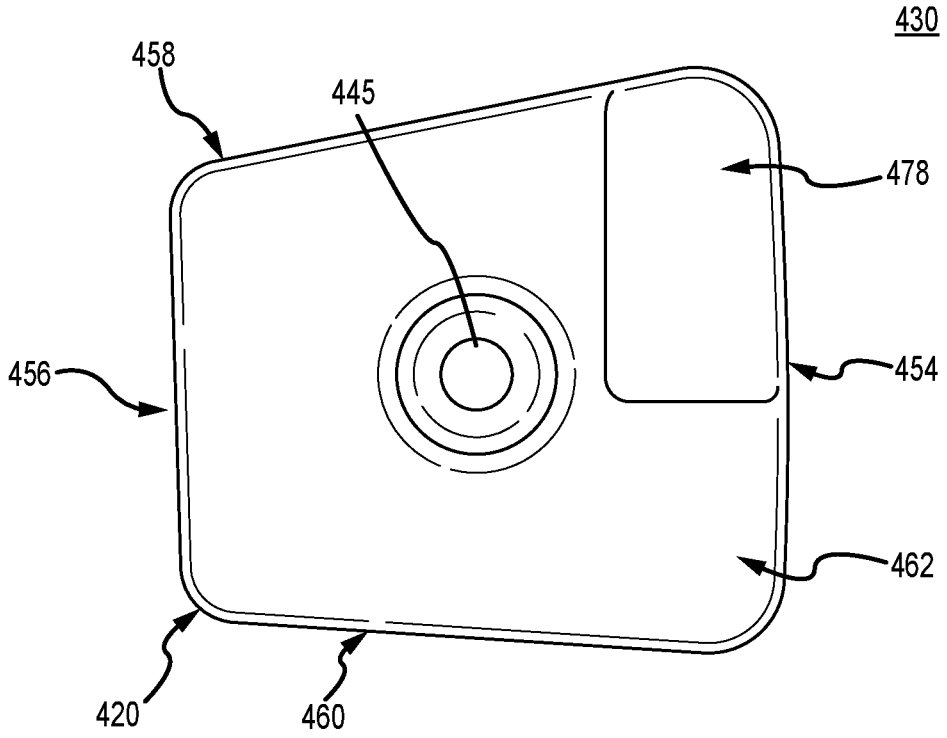
FIG. 7A illustrates a top view of a fairway-type golf club head sole insert with an aperture.

The "sole insert" 430 of the fairway-type golf club head as defined herein and used below is a high density insert configured to be received within the sole insert recess 250. Referring to FIG. 7A, the sole insert 430 comprises a perimeter 420 having front edge 454, a rear edge 456, a heel side edge 458, a toe side edge 460, a top surface 462, and a bottom surface 464. The sole insert 430 is configured to be received within the sole insert recess 240 such that the top surface 462 is in contact with the sole insert recess floor 241, and the bottom surface 464 forms a portion of the sole outer surface 219. The sole insert 430 can be relatively large such that it defines a substantial portion of the sole outer surface 219. The sole insert perimeter 420 is used to define the sole insert 430 dimensions such as length, width, and thickness.

Figure 7B:
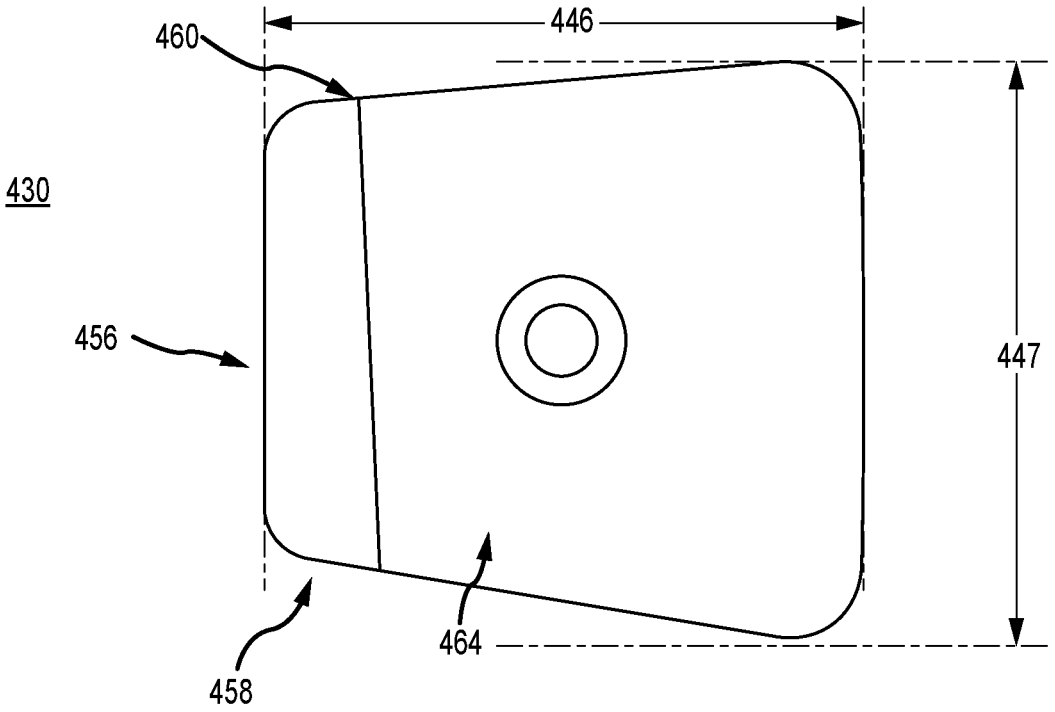
FIG. 7B illustrates a bottom view of a fairway-type golf club head sole insert with an aperture.

The "sole insert depth" 446 of the fairway-type golf club head, as defined herein and used below, is measured across the sole insert in a front-to-rear direction front edge 454 to the rear edge 456 (see FIG. 7B). The sole insert depth 446 can be uniform across the sole insert 430 in a heel-to-toe direction. Alternatively, the depth 446 can vary across the sole insert 430 in a heel-to-toe direction. The sole insert depth 446 can range between 0.5 inch to 2.00 inches. The depth 446 can be greater than 1.3 inches, greater than 1.4 inches, greater than 1.5 inches, greater than 1.6 inches, greater than 1.7 inches, or greater than 1.8 inches. Alternatively, the depth 446 can range between 0.5 inch to 2.0 inches, between 0.6 inch to 1.8 inch, between 1.3 inches to 1.6 inches, between 1.5 inches to 1.8 inches, between 1.7 inches to 1.8 inches, or between 1.7 inches to 2.0 inches. In one exemplary embodiment, the maximum depth 446 is 1.76 inches. The sole insert depth 446 is selected to provide a large mass near the sole 118 to lower CG while remaining within the footprint of the main body sole 218.

The "sole insert length" 447 of the fairway-type golf club head, as defined herein and used below, is measured from the sole insert heel side edge 458 to the sole insert toe side edge 460 (see FIG. 7B). The sole insert length 447 can be uniform across the sole insert 430 in a front-to-rear direction. Alternatively, the length 447 can vary across the sole insert 430 in a front-to-rear direction. The sole insert length 447 can range between 1.00 inches to 4.00 inches. The length 447 can be greater than 2.2 inches, greater than 2.3 inches, greater than 2.4 inches, greater than 2.5 inches, greater than 2.6 inches, or greater than 2.7 inches. Alternatively, the length 447 can range between 1.0 inch to 2.6 inch, between 2.2 inches to 2.6 inches, between 2.4 inches to 2.7 inches, between 2.5 inches to 2.8 inches, or between 2.7 inches to 3.0 inches. In one exemplary embodiment, the maximum length 447 is 2.54 inches.

Figure 7C:
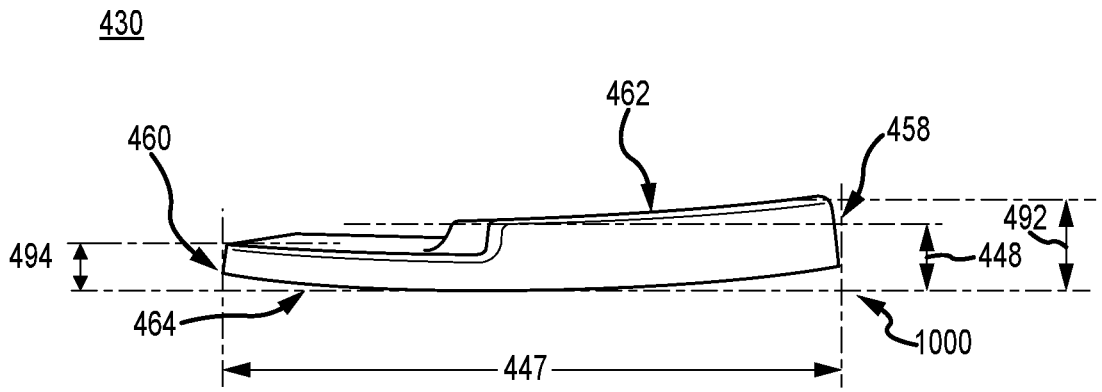
FIG. 7C illustrates a front view of a fairway-type golf club head sole insert with variable thickness.

The "sole insert thickness" 448 of the fairway-type golf club head, as defined herein and used below, is measured from the sole insert top surface 462 to the sole insert bottom surface 464 (see FIG. 7C). The sole insert 430 can be thinned or thickened over different portions to balance the club head CG 172. The thickness 448 can vary in a front-to-rear and/or heel-to-toe direction across the sole insert 430. Alternatively, the sole insert thickness 448 can be uniform in a front-to-rear and/or heel-to-toe direction across the sole insert 430. The sole insert thickness 448 can range between 0.050 inch to 0.30 inch. The thickness 448 can be greater than 0.050 inch, greater than 0.055 inch, greater than 0.060 inch, greater than 0.065 inch, greater than 0.070 inch, greater than 0.075 inch, greater than 0.080 inch, greater than 0.085 inch, greater than 0.090 inch, greater than 0.095 inch, greater than 0.10 inch, greater than 0.11 inch, greater than 0.12 inch, greater than 0.13 inch, greater than 0.14 inch, greater than 0.15 inch, greater than 0.16 inch, greater than 0.17 inch, greater than 0.18 inch, greater than 0.19 inch, greater than 0.20 inch, greater than 0.21 inch, greater than 0.22 inch, greater than 0.23 inch, greater than 0.24 inch, greater than 0.25 inch, greater than 0.26 inch, greater than 0.27 inch, greater than 0.28 inch, greater than 0.29 inch, or greater than 0.30 inch. Alternatively, the thickness 448 can be between 0.050 inch to 0.10 inch, between 0.075 inch to 0.20 inch, or between 0.075 inch to 0.20 inch. The sole insert thickness 448 is selected to provide substantial mass near the sole 118 while balancing club head CG 172 in a front-to-rear and a heel-to-toe direction.

The "crown aperture" 234 of the fairway-type golf club head as defined herein and used below comprises an upper, topside opening, surrounded and defined by the main body toe portion 222, the main body heel portion 220, the sole 218, the crown return 216, and the main body rear portion 212. The crown aperture 234 comprises a toe indention 260 and a heel indention 262 wherein each of the toe indention 260 and the heel indention 262 extend the crown aperture 234 past a transition from an upper portion of the fairway-type golf club head 100 towards a lower portion of the fairway-type golf club head 100. The crown aperture perimeter further comprises a crown flange 217, a rear flange 228, a toe crown aperture toe indention flange 261, and a crown aperture heel indention flange 263. The crown flange 217 is inwardly recessed from the crown return 216 and has an outer surface oriented upwardly. The rear flange 228 is recessed inwardly from a main body rear portion rear edge 213 and has an outer surface oriented towards the rear and upwardly. The toe indention flange 261 is inwardly recessed from an outer surface of the toe portion 222 and an outer surface of the sole 218. An outer surface of the toe indention flange 261 is oriented toeward and downward. The heel indention flange 263 is inwardly recessed from the heel portion 220 and the sole 218. An outer surface of the heel indention flange 263 is oriented heelward and downward. The outer surface of the crown flange 217, the rear flange 228, the toe indention flange 261, and the heel indention flange 263 further comprise a plurality of flange spacers 270. The flange spacers 270 extend outwardly from the outer surface of each flange to provide a gap when a crown insert 800 is adhesively attached in the crown aperture 234.

A "joint depth" of the fairway-type golf club head as defined herein and used below is the distance the crown flange 217, rear flange 228, toe flange 261, and the heel flange 263 are recessed inwardly from a main body 202 outermost surface. The joint depth is measured from the outer surface of the main body 202 to the outer surface of the respective flange 217, 228, 261, 263. The joint depth can be in a range of between 0.010 inch to 0.050 inch. In some embodiments, the joint depth is between 0.010 inch to 0.030 inch, between 0.020 inch to 0.040 inch, or between 0.025 inch to 0.050 inch. In one exemplary embodiment, the joint depth is 0.030 inch.

The "front aperture" 210 of the fairway-type golf club head, as defined herein and used below, is a forward opening, surrounded and defined by the main body toe portion 222, the heel return 224, the heel strike face portion 226, the sole 218, and the crown return 216. The front aperture 210 defines a front aperture plane 280 generally parallel to a loft plane 1010. The front aperture plane 280 is offset rearwardly from the loft plane 1010, a front aperture plane offset distance 282.

The "rear weight support structure" 299 of the fairway-type golf club head as defined herein and used below is a section of the sole central portion 221 that is thickened and located at a far rearward portion of the fairway-type golf club head. Referring to FIGS. 2A-2C, the support structure 299 comprises a rear flange 228, a rear weight recess 250, and the supporting material around the rear weight recess 250. The support structure has a structure length 283, measured front to rear, is in a range of 1.50 inches to 0.75 inches. The support structure length 283 is measured from the rearward most exterior point on the fairway-type golf club head to the forward most interior wall of the rear weight recess 250. The support structure 299 comprises a support structure height 293 measured from a bottom outer surface of the golf clubhead to the upper most point of the rear flange 228. The support structure height 293 can be in a range of 0.30 inch to 1.50 inches. The ledge depth 254 measured inwardly from the adjacent sole outer surface 219 can be in a range of 0.05 inch to 0.15 inch. The weight recess rear ledge 252 is open to the rear of the fairway-type golf club head and open to the bottom of the fairway-type golf club head. The weight recess rear ledge 252 is configured to receive a rear weight rearward protrusion. The rear flange 228 comprises a rear flange height 291 and a rear flange length measured from a toe side to a heel side of the rear flange 228. The rear flange 228 is configured to receive a rearmost portion of the crown insert 800, such that the crown insert 800 lower rear edge is supported. Accordingly, the rear flange 228 is offset inwardly from the rear outer surface of the fairway-type golf club head 100 forming a support structure inset 284. The support structure inset 284 comprises an inset depth 285 in a range of 0.01 inch to 0.25 inch corresponding to a crown insert thickness at this location, plus a bond line depth for an adhesive bond line. Because the support structure height 293 must encompass the rear weight recess depth 251, the height of the rear weight fastener aperture 255, and the rear flange height 291, the support structure 229 comprises a support structure mass that is relatively large. The support structure mass is in a range of 0.1 grams to 50.0 grams. Further, when the rear weight 1111 is received in the rear weight recess 250, the support structure 229 and weight mass is 25 grams or greater.

Figure 4A:
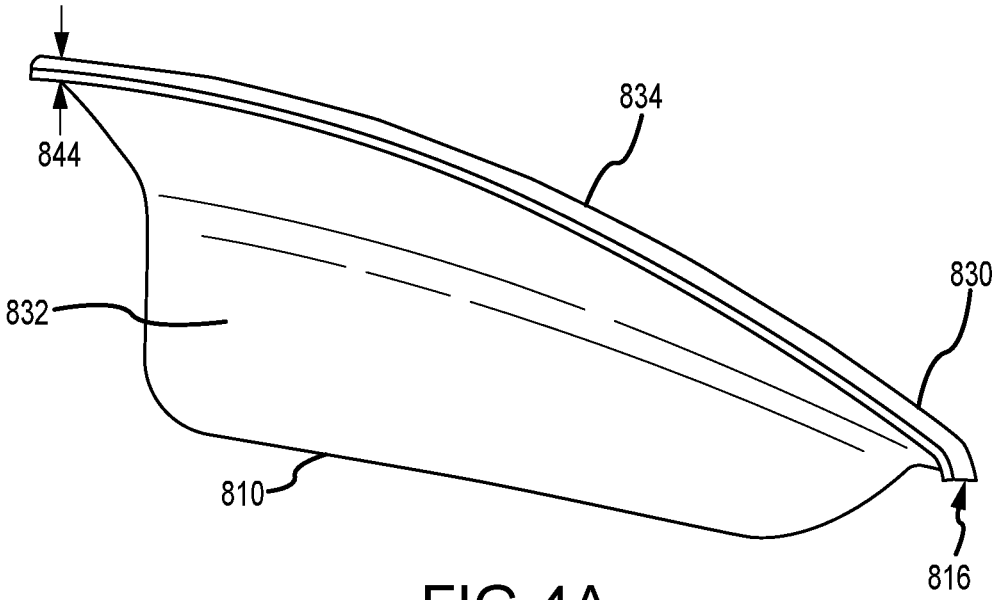
FIG. 4A illustrates a cross-sectional view of a fairway-type golf club head crown insert and wrap around section.
Figure 4B:
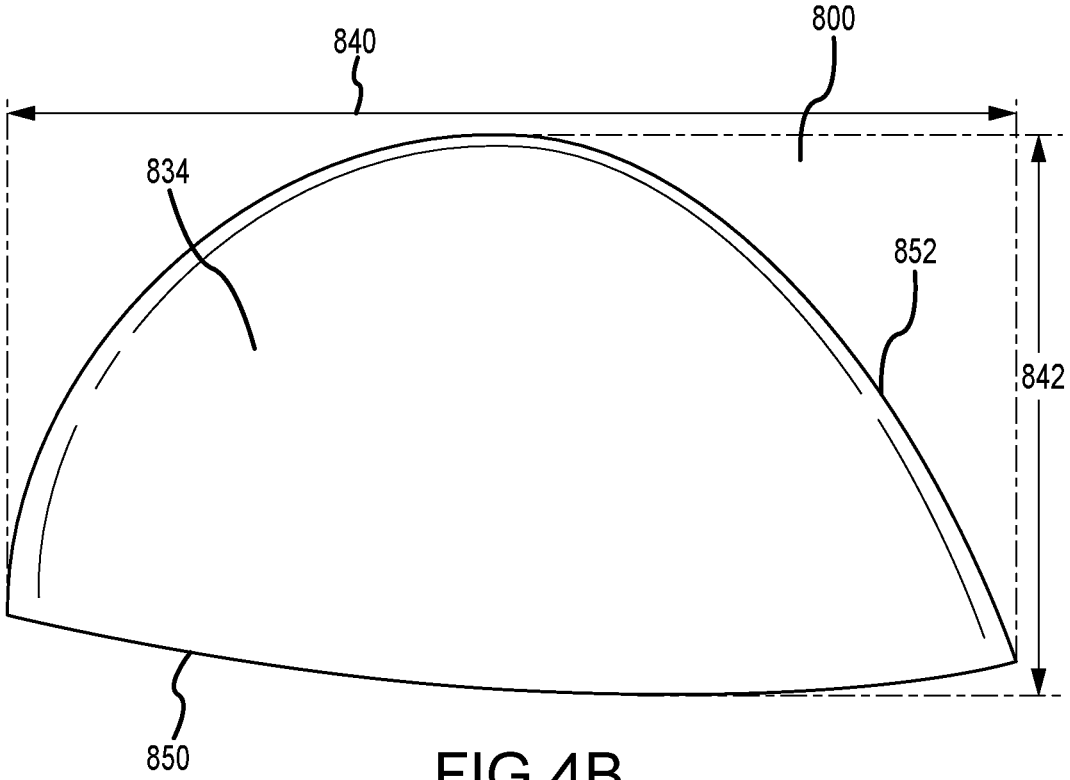
FIG. 4B illustrates a top view of a fairway-type golf club head crown insert.
Figure 4C:
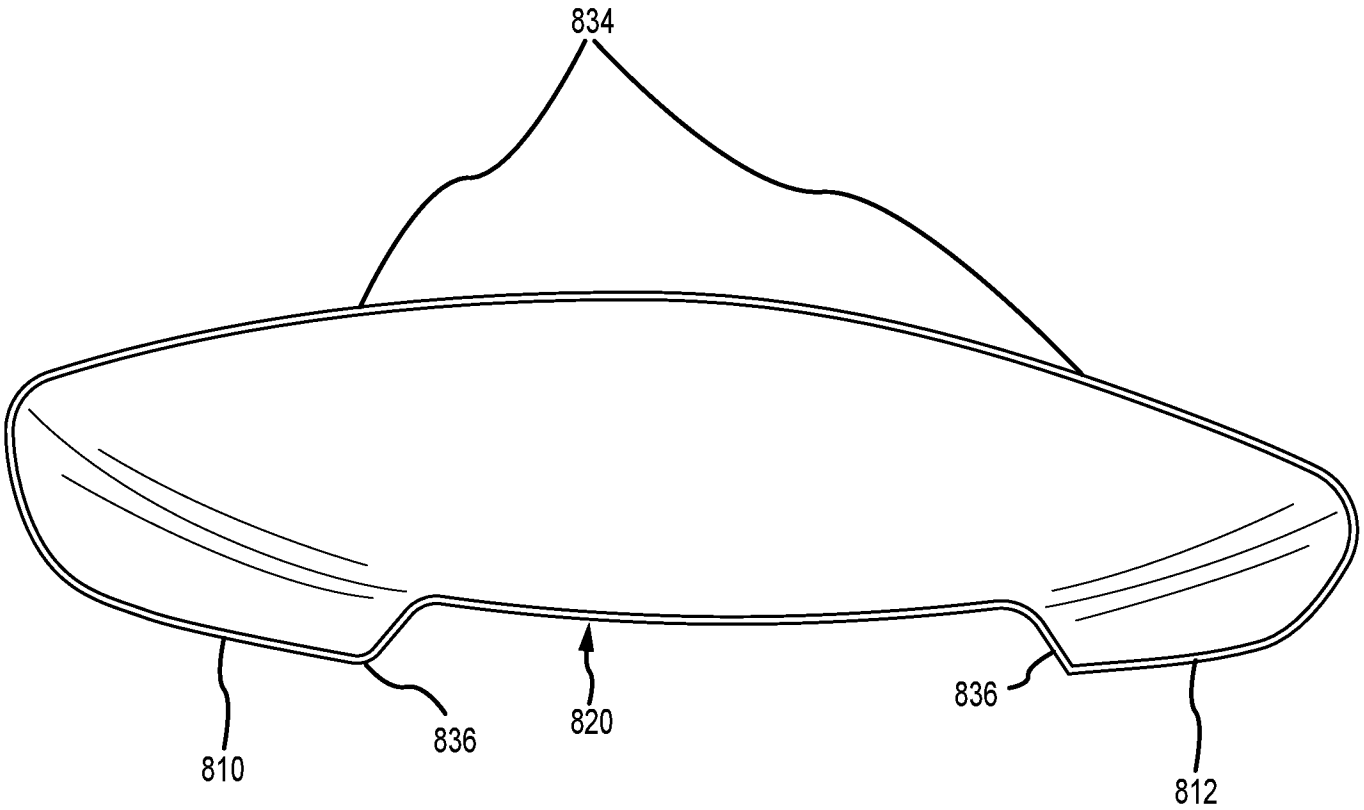
FIG. 4C illustrates a rear view of a fairway-type golf club head crown insert.

The "crown insert" 800 of the fairway-type golf club head as defined herein and used below is a lightweight component configured to be received within the crown aperture 234 of the main body 202. Referring to FIGS. 4A-4C, the crown insert 800 extends toward the club head sole 118, covering the toe indention 260 and forming a portion of the club head outer surface over the toe indention flange 261. Similarly, the crown insert heel wing 812 extends toward the club head sole 118, covering the heel indention 262 and forming a portion of the club head outer surface over the heel indention flange 263. The crown insert upper portion 834 forms a portion of the fairway-type golf club head crown 116 and overlays the crown flange 217. The crown insert rear wing 816 extends downward toward the club head sole 118 at the rear 110 of the fairway-type golf club head 100, forming a portion of the club head outer surface over the rear flange 228. The crown insert upper portion 834 is the portion of the crown insert located above the fairway-type golf club head perimeter. The crown insert lower portion 836 is the portion of the crown insert 800 located below the fairway-type golf club head perimeter 112.

The "face cup" 300 of the fairway-type golf club head, as defined herein and used below, is a component configured to be permanently affixed to the main body front aperture 210. Referring to FIGS. 1C, 2A, 2B, and 3A-3C, the face cup 300 comprises a face cup front portion 310, a face cup toe portion 311, a face cup strike face portion 304, a face cup crown return 316, a face cup sole return 318, and a face cup heel portion 315. The face cup 300 is configured to be received within and permanently affixed to the main body front aperture 210 to form the front 108 of the golf cub head 100. When the face cup 300 is affixed to the main body, the main body strike face portion 226 and the face cup strike face portion 304 combine to form the fairway-type golf club head strike face 104. The face cup 300 crown return 316, face cup sole return 318, and face cup toe portion 311 surround the face cup strike face portion 304. The face cup 300 comprises a face cup rear edge 381 forming a face cup rear perimeter. The face cup rear edge 381 encompasses the entirety of the rearward edge of the face cup 300 and also encompasses the heelward edge of the face cup 300. The face cup rear edge 381 is configured to abut the main body front edge 281 when the face cup 300 is affixed to the main body 100. The rearmost point on the face cup crown return 316, and the rearmost point on the face cup sole return 318 define a face cup rear plane 380. The face cup rear plane 380 is parallel to the loft plane 1010.

Figure 3C:
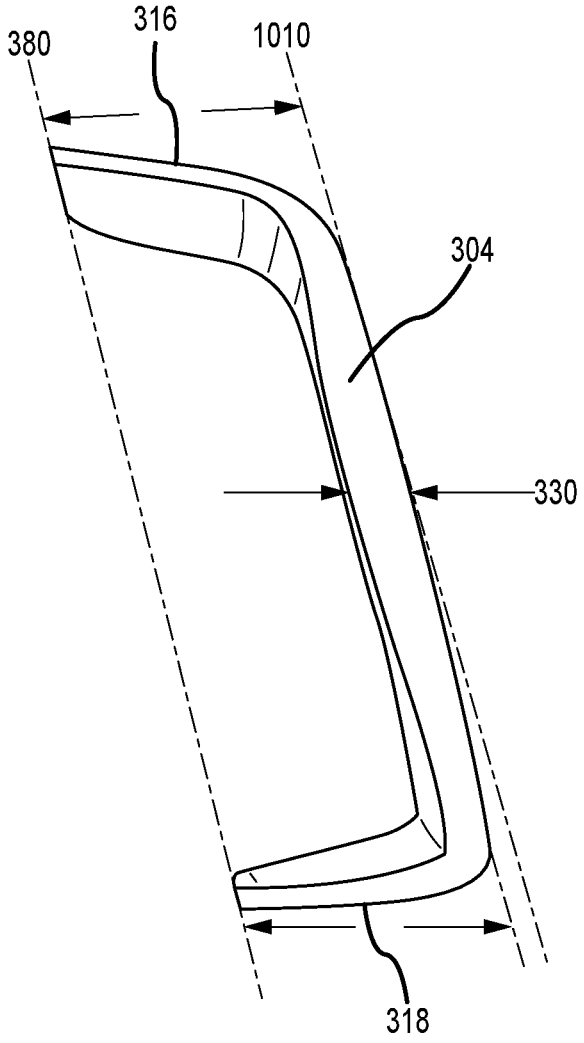
FIG. 3C illustrates a cross-sectional view of a fairway-type golf club head face cup and variable strike face.

The "strike face thickness" 330 of the fairway-type golf club head, as defined herein and used below, is measured from the strike front surface to the strike face rear surface. Referring to FIG. 3C, the strike face thickness 330 can vary in a toe to heel direction and in a crown to sole direction. The strike face thickness 330 can be in a range of 0.020 inch to 0.050 inch.

The "strike face area" of the fairway-type golf club head as defined herein and used below is the total surface area of the strike face. The strike face area can be in a range of 2.00 $in^2$ to 3.00 $in^2$. The strike face area can be approximately 2.00 $in^2$, approximately 2.05 $in^2$, approximately 2.10 $in^2$, approximately 2.15 $in^2$, approximately 2.20 $in^2$, approximately 2.25 $in^2$, approximately 2.30 $in^2$, approximately 2.35 $in^2$, approximately 2.40 $in^2$, approximately 2.45 $in^2$, approximately 2.50 $in^2$, approximately 2.55 $in^2$, approximately 2.60 $in^2$, approximately 2.65 $in^2$, approximately 2.70 $in^2$, approximately 2.75 $in^2$, approximately 2.80 $in^2$, approximately 2.85 $in^2$, approximately 2.90 $in^2$, approximately 2.95 $in^2$, or approximately 3.00 $in^2$. In one exemplary embodiment, the strike face area is 2.345 $in^2$.

The "rear weight assembly" 1100 of the fairway-type golf club head as defined herein and used below is a removable, adjustable, or interchangeable weight assembly comprising the rear weight assembly 1100, which comprises a rear weight 1111, a rear weight threaded fastener 1160, and a rear weight washer 1170. Referring to FIGS. 2A-2C and 6A, the rear weight recess 250 is encompassed by the rear weight support structure 299.

Figure 6A:
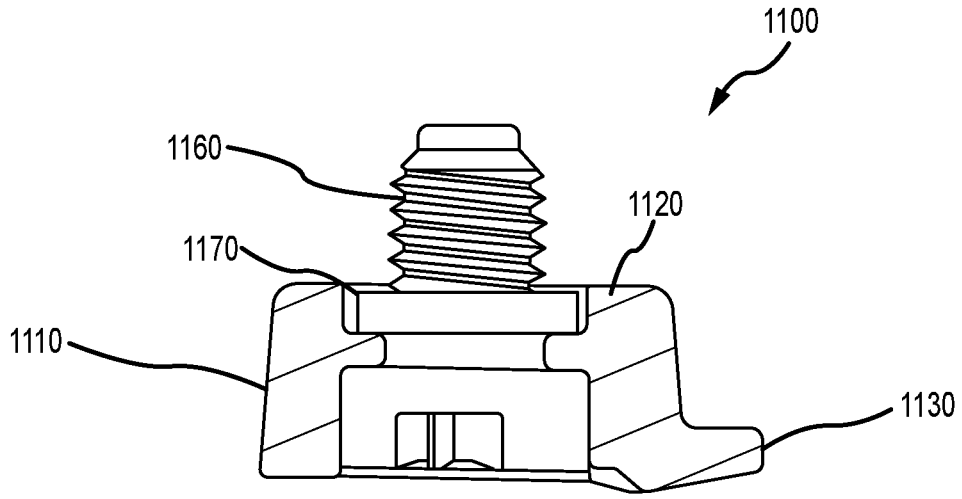
FIG. 6A illustrates a cross-sectional view of a fairway-type golf club head rear weight.
Figure 6B:
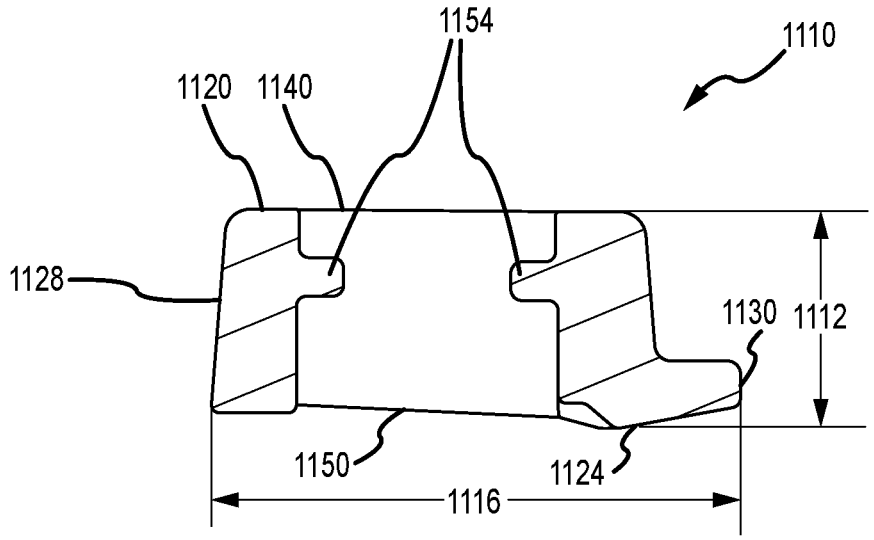
FIG. 6B illustrates a cross-sectional view of a fairway-type golf club head rear weight.

The "rear weight" 1111 of the fairway-type golf club head as defined herein and used below is a detachable weight component configured to be received at least partially within the rear weight recess 250. Referring to FIGS. 5D, 6A, and 6B, the rear weight comprises a rear weigh height 1112, a rear weight width 1114 (not shown), a rear weight length 1116, a rear weight top surface 1120, a rear weight bottom surface 1124, a rear weight perimeter surface 1128 between the top and bottom surfaces, a rear weight protrusion 1130, a top washer recess 1140, a rear weight fastener aperture 1150, and a rear weight aperture shoulder 1154 within the fastener aperture 1150. The threaded fastener 1160 is inserted upwards from the bottom surface 1124 into the fastener aperture 1150 until the head of the threaded fastener 1160 abuts the aperture shoulder 1154. A portion of the threaded fastener 1160 extends past the top surface 1120. The weight washer 1170 is received over the threaded fastener 1160, wherein the weight washer 1170 is also received within the top washer recess 1140. Once this rear weight assembly is fully assembled, it can be received within the rear weight recess 250, wherein the threaded fastener 1160 is threadably received within the rear weight fastener aperture 255. The rear weight bottom surface 1124 is exposed to the bottom exterior of the fairway-type golf club head. The rear weight protrusion 1130 is exposed to both the bottom and rear exterior of the fairway-type golf club head.

III. Coordinate Systems

Two coordinate systems are described below to be applied to the fairway-type club head to achieve the various center of gravity, FLIP axis, and fairway-type club head dimensions describing the invention.

An "XYZ" coordinate system of the fairway-type golf club head, as described herein, is based upon the geometric center 140 of the strike face 104. The fairway-type club head dimensions as described herein can be measured based on a coordinate system as defined below. The geometric center 140 of the strike face 104 defines a coordinate system having an origin located at the geometric center 140 of the strike face 104. The coordinate system defines an X axis 1052, a Y axis 1062, and a Z axis 1072. The X axis 1052 extends through the geometric center 140 of the strike face 104 in a direction from the heel 120 to the toe 122 of the fairway-type club head 100. The Y axis 1062 extends through the geometric center 140 of the strike face 104 in a direction from the crown 116 to the sole 118 of the fairway-type club head 100. The Y axis 1062 is perpendicular to the X axis 1052. The Z axis 1072 extends through the geometric center 140 of the strike face 104 in a direction from the front end 108 to the rear end 110 of the fairway-type club head 100. The Z axis 1072 is perpendicular to both the X axis 1052 and the Y axis 1062.

The XYZ coordinate system of the fairway-type golf club head, as described herein defines an XY plane extending through the X axis 1052 and the Y axis 1062. The coordinate system defines XZ plane extending through the X axis 1052 and the Z axis 1072. The coordinate system further defines a YZ plane extending through the Y axis 1062 and the Z axis 1072. The XY plane, the XZ plane, and the YZ plane are all perpendicular to one another and intersect at the coordinate system origin located at the geometric center 140 of the strike face 104. The XY plane extends parallel to the hosel axis 132 and is positioned at an angle corresponding to the loft angle of the fairway-type club head 100 from the loft plane 1010. In these or other embodiments, the fairway-type club head 100 can be viewed from a front view (FIG. 1B) when the strike face 104 is viewed from a direction perpendicular to the XY plane. Further, in these or other embodiments, the fairway-type club head 100 can be viewed from a side view or side cross-sectional view (FIG. 1A) when the heel 120 is viewed from a direction perpendicular to the YZ plane.

An "xyz" coordinate system of the fairway-type golf club head, as described herein, is based upon the fairway-type club head CG 172. The xyz coordinate system is different from the XYZ coordinate system, which is based on the geometric center 140. The fairway-type club head CG 172 defines the origin of a coordinate system having an x axis 1050, a y axis 1060, and a z axis 1070. The y axis 1060 extends through the head CG 172 in a direction from the crown 116 to the sole 118 of the fairway-type club head 100. The x axis 1050 extends through the head CG 172 from the heel 120 to the toe 122 and perpendicular to the y axis 1060 when viewed from a front view and parallel to the XY plane. The z axis 1070 extends through the head CG 172 from the front end 108 to the rear end 110 and is perpendicular to the x axis 1050 and the y axis. In many embodiments, the x axis 1050 extends through the head CG 172 from the heel 120 to the toe 122 and parallel to the X axis 1052. The y axis 1060 extends through the head CG 172 from the crown 116 to the sole 118 parallel to the Y axis 1062. The z axis 1070 extends through the head CG 172 from the front end 108 to the rear end 110 and is parallel to the Z axis 1072.

The "loft plane" 1010 of the fairway-type golf club head, as described herein, is a plane that is tangent to the geometric center 140 of the strike face 104. The loft plane 1010 forms a loft angle with the ground plane 1000.

IV. Methods of Determining CG Location

The fairway-type club head CG 172 and the sole insert CG 472 can be described relative to the location of different fairway-type golf club head components. Several methods are developed to describe the desirable CG 172, 472 location as described below. The fairway-type club head CG 172 and the sole insert CG 472 can be described using any combination of these methods. Each method establishes an "imaginary volume" or volume within the fairway-type club head 100 where the CG 172 will be optimally located. FIGS. 5A-5D and 8A-8E illustrate the volumes within the fairway-type club head 100 as two-dimensional areas (not drawn to scale). The two-dimensional areas can be idealized as three-dimensional volumes within the fairway-type club head (not shown). The CG 172, 472 can be restricted to a specified area or a specified volume. The offsets described below may be absolute values or offset in any direction from the defining point. For example, $CGX_1$ may be offset from the Y axis 1062 in the heelward or toeward direction.

Figure 8A:
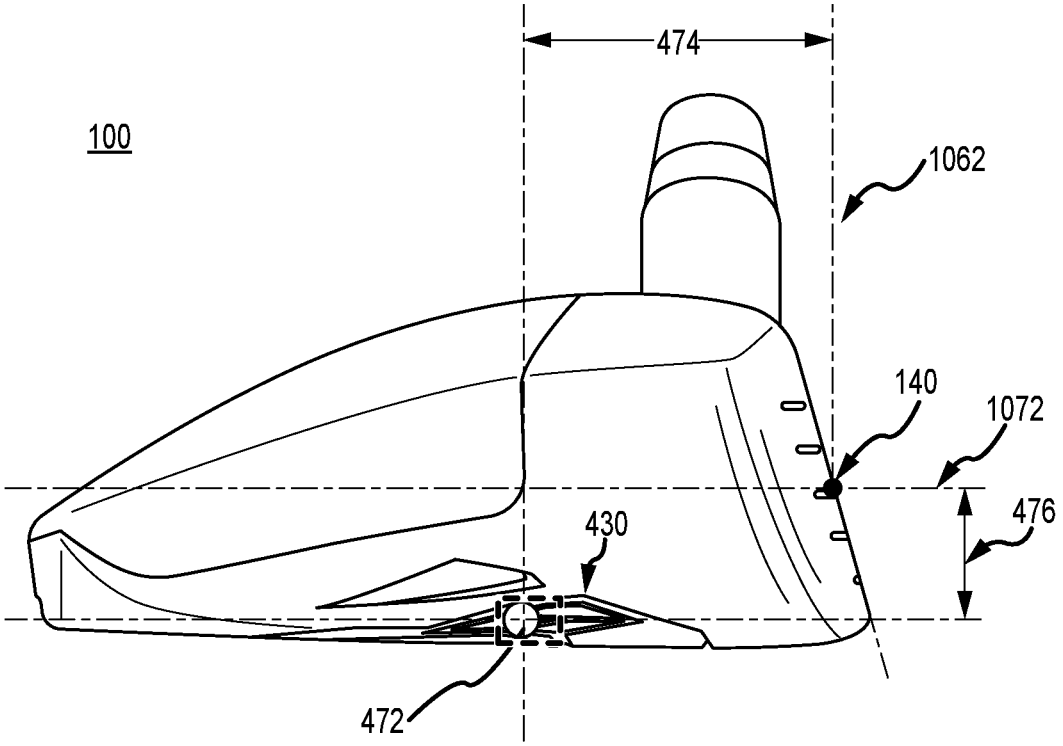
FIG. 8A illustrates a side view of a fairway-type golf club head with crown and sole inserts.

A "geometric center method" for determining CG location 172, 472 as defined herein and used below is described relative to the XYZ coordinate system originating at the geometric center of the face 140. The geometric center method can be used to locate the fairway-type club head CG 172 and the sole insert CG 472. The fairway-type club head CG 172 is located at an offset ($CGX_1$) 173, an offset ($CGY_1$) 176, and an offset ($CGZ_1$) 174. The sole insert CG 472 is located at an offset ($CGX_1$) 473, an offset ($CGY_1$) 476, and an offset ($CGZ_1$) 474. Although the fairway-type club head CG 172 and the sole insert CG 472 can be similarly described using this method, the values obtained for fairway-type club head CG 172 and sole insert CG 472 may or may not be the same. In other words, $CGZ_1$ 174, $CGY_1$ 176, and $CGX_1$ 173 are relevant to the fairway-type club head CG 172, and $CGZ_1$ 474, $CGY_1$ 476, and $CGX_1$ 473 are relevant to the sole insert CG 472. Referring to FIGS. 5A and 8A, the CG 172, 472 is located at an offset ($CGZ_1$) 174, 474 measured parallel to the Z axis 1072 and rearward from the geometric center 140. The CG 172, 472 is further located at an offset ($CGY_1$) 176, 476 measured perpendicularly from the CG 172, 472 to the Z axis 1072. The CG 172, 472 can be above or below the geometric center 140. In other words, the $CGY_1$ is an absolute value from the Z axis 1072. The CG is further located at an offset ($CGX_1$) 173, 473 measured parallel to the X axis 1052 from the geometric center 140

(not shown). The CG 172, 472 can be heelward or toeward relative to the geometric center 140. In other words, the $CGX_1$173, 473 is an absolute value from the Y axis 1062. Using the geometric center method, separate imaginary boxes can be defined around the fairway-type club head CG 172 and the sole insert CG 472 by minimum and maximum $CGX_1$, $CGY_1$, and $CGZ_1$ values. The $CGX_1$ 173, 473 can define the box in the heel-to-toe direction, the $CGY_1$ 176, 476 can define the box in the crown-to-sole direction, and the $CGZ_1$ 174, 474 can define the box in the front-to-rear direction. The imaginary box can define a range of optimal CG 172, 472 values. The imaginary box drawn around the fairway-type club head CG 172 can be located closer to the crown and the strike face than the imaginary box drawn around the sole insert CG 472.

Figure 8B:
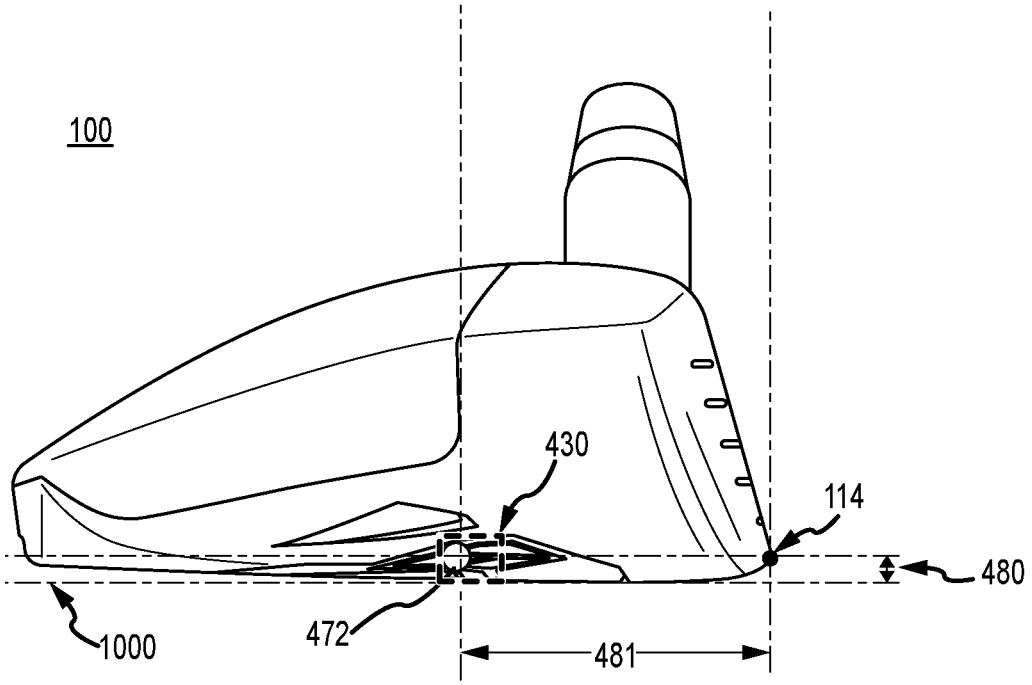
FIG. 8B illustrates a side view of a fairway-type golf club head with crown and sole inserts.

A "leading edge method" for determining CG location 172, 472 as defined herein and used below is described relative to the fairway-type club head leading edge 114. The leading edge method can be used to locate the fairway-type club head CG 172 and the sole insert CG 472. The fairway-type club head CG 172 is located at an offset ($CGX_1$) 173, an offset ($CGY_2$) 180, and an offset ($CGZ_2$) 181. The sole insert CG 472 is located at an offset ($CGX_1$) 473, an offset ($CGY_2$) 480, and an offset ($CGZ_2$) 481. Although the fairway-type club head CG 172 and the sole insert CG 472 can be similarly described using this method, the values obtained for fairway-type club head CG 172 and sole insert CG 472 may or may not be the same. In other words, $CGZ_2$ 181, $CGY_2$ 180, and $CGX_1$ 173 are relevant to the fairway-type club head CG 172, and $CGZ_2$ 481, $CGY_2$ 480, and $CGX_1$ 473 are relevant to the sole insert CG 472. Referring to FIGS. 5B and 8B, the CG 172, 472 is located at an offset ($CGY_2$) 180, 480 measured perpendicular to the ground plane 1000. The CG 172, 472 is further located an offset ($CGZ_2$) 181, 481 measured parallel to the ground plane 1000 and rearward from the leading edge 114 to the CG 172, 472. The CG is further located at an offset ($CGX_1$) 173, 473 measured parallel to the X axis 1052 from the geometric center 140 (not shown). The CG 172, 472 can be heelward or toeward relative to the geometric center 140. In other words, the $CGX_1$173, 473 is an absolute value from the Y axis 1062. When viewing the fairway-type club head from the front, the leading edge is idealized as a point along the Y axis 1062. Therefore, the location of the CG 172, 472 in the X axis 1062 direction is based on the geometric center 140. Using the leading edge method, separate imaginary boxes can be defined around the fairway-type club head CG 172 and the sole insert CG 472 by minimum and maximum $CGX_1$, $CGY_2$, and $CGZ_2$ values. The $CGX_1$ 173, 473 can define the box in the heel-to-toe direction, the $CGY_2$ 180, 480 can define the box in the crown-to-sole direction, and the $CGZ_2$ 181, 481 can define the box in the front-to-rear direction. The imaginary box can define a range of optimal CG 172, 472 values. The imaginary box drawn around the fairway-type club head CG 172 can be located closer to the crown and the strike face than the imaginary box drawn around the sole insert CG 472.

Figure 8C:
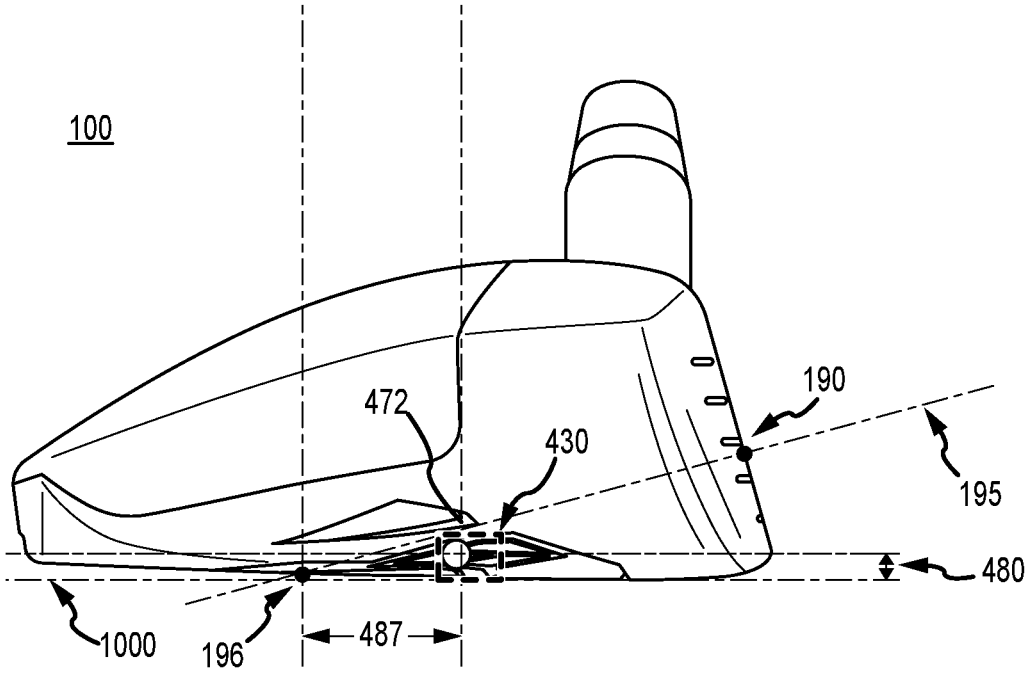
FIG. 8C illustrates a side view of a fairway-type golf club head with parallel positioning of club head CG and sole insert CG.

An "exit point method" of determining CG location 172, 472 as defined herein and used below is described relative to the FLIP axis exit point 196. The exit point method can be used to locate the fairway-type club head CG 172 and the sole insert CG 472. The fairway-type club head CG 172 is located at an offset ($CGX_2$) 179, an offset ($CGY_2$) 180, and an offset ($CGZ_3$) 187. The sole insert CG 472 is located at an offset ($CGX_2$) 479, an offset ($CGY_2$) 480, and an offset ($CGZ_3$) 487. Although the fairway-type club head CG 172 and the sole insert CG 472 can be similarly described using this method, the values obtained for fairway-type club head CG 172 and sole insert CG 472 may or may not be the same. In other words, $CGZ_3$ 187, $CGY_2$ 180, and $CGX_2$ 179 are relevant to the fairway-type club head CG 172, and $CGZ_3$ 487, $CGY_2$ 480, and $CGX_2$ 479 are relevant to the sole insert CG 472. Referring to FIGS. 5C and 8C, the CG 172, 472 is located at an offset ($CGY_2$) 180, 480 measured perpendicular to the ground plane 1000. The CG 172, 472 is further located an offset ($CGZ_3$) 187, 487 measured parallel to the ground plane 1000 and forward from the exit point 196 to the CG 172, 472. The CG is further located at an offset ($CGX_2$) 179, 479 measured parallel to the X axis 1052 from the FLIP axis 195 (not shown). The CG 172, 472 can be heelward or toeward relative to the FLIP 190. In other words, the $CGX_2$ 179, 479 is an absolute value from the FLIP axis 195. Using the exit point method, separate imaginary boxes can be defined around the fairway-type club head CG 172 and the sole insert CG 472 by minimum and maximum $CGX_2$, $CGY_2$, and $CGZ_3$ values. The $CGX_2$ 179,479 can define the box in the heel-to-toe direction, the $CGY_2$ 180, 480 can define the box in the crown-to-sole direction, and the $CGZ_3$ 187, 487 can define the box in the front-to-rear direction. The imaginary box can define a range of optimal CG 172, 472 values. The imaginary box drawn around the fairway-type club head CG 172 can be located closer to the crown and the strike face than the imaginary box drawn around the sole insert CG 472.

Figure 8D:
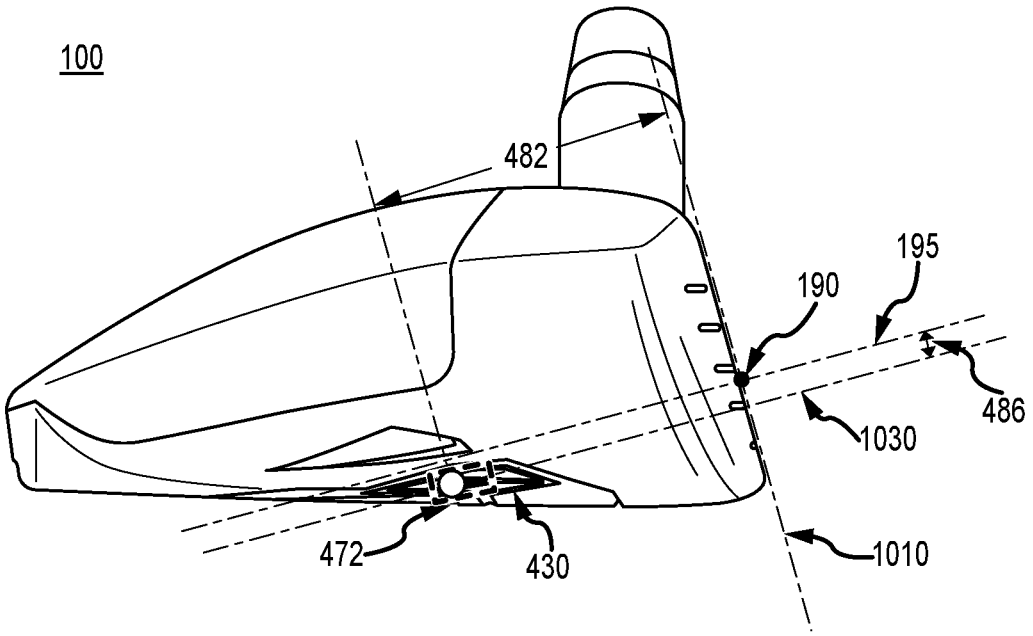
FIG. 8D illustrates a side view of a fairway-type golf club head with crown and sole inserts.

A "FLIP axis method" of determining CG location 172, 472 as defined herein and used below is described relative to the FLIP axis 195. The FLIP axis method can be used to locate the fairway-type club head CG 172 and the sole insert CG 472. The fairway-type club head CG 172 is located at an offset ($CGF_1$) 186 and an offset ($CGF_2$) 182. The sole insert CG 472 is located at an offset ($CGF_1$) 486 and an offset ($CGF_2$) 482. Although the fairway-type club head CG 172 and the sole insert CG 472 can be similarly described using this method, the values obtained for fairway-type club head CG 172 and sole insert CG 472 may or may not be the same. In other words, $CGF_2$ 182 and $CGF_1$ 186 are relevant to the fairway-type club head CG 172, and $CGF_2$ 482 and $CGF_1$ 486 are relevant to the sole insert CG 472. Referring to FIGS. 5D and 8D, the CG 172, 472 is located at an offset ($CGF_1$) 186, 486 measured perpendicularly from the CG 172, 472 to the FLIP axis 195. The CG 172, 472 can be above or below the FLIP axis 195. In other words, the $CGF_1$ 186, 486 is an absolute value from the FLIP axis 195 and defines a radial distance off of the FLIP axis 195. The CG 172, 472 is further located an offset ($CGF_2$) 182, 482 measured along a plane 1020, 1030 that passes through the CG 172 and is parallel to the FLIP axis 195. Using the FLIP axis method, separate imaginary cylinders can be defined around the fairway-type club head CG 172 and the sole insert CG 472 by defining ranges for the $CGF_1$ and $CGF_2$ values. The $CGF_1$ 186, 486 value can define a radius of the cylinder, and the $CGF_2$ 182, 482 value can define the height of the cylinder along the FLIP axis 195. The imaginary cylinder can define a range of optimal CG 172, 472 values. The imaginary cylinder drawn around the fairway-type club head CG 172 can be located closer to the crown and the strike face than the imaginary box drawn around the sole insert CG 472.

Figure 8E:
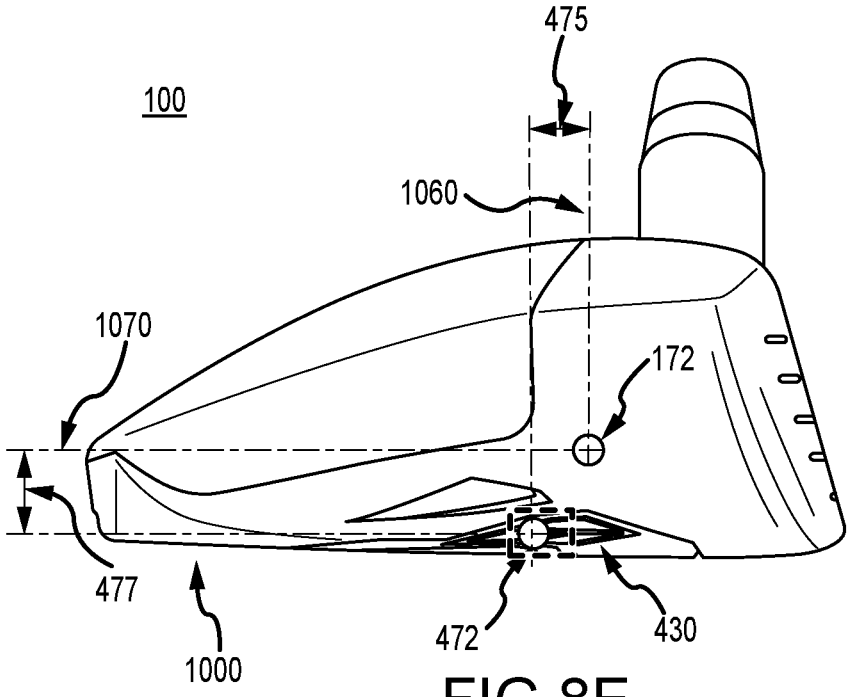
FIG. 8E illustrates a side view of a fairway-type golf club head with crown and sole inserts.

A "relative method" of determining the sole insert CG location 472 as defined herein and used below is described relative to the coordinate system originating at the fairway-type club head CG 172. Referring to FIG. 8E, the sole insert CG 472 is located at an offset ($CGY_4$) 477, measured perpendicularly from the sole insert CG 472 to the z axis 1070. The CG 172, 472 is further located an offset ($CGZ_5$) 475 measured perpendicularly from the sole insert CG 472 to the y axis 1060. The sole insert CG 472 can be located below and rearward of the fairway-type club head CG 172. The CG is further located at an offset ($CGX_3$) 483 measured parallel to the X axis 1052 from the fairway-type club head CG 172 to the sole insert CG 472 (not shown). Using the relative method, an imaginary box can be defined around the sole insert CG 472 by minimum and maximum $CGX_3$, $CGY_4$, and $CGZ_5$ values. The $CGX_3$ 483 can define the box in the heel-to-toe direction, the $CGY_4$ 477 value can define the box in the crown-to-sole direction, and the $CGZ_5$ 475 value can define the box in the front-to-rear direction. The imaginary box can define a range of optimal CG 472 values.

The combination of a lightweight crown insert 800, main body 202, a high density sole insert 430, and a removable, adjustable, or interchangeable rear weight assembly 1100 provides a fairway-type golf club head with a low center of gravity that is forgiving and reduces golf ball spin compared to a fairway-type club head devoid of a sole insert. The fairway-type golf club head 100 described herein uses a high density sole insert 430, a lightweight crown insert 800, and a removable, adjustable, or interchangeable rear weight assembly 1100 to balance the CG 172 along the FLIP axis 195.

There are various embodiments of a fairway-type golf club head 100 that achieves a low and rearward CG 172 on the FLIP axis 195. The main body 202 and the face cup 300 can comprise a metallic material such as a titanium alloy, or the main body 202 can comprise a composite material such as a fiber reinforced polymer or a fiber reinforced composite. The sole insert 430 and rear weight 1111 can comprise a dense metallic material such as titanium or steel. The crown insert 800 can comprise a composite material such as a carbon composite material, a fiber reinforced polymeric material, a natural fiber composite, or any other suitable, low density material.

Various embodiments of the club head can have varied loft angles and volumes. Other embodiments can include club heads having loft angles or volumes different than the loft angles and volumes described herein.

DETAILED DESCRIPTION

I. Force Line Impact Point and Force Line Axis

Referring to FIGS. 1A and 1B, the fairway-type golf club head 100 comprises a series of structures that lead to the CG being near or on a force line to maximize force transmitted when striking a golf ball. The force line impact point (FLIP) 190 is a point at which the force of the fairway-type golf club stroke is most efficiently transmitted to a golf ball. A most efficient transfer maximizes the force transmitted to the golf ball and occurs without expending any force in a side vector. Thus, the FLIP axis 195 is an axis congruent to a vector of force that does not place side/top/or bottom spin vectors into the golf ball at impact. The FLIP 190 is the point of impact that is the intersection point on the strike face 104 for the FLIP axis 195, developed from an average optimal impact location of the golf ball resting on the ground. In other words, the FLIP 190 is a point that defines the origin of the FLIP axis 195. The average optimal impact location of the golf ball is approximately the point on the golf ball wherein the roll radius/face curvature of the fairway-type golf club head 100 is tangent to the golf ball at the moment of impact. This impact location is essentially unchanged by the bounce angle of the fairway-type golf club because the bounce portion of a sole of a fairway-type golf club is designed to actually be below the ground level upon which the ball rests (thus taking a divot) at impact. This desired impact location is also essentially unchanged by the strike face height because the physical dimensions of the golf ball do not get larger or smaller in response to a change in the fairway-type golf club head dimensions. Therefore, the golf club described herein is not a driver-type golf club, it is not a hybrid-type golf club, it is not an iron-type golf club, and it is not a putter-type golf club.

Thus, this desired or optimal static force-line impact point (the FLIP 190) is a relatively constant point on a fairway-type golf club head strike face 104 (essentially unchanged by the fairway-type golf club sole bounce angles and depth, or strike face height) and is located where the strike face end point of the most efficient force vector for golf ball impact. Consequently, if the CG 172 were located directly on the FLIP axis 195, the CG 172 would be reacting to this impulse force along this FLIP axis 195 in such a way as to not lose any impulse force to a side vector that would waste some of the impulse force to impart a top/bottom/or side spin to the golf ball. Referring to FIG. 1A, the FLIP (force line impact point) 190 is located on the strike face at a FLIP height 192 above the ground plane 1000 and on the YZ plane. The FLIP height 192 is within a range between 0.55 inch to 0.75 inch. The FLIP height 192 may be 0.55 inch, 0.56 inch, 0.57 inch, 0.58 inch, 0.59 inch, 0.60 inch, 0.61 inch, 0.62 inch, 0.63 inch, 0.64 inch, 0.65 inch, 0.66 inch, 0.67 inch, 0.68 inch, 0.69 inch, 0.70 inch, 0.71 inch, 0.72 inch, 0.73 inch, 0.74 inch, or 0.75 inch.

The fairway-type golf club head, as defined above, comprises features selected from a group consisting of a crown insert, a face cup, a high-density sole insert, and a rear weight. This configuration provides a mass distribution that allows a desirable location of the fairway-type golf club head CG on or near the FLIP axis and optimally positioned measured front to rear. Specifically, the particular material choices for each component support a high percentage of mass in a lower portion of the fairway-type golf club head. Further, the overall shape of the fairway-type golf club head also supports the desirable CG location. Specifically, the relative height of the strike face and club head described below also support a lower CG placement. A lower CG placement allows the CG to be on or near the FLIP axis while also placed further towards the rear of the fairway-type golf club head. Combining one or more of the structures and structural relationships disclosed herein provides more optimal fairway-type golf club head CG placement.

Various ratios of the fairway-type golf club head can be developed to demonstrate relationships between the dimensions of the fairway-type club head components. The ratios discussed below are directed to a fairway-type club head 100. The ratios are not directed to a driver-type, a hybrid-type, an iron-type, or a putter-type club head. The fairway-type club head 100 can be described using any one or more of the relationships below.

$$2.00 \leq \frac{\text{Club Head Height (164)}}{\text{Geometric Center Height (146)}} \leq 2.30 \quad (1)$$

$$1.00 \leq \frac{\text{Club Head Height (164)}}{\text{Face Height (144)}} \leq 1.50 \quad (2)$$

A first ratio (1) develops a relationship between the fairway-type club head height 164 and the geometric center height 146. The club head height 164 must be between 1.25 inches to 2.00 inches when measured perpendicular to the ground plane 1000, and the geometric center height 146 must be between 0.40 inch to 0.75 inch. The fairway-type club head 100 can be described as having a first ratio (1) that is less than 2.30. In one exemplary embodiment, the fairway-type club head 100 has a first ratio (1) of 2.15.

A second ratio (2) develops a relationship between the club head height 164 and the face height 144. The club head height 164 must be between 1.25 inches to 2.00 inches, when measured perpendicular to the ground plane 1000, and the face height 144 must be between 1.00 inch to 1.50 inches when measured parallel to the loft plane 1010 extending through the geometric center of the face 140. The fairway-type club head 100 can be described as having a second ratio (2) that is less than 1.50. In one exemplary embodiment, the fairway-type club head 100 has a second ratio (2) of 1.28.

The fairway-type golf club head dimensions can be used to develop relationships between the club head geometry and the location of the FLIP axis 195. For example, the fairway-type golf club head can be described using the relationships below.

$$0.85 \leq \frac{\text{FLIP Height (192)}}{\text{Geometric Center Height (146)}} \leq 1.15 \quad (3)$$

$$0.35 \leq \frac{\text{FLIP Height (192)}}{\text{Club Head Height (164)}} \leq 0.55 \quad (4)$$

$$0.45 \leq \frac{\text{FLIP Height (192)}}{\text{Face Height (144)}} \leq 0.65 \quad (5)$$

A third ratio (3) develops a relationship between the FLIP height 192 and the height of the geometric center of the face 146. The FLIP height 192 must be within 0.55 inch to 0.75 inch, and the geometric center height 146 must be between 0.40 inch to 0.75 inch. The third ratio (3) is restricted to the specified ranges to ensure the FLIP 190 and the geometric center 140 are located near one another. In other words, the third ratio (3) limits the club head 100 to a fairway-type club head. In one exemplary embodiment, the club head 100 has a third ratio of 0.98.

A fourth ratio (4) develops a relationship between the FLIP height 192 and the height of the club head 164. The FLIP height 192 must be within 0.55 inch to 0.75 inch, and the club head height 164 must be between 1.25 inches to 2.00 inches, when measured perpendicular to the ground plane 1000. The fourth ratio (4) is limited to the specified ranges to limit the FLIP height 192 to approximately half, or slightly less than half of the club head height 164. As such, the fourth ratio (4) further establishes that the club head 100 is a fairway-type club head. In one exemplary embodiment, the club head 100 has a fourth ratio (4) of 0.45.

A fifth ratio (5) develops a relationship between the FLIP height 192 and the height of the face 144. The FLIP height 192 must be within 0.55 inch to 0.75 inch, and the face height 144 must be between 1.00 inch to 1.50 inches when measured parallel to the loft plane 1010 extending through the geometric center of the face 140. The fifth ratio (5) is restricted to the specified ranges to limit the FLIP height 192 to approximately half of the face height 144. As such, the fifth ratio (5) further establishes that the club head 100 is a fairway-type club head. In one exemplary embodiment, the club head 100 has a fifth ratio (5) of 0.58.

V. Club Head Center of Gravity

The specified ranges below and in the definitions above for the fairway-type golf club head CG 172 limit the club head to a fairway-type club head. In other words, the fairway-type golf club head cannot be a driver type, a hybrid-type, an iron-type, or a putter-type golf club head. As shown in FIGS. 5A-5D, the fairway-type golf club head 100 defines a low and optimally placed center of gravity (CG) 172 that is on or near the FLIP axis 195. Each method establishes a volume within the club head 100 where the CG 172 will be optimally located. The club head CG location 172 can be described using any combination of these methods.

A. Geometric Center Method

The combination of a lightweight crown insert 800, main body 202, a high density sole insert 430, a removable, adjustable, or interchangeable rear weight assembly 1100, or a combination thereof provides a golf club head with a low center of gravity that is forgiving and reduces golf ball spin compared to a club head devoid of a sole insert. These fairway-type golf club head components provide the basis for the CG 172 locations described herein. The fairway-type golf club head 100 described herein comprise features selected from a group consisting of a high density sole insert 430, a lightweight crown insert 800, a removable, adjustable, or interchangeable rear weight assembly 1100, and a combination thereof to balance the CG 172 along the FLIP axis 195. The CG 172 location ranges defined herein require a high density sole insert having a mass in the range of 70 grams to 90 grams.

Using the geometric center method, an imaginary box can be defined around the club head CG 172 by minimum and maximum $CGX_1$, $CGY_1$, and $CGZ_1$ values. The $CGX_1$ 173 can define the box in the heel-to-toe direction, the $CGY_1$ 176 can define the box in the crown-to-sole direction, and the $CGZ_1$ 174 can define the box in the front-to-rear direction. The imaginary box can define a range of optimal CG 172 values.

According to geometric center method, the $CGZ_1$ 174 can be in a range of between 1.00 inch to 1.50 inches, the $CGY_1$176 can be in a range of 0.10 inch to 0.40 inch, and the $CGX_1$ 173 can be between 0.005 inch to 0.030 inch. For example, the $CGZ_1$ 174 can be between 1.00 inch to 1.25 inches, between 1.10 inches to 1.40 inches, or between 1.25 inches to 1.50 inches. The $CGZ_1$174 can be approximately 1.00 inch, 1.05 inches, 1.10 inches, 1.15 inches, 1.20 inches, 1.25 inches, 1.30 inches, 1.35 inches, 1.40 inches, 1.45 inches, or 1.50 inches. Additionally, the $CGY_1$176 can be between 0.10 inch to 0.30 inch, between 0.15 inch to 0.25 inch, between 0.20 inch to 0.30 inch, or between 0.25 inch to 0.40 inch. The $CGY_1$ 176 can be 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch 0.19 inch, 0.20 inch, 0.21 inch, 0.22 inch, 0.23 inch, 0.24 inch, 0.25 inch, 0.26 inch, 0.27 inch, 0.28 inch, 0.29 inch, 0.30 inch, 0.31 inch, 0.32 inch, 0.33 inch, 0.34 inch, 0.35 inch, 0.36 inch, 0.37 inch, 0.38 inch, 0.39 inch, or 0.40 inch. The $CGX_1$ 173 can be between 0.005 inch to 0.020 inch, between 0.010 inch to 0.020 inch, or between 0.015 inch to 0.030 inch. The $CGX_1$ 173 can be 0.005 inch, 0.006 inch, 0.007 inch, 0.008 inch, 0.009 inch, 0.010 inch, 0.011 inch, 0.012 inch, 0.013 inch, 0.014 inch, 0.015 inch, 0.016 inch, 0.017 inch, 0.018 inch, 0.019 inch, 0.020 inch, 0.021, inch, 0.022 inch, 0.023 inch, 0.024 inch, 0.025 inch, 0.026 inch, 0.027 inch, 0.028 inch, 0.029 inch, or 0.030 inch. In one exemplary embodiment, the $CGZ_1$ 174 is 1.200 inches rearward of the geometric center 140, the $CGY_1$ 176 is 0.286 inch below the Z axis 1072, and the $CGX_1$ 173 is 0.015 inch toeward of the Y axis 1062.

B. Leading Edge Method

The combination of a lightweight crown insert 800, main body 202, a high density sole insert 430, a removable, adjustable, or interchangeable rear weight assembly 1100, or a combination thereof provides a golf club head with a low center of gravity that is forgiving and reduces golf ball spin compared to a club head devoid of a sole insert. These fairway-type golf club head components provide the basis for the CG 172 locations described herein. The fairway-type golf club head 100 described herein comprise features selected from a group consisting of a high density sole insert 430, a lightweight crown insert 800, a removable, adjustable, or interchangeable rear weight assembly 1100, and a combination thereof to balance the CG 172 along the FLIP axis 195. The CG 172 location ranges defined herein require a high density sole insert having a mass in the range of 70 grams to 90 grams.

Using the leading edge method, an imaginary box can be defined around the club head CG 172 by minimum and maximum CGX1, CGY2, and CGZ2 values. The CGX1 173 can define the box in the heel-to-toe direction, the CGY2 180 can define the box in the crown-to-sole direction, and the CGZ2 181 can define the box in the front-to-rear direction. The imaginary box can define a range of optimal CG 172 values. According to the leading edge method, the $CGY_2$ 180 can be in a range of between 0.20 inch to 0.50 inch. For example, the $CGY_2$ 180 can be between 0.20 inch to 0.30 inch, between 0.25 inch to 0.40 inch, between 0.30 inch to 0.40 inch, between 0.35 inch to 0.40 inch, or between 0.35 inch to 0.50 inch. The $CGY_2$ 180 can be approximately 0.20 inch, 0.21 inch, 0.22 inch, 0.23 inch, 0.24 inch, 0.25 inch, 0.26 inch, 0.27 inch, 0.28 inch, 0.29 inch, 0.30 inch, 0.31 inch, 0.32 inch, 0.33 inch, 0.34 inch, 0.35 inch, 0.36 inch, 0.37 inch, 0.38 inch, 0.39 inch, 0.40 inch, 0.41 inch, 0.42 inch, 0.43 inch, 0.44 inch, 0.45 inch, 0.46 inch, 0.47 inch, 0.48 inch, 0.49 inch, or 0.50 inch. The $CGZ_2$181 can be in a range of between 1.00 inch to 1.50 inches. For example, the $CGZ_2$181 can be between 1.00 inch to 1.25 inches, between 1.10 inches to 1.40 inches, or between 1.25 inches to 1.50 inches. The $CGZ_2$181 can be 1.00 inch, 1.05 inches, 1.10 inches, 1.15 inches, 1.20 inches, 1.25 inches, 1.30 inches, 1.35 inches, 1.40 inches, 1.45 inches, or 1.50 inches. The $CGX_1$ 173 can be between 0.005 inch to 0.020 inch, between 0.010 inch to 0.020 inch, or between 0.015 inch to 0.030 inch. The $CGX_1$ 173 can be 0.005 inch, 0.006 inch, 0.007 inch, 0.008 inch, 0.009 inch, 0.010 inch, 0.011 inch, 0.012 inch, 0.013 inch, 0.014 inch, 0.015 inch, 0.016 inch, 0.017 inch, 0.018 inch, 0.019 inch, 0.020 inch, 0.021, inch, 0.022 inch, 0.023 inch, 0.024 inch, 0.025 inch, 0.026 inch, 0.027 inch, 0.028 inch, 0.029 inch, or 0.030 inch. In one exemplary embodiment, the $CGY_2$ 180 is 0.376 inch above the ground plane, the $CGZ_2$181 is 1.330 inches rearward of the leading edge, and the $CGX_1$ 173 is 0.015 inch toeward of the Y axis 1062.

C. Exit Point Method

The combination of a lightweight crown insert 800, main body 202, a high density sole insert 430, a removable, adjustable, or interchangeable rear weight assembly 1100 or a combination thereof provides a golf club head with a low center of gravity that is forgiving and reduces golf ball spin compared to a club head devoid of a sole insert. These fairway-type golf club head components provide the basis for the CG 172 locations described herein. The fairway-type golf club head 100 described herein comprise features selected from a group consisting of a high density sole insert 430, a lightweight crown insert 800, a removable, adjustable, or interchangeable rear weight assembly 1100, and a combination thereof to balance the CG 172 along the FLIP axis 195. The CG 172 location ranges defined herein require a high density sole insert having a mass in the range of 70 grams to 90 grams.

Using the exit point method, an imaginary box can be defined around the club head CG 172 by minimum and maximum $CGX_2$, $CGY_2$, and $CGZ_3$ values. The $CGX_2$ 179 can define the box in the heel-to-toe direction, the $CGY_2$ 180 can define the box in the crown-to-sole direction, and the $CGZ_3$ 187 can define the box in the front-to-rear direction. The imaginary box can define a range of optimal CG 172 values.

According to the exit point method, the $CGZ_3$187 can be in a range of between 1.00 inch to 1.50 inches. For example, the $CGZ_3$187 can be between 1.00 inch to 1.25 inches, between 1.10 inches to 1.40 inches, or between 1.25 inches to 1.50 inches. The $CGZ_3$187 can be approximately 1.00 inch, 1.05 inches, 1.10 inches, 1.15 inches, 1.20 inches, 1.25 inches, 1.30 inches, 1.35 inches, 1.40 inches, 1.45 inches, or 1.50 inches. The $CGY_2$ 180 can be in a range of between 0.20 inch to 0.50 inch. For example, the $CGY_2$ 180 can be between 0.20 inch to 0.30 inch, between 0.25 inch to 0.40 inch, between 0.30 inch to 0.40 inch, between 0.35 inch to 0.40 inch, or between 0.35 inch to 0.50 inch. The $CGY_2$ 180 can be approximately 0.20 inch, 0.21 inch, 0.22 inch, 0.23 inch, 0.24 inch, 0.25 inch, 0.26 inch, 0.27 inch, 0.28 inch, 0.29 inch, 0.30 inch, 0.31 inch, 0.32 inch, 0.33 inch, 0.34 inch, 0.35 inch, 0.36 inch, 0.37 inch, 0.38 inch, 0.39 inch, 0.40 inch, 0.41 inch, 0.42 inch, 0.43 inch, 0.44 inch, 0.45 inch, 0.46 inch, 0.47 inch, 0.48 inch, 0.49 inch, or 0.50 inch. The $CGX_2$ 179 can be in a range of between 0.00 inch to 0.020 inch. For example, the $CGX_2$ 179 can be between 0.00 inch to 0.005 inch, between 0.005 inch to 0.015 inch, between or between 0.010 inch to 0.020 inch. The $CGX_2$ 179 can be 0.000 inch, 0.001 inch, 0.002 inch, 0.003 inch, 0.004 inch, 0.005 inch, 0.006 inch, 0.007 inch, 0.008 inch, 0.009 inch, 0.010 inch, 0.011 inch, 0.012 inch, 0.013 inch, 0.014 inch, 0.015 inch, 0.016 inch, 0.017 inch, 0.018 inch, 0.019 inch, or 0.020 inch. In one exemplary embodiment, the $CGY_2$ 180 is 0.376 inch above the ground plane, the $CGZ_3$ 187 is 1.10 inches forward of the exit point 196, and the $CGX_2$ 179 is 0.016 inch heelward of the exit point 196.

D. FLIP Axis Method

The combination of a lightweight crown insert 800, main body 202, a high density sole insert 430, a removable, adjustable, or interchangeable rear weight assembly 1100, or a combination thereof provides a golf club head with a low center of gravity that is forgiving and reduces golf ball spin compared to a club head devoid of a sole insert. These fairway-type golf club head components provide the basis for the CG 172 locations described herein. The fairway-type golf club head 100 described herein comprise features selected from a group consisting of a high density sole insert 430, a lightweight crown insert 800, a removable, adjustable, or interchangeable rear weight assembly 1100, and a combination thereof to balance the CG 172 along the FLIP axis 195. The CG 172 location ranges defined herein require a high density sole insert having a mass in the range of 70 grams to 90 grams.

Using the FLIP axis method, an imaginary cylinder can be defined around the club head CG 172 by defining ranges for the $CGF_1$ and $CGF_2$ values. The $CGF_1$ 186 value can define a radius of the cylinder, and the $CGF_2$ 182 value can define the cylinder height along the FLIP axis 195. The imaginary cylinder can define a range of optimal CG 172 values.

According to the FLIP Axis Method, the $CGF_2$ 182 can be in a range of between 1.00 inch to 1.50 inches. For example, the $CGF_2$ 182 can be between 1.00 inch to 1.25 inches, between 1.10 inches to 1.40 inches, or between 1.25 inches to 1.50 inches. The $CGF_2$ 182 can be approximately 1.00 inch, 1.05 inches, 1.10 inches, 1.15 inches, 1.20 inches, 1.25 inches, 1.30 inches, 1.35 inches, 1.40 inches, 1.45 inches, or 1.50 inches. The $CGF_1$ 186 can be in a range of between 0.00 inch to 0.25 inch. For example, the $CGF_1$ 186 can be between 0.00 inch to 0.040 inch, between 0.025 inch to 0.040 inch, between 0.035 inch to 0.040 inch, between 0.040 inch to 0.050 inch, between 0.040 inch to 0.075 inch, between 0.050 inch to 0.10 inch, between 0.075 inch to 0.10 inch, between 0.10 inch to 0.25 inch, or between 0.15 inch to 0.25 inch. The $CGF_1$ 186 can be approximately 0.000 inch, 0.001 inch, 0.002 inch, 0.003 inch, 0.004 inch, 0.005 inch, 0.006 inch, 0.007 inch, 0.008 inch, 0.009 inch, 0.010 inch, 0.011 inch, 0.012 inch, 0.013 inch, 0.014 inch, 0.015 inch, 0.016 inch, 0.017 inch, 0.018 inch, 0.019 inch, 0.020 inch, 0.021 inch, 0.022 inch, 0.023 inch, 0.024 inch, or 0.025 inch. In one exemplary embodiment, the $CGF_2$ 182 is 1.233 inches rearward from the FLIP 190 along the FLIP axis 195, and the $CGF_1$ 186 is 0.038 inch.

The specified ranges for the CG 172 ensure that the CG 172 is located on the FLIP axis 195 in a low and rearward position relative to the front portion of the fairway-type golf club head. The careful placement of the club head CG 172 on the FLIP axis 195 and as low as possible allows for optimal force transference to the golf ball. As such, the $CGZ_1$ 174 can be less than 1.50 inches, and the $CGY_1$ 176 can be less than 0.40 inch. The $CGF_1$ 186 can be less than 0.25 inch. The club head CG 172 can be limited to the ranges discussed above to ensure the club head CG 172 is located on or near the FLIP axis 195. A head CG 172 placement along the FLIP axis 195 provides optimal force transference and reduces spin. Additionally, the $CGY_2$ 180 can be less than 0.50 inch, and the $CGF_2$ 182 can be greater than 1.00 inch. Importance of Material Choice and Its Effect on CG Position The combination of a lightweight crown insert 800, main body 202, a high density sole insert 430, a removable, adjustable, or interchangeable rear weight assembly 1100, or a combination thereof provides a golf club head with a low center of gravity that is forgiving and reduces golf ball spin compared to a club head devoid of a sole insert. The fairway-type golf club head 100 described herein uses a high density sole insert 430, a lightweight crown insert 800, a removable, adjustable, or interchangeable rear weight assembly 1100, or a combination thereof, to balance the CG 172 along the FLIP axis 195.

Because the FLIP axis 195 is essentially normal to the loft plane 1010 of the golf club head 100, it necessarily slopes closer to the sole 118 as it moves rearwards toward the rear 110 of the golf club head 100. Thus, the further rear the CG 172 is moved, the lower the CG 172 must be placed in order to be on or near the FLIP axis 195. This necessitates a careful choice and placement of materials for the golf club head 100. Ideally, the crown 116 and main body 102 of the golf club have a low density, and a very large portion of the golf club head total mass would be located very low in the golf club head 100. However, there are limits as to how much of the total mass of the golf club head 100 can be moved downward toward the sole 118 to lower the CG 172. This, then, also requires that the CG 172 of the golf club head 100 be carefully positioned and moved somewhat forward, towards the front 108, in order to have the CG 172 as close as possible to the FLIP axis while also moved as far towards the rear 110 as possible, to maximize total club head MOI.

Both the geometry and particular material choices for each component support a high percentage of mass in a lower portion of the golf club head. The effect of mass and configuration of each component and system is cumulative. The fairway-type golf club head described herein may comprise features selected from any or all of the described components. The main body, face cup, crown insert, rear weight assembly, and support structure, and the sole insert each have geometries and material and mass properties that can be configured to contribute to the desired placement of the golf club head CG.

VI. Main Body

It is desirable that the main body 202 provide a strong, rigid framework while also minimizing the mass allocated to the main body. The main body 202 can be comprised of a metallic material such as a titanium alloy or an aluminum alloy. The titanium alloy can be selected from the group consisting of Ti-8-1-1, Ti 6-4, Ti 9-1-1, and TI140C. The main body 202 can also be comprised of a fiber reinforced polymer or a fiber reinforced composite. A steel alloy is less desirable as a material for the main body because of the higher specific mass compared to a titanium alloy, aluminum alloy, a fiber reinforced polymer, or a fiber reinforced composite. The main body 202 serves as an anchoring for a combination of fairway-type golf club head components while simultaneously reducing structural mass that can be redistributed throughout the club head as need to improve the CG 172 location and/or MOI of the fairway-type club head 100.

VII. High-Density Sole Insert (430)

The fairway-type golf club head 100 can further comprise a high density sole insert 430. More specifically, the main body sole 218 can further comprise a high-density sole insert 430 (or sole insert) that is received within the sole insert recess 240. The sole insert 430 can be removably received within the sole recess with one or more threaded fasteners 435. The sole insert 430 can define an aperture 445 that can receive a threaded fastener 435. In another embodiment, the sole insert 430 can be permanently affixed within the sole insert recess. In this alternate embodiment, the sole insert 430 can be welded within the sole insert recess. In still another alternate embodiment, the sole insert 430 can be integrally cast with the fairway-type golf club head main body 102.

The high-density sole insert 430 can comprise a steel alloy having a density greater than the crown 116 and main body 102 (which would serve to move more mass lower and into the sole 118). The high-density sole insert 430 can more preferably comprise a tungsten alloy or pure tungsten material (which would move a still larger portion of the fairway-type golf club head total mass closer to the sole 118). The sole insert 430 can be configured to be as low and flat as possible, to drive the fairway-type golf club head CG 172 as far as possible toward the sole 118.

Referring to FIG. 7A, the front edge 454 and rear edge 456 can be generally parallel to one another or generally parallel with respect to the X axis 1052. Alternatively, a front edge 454 portion or a rear edge 456 portion can be non-parallel to the rear edge 456 and can be non-parallel with respect to the X axis 1052. The heel side edge 458 and toe side edge 460 can be parallel with one another and non-parallel with the X axis 1052 and the Z axis 1072. In some embodiments, the heel side edge 458 can comprise at least a portion that is parallel to the toe side edge 460. The sole insert 430 further comprises a top surface 462, and a bottom surface 464. The sole insert 430 is configured to be received within the sole insert recess 240 such that the top surface 462 is in contact with the sole insert recess floor 241, and the bottom surface 464 forms a portion of the sole 118.

The sole insert 430 can be relatively large such that it defines a substantial portion of the fairway-type golf club head sole 118. The sole insert 430 extends substantially across the sole 118 in a front-to-rear direction such that the maximum sole insert depth 446 is greater than 50% of the fairway-type golf club head depth 160. The sole insert 430 extends substantially across the sole 118 in a heel-to-toe direction such that the maximum sole insert length 447 is greater than 50% of the fairway-type golf club head length 162.

The sole insert length 447 is carefully selected to balance the fairway-type golf club head CG 172 with the fairway-type golf club head MOI. A wider insert 430 would follow the curvature of the fairway-type golf club head 100 and begin to form a portion of the perimeter region 112. A wider insert 430 can increase MOI and provide a more forgiving fairway-type golf club head; however, the wider insert 430 would place more mass higher on the fairway-type golf club head 100 and raise the fairway-type golf club head CG 172. Conversely, a narrower insert can lower fairway-type golf club head CG 172 but can reduce fairway-type golf club head MOI, providing a less forgiving club. Therefore, the sole insert length 447 is selected to be large enough to provide substantial mass near the sole 118 while remaining within the sole portion 118 to optimize fairway-type golf club head CG and MOI.

As discussed above, the dimensions of the sole insert 430 are carefully selected to balance the fairway-type golf club head CG 172 and fairway-type golf club head MOI. The sole insert depth 446 and length 447 are selected such that the insert 430 spans across the sole 118 and defines a substantial portion of the sole 118. The sole insert bottom surface 464 defines a surface area that is visible from an exterior of the fairway-type golf club head 100. The surface area can be greater than 2.50 $in^2$, greater than 2.75 $in^2$, greater than 3.00 $in^2$, greater than 3.25 $in^2$, or greater than 3.50 $in^2$. Alternatively, the surface area can be between 2.50 $in^2$ to 3.00 $in^2$, between 2.75 $in^2$ to 3.25 $in^2$, or between 3.00 $in^2$ to 3.50 $in^2$. In one exemplary embodiment, the visible surface area is 3.135 $in^2$. The surface area is determined by the sole insert depth 446 and length 477.

The sole insert depth 446 and length 447 can be restricted to ensure the sole insert 430 remains generally within the central sole portion. Additionally, the sole insert 430 can be located at an offset 449 from the strike face 104 to further ensure the sole insert 430 remains near the central portion of the sole 118. In other words, the sole insert 430 is configured such that it forms only a sole 418 portion and does not form a fairway-type golf club head perimeter 112 portion or the strike face 104. This arrangement of the sole insert 430 will serve to position the CG 172 of the fairway-type golf club head 100 further back in order to be on or near the FLIP axis 195. If the design consisted of a sole insert 430 forming a portion of the perimeter, the CG 172 would be raised, making it more difficult to position on or near the FLIP axis 195. As such, the sole insert depth 446 can be less than 2.0 inches, the length 447 can be less than 3.0 inches, the thickness 448 can be less than 0.30 inch, and the visible surface area can be less than 3.50 $in^2$.

As discussed above, the fairway-type golf club head 100 defines a perimeter, wherein the perimeter defines an upper portion 152 and a lower portion 156 of the fairway-type golf club head 100. The lower portion 152 comprises the sole 118 and a portion of the perimeter region 112. The lower portion 156 comprises an outer surface, wherein the sole insert bottom surface 464 can define between 15% to 40% of the outer surface. For example, the bottom surface 464 can define between 15% to 30%, between 18% to 23%, or between 25% to 40% of the outer surface. In one exemplary embodiment, the bottom surface 464 defines 21.68% of the lower portion. The dimensions of the sole insert 430 are carefully selected to provide a low insert CG that enables a fairway-type golf club head CG 172 near the FLIP axis 195.

The sole insert bottom surface 464 defines a curvature that generally follows the curvature of the fairway-type golf club head 100. The sole insert 430 defines a heel side radius of curvature (ROC) measured along the bottom surface 464 from the lowest point of the sole insert 430 to the heel side edge 458, and a toe side radius of curvature (ROC) measured from the lowest point of the sole insert 430 to the toe side edge 460. In some embodiments, the heel side ROC can smaller than the toe side ROC. For example, in one embodiment, the heel side ROC is 4.50 inches, and the toe side ROC is 5.75 inches. Referring to FIG. 7C, the sole insert ROC 430 can follow the sole 118 ROC, and the sole insert 430 can further define a heel side maximum height 492 and a toe side maximum height 494. In some embodiments, the heel and toe side maximum heights 492, 494 can be the same, and in other embodiments, they are different. In one exemplary embodiment, the heel and toe side heights 492, 494 are 0.287 inch. The maximum height 492, 494 can define an insert plane parallel to the ground plane 1000, wherein at least 70% of the fairway-type golf club head mass 100 is below the insert plane. The sole insert 430 can further comprise a mass pad 478, or a thickened region to enable a fairway-type golf club head CG 172 located on or near the FLIP axis 195. Referring to FIG. 7A, in some embodiments, the mass pad can be located near the front edge 454 and the heel side edge 458. However, in other embodiments, the mass pad 478 can be located closer to the toe side edge 460 or the rear edge 456. The sole insert 430 can be partitioned into four quadrants through an approximate midline of the depth 446 and length 447: a front-heel quadrant, a front-toe quadrant, a rear-toe quadrant, and a rear-heel quadrant. The four quadrants help illustrate the mass distribution of the sole insert 430.

In some sole inserts 430 comprising a forward and heelward mass pad 478, more than 40% of the mass is located in the front-heel quadrant, and more than 70% of the mass is located in the front-heel and front-toe quadrants. In some embodiments, the front-heel quadrant can comprise between 30 grams to 45 grams, the front-toe quadrant can comprise between 20 grams to 30 grams, rear-toe quadrant can comprise between 5 grams to 10 grams, and the rear-heel quadrant can comprise between 5 grams to 10 grams. In other embodiments, the front-heel quadrant can comprise between 35 grams to 40 grams, the front-toe quadrant can comprise between 24 grams to 38 grams, rear-toe quadrant can comprise between 7 grams to 10 grams, and the rear-heel quadrant can comprise between 7 grams to 10 grams. The forward and heelward mass pad 478 can position the fairway-type golf club head CG 172 near the FLIP axis 195.

The sole insert CG 472 is influenced by the depth 446, length 447, and thickness 448 of the sole insert 430. Certain portions of the sole insert 430 can be thickened to adjust the CG as other fairway-type golf club head 100 components are adjusted. For example, a fairway-type golf club head 100 comprising an aluminum face cup will have less mass towards the front 108 and will require a sole insert 430 having more mass towards the front 110. In such an embodiment, the sole insert 430 can further comprise a mass pad or a thickened region 478 near the front edge 454. In contrast, a fairway-type golf club head 600 comprising a steel face cup will have more mass towards the front 608 and will require a sole insert 630 having more mass towards the rear 610. In such an embodiment, the sole insert 630 can comprise a mass pad or a thickened region 678 located at an offset from the front edge 654.

The sole insert 430 can preferably comprise a material having a density equal to or higher than 8 g/cm$^3$. The density of sole insert 430 can be 8 g/cm$^3$, 9 g/cm$^3$, 10 g/cm$^3$, 11 g/cm$^3$, 12 g/cm$^3$, 13 g/cm$^3$, 14 g/cm$^3$, 15 g/cm$^3$, 16 g/cm$^3$, 17 g/cm$^3$, 18 g/cm$^3$, 19 g/cm$^3$, or 20 g/cm$^3$. The density of the sole insert 430 can be between 8 g/cm$^3$ to 15 g/cm$^3$, between 12 g/cm$^3$ to 19 g/cm$^3$, or between 15 g/cm$^3$ to 19 g/cm$^3$. The density of the sole insert 430 is preferably greater than or equal to the density of the cup face 490 material.

The sole insert 430 defines a total mass that is relatively large and can be in a range of 70 grams to 90 grams. In some embodiments, the total mass can be between 70 grams to 75 grams, between 72 grams to 80 grams, between 75 grams to 85 grams, between 75 grams to 90 grams, between 80 grams to 85 grams, or between 83 grams to 90 grams. Alternatively, the total mass can be at least 75 grams, at least 80 grams, at least 82 grams, at least 84 grams, at least 86 grams or at least 88 grams. In one exemplary embodiment, the mass is 81.1 grams.

Because the mass sole insert has such a large effect on the overall fairway-type golf club head CG, the position of the sole insert center of gravity (sole insert CG) 472 is important to the performance of the described fairway-type golf club head. As shown in FIGS. 8A-8C, the sole insert further 430 defines a low and optimally placed center of gravity (CG) 472. The sole insert CG 472 is carefully placed to enable a fairway-type golf club head CG 172 location along the FLIP axis 195. The sole insert CG 472 location can be described using any combination of the methods described herein.

A. Geometric Center Method

The geometric center method, as discussed above for locating the fairway-type golf club head CG 172, can be adapted to locate the sole insert CG 472 of a fairway-type club head 100 comprising a sole insert 430. The geometric center method for locating the sole insert CG 472 can be the same as the geometric center method for locating the fairway-type club head CG 172. However, the sole insert CG 472 is a characteristic of the sole insert 430, and therefore, produces different location ranges than the club head CG 172. The sole insert CG 472 influences the location of the club head CG 172, but the sole insert CG 472 will never be co-located with the fairway-type club head CG 172.

Using the geometric center method, an imaginary box can be defined around the sole insert CG 430 by minimum and maximum $CGX_1$, $CGY_1$, and $CGZ_1$ values. The $CGX_1$ 473 can define the box in the heel-to-toe direction, the $CGY_1$ 476 can define the box in the crown-to-sole direction, and the $CGZ_1$ 474 can define the box in the front-to-rear direction. The imaginary box can define a range of optimal CG 472 values. The CG 472 location ranges defined herein require a high density sole insert having a mass in the range of 70 grams to 90 grams.

According to geometric center method, the $CGZ_1$474 can be in a range of between 1.00 inch to 1.50 inches, the $CGY_1$476 can be in a range of 0.25 inch to 0.75 inch, and the $CGX_1$ 473 can be between 0.05 inch to 0.25 inch. For example, the $CGZ_1$474 can be between 1.00 inch to 1.25 inches, between 1.10 inches to 1.40 inches, or between 1.25 inches to 1.50 inches. The $CGZ_1$ 474 can be 1.00 inch, 1.05 inches, 1.10 inches, 1.15 inches, 1.20 inches, 1.25 inches, 1.30 inches, 1.35 inches, 1.40 inches, 1.45 inches, or 1.50 inches. The $CGY_1$476 can be between 0.25 inch to 0.60 inch, between 0.50 inch to 0.60 inch, between 0.50 inch to 0.75 inch, or between 0.55 inch to 0.70 inch. The $CGY_1$ 476 can be approximately 0.25 inch, 0.30 inch, 0.35 inch, 0.40 inch, 0.45 inch, 0.50 inch, 0.55 inch, 0.60 inch, 0.65 inch, 0.70 inch, or 0.75 inch. The $CGX_1$ 473 can be between 0.05 inch to 0.15 inch, between 0.10 inch to 0.25 inch, or between 0.15 inch to 0.25 inch. The $CGX_1$ 473 can be approximately 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, 0.21 inch, 0.22 inch, 0.23 inch, 0.24 inch, or 0.25 inch. In one exemplary embodiment, the $CGZ_1$ 474 is 1.245 inches rearward of the geometric center 140, the $CGY_1$ 476 is 0.556 inch below the Z axis 1072, and the $CGX_1$ 473 is 0.146 inch toeward of the Y axis 1062.

B. Leading Edge Method

The leading edge method, as discussed above for locating the fairway-type golf club head CG 172, can be adapted to locate the sole insert CG 472 of a fairway-type club head 100 comprising a sole insert 430. The leading edge method for locating the sole insert CG 472 can be the same as the leading edge method for locating the fairway-type club head CG 172. However, the sole insert CG 472 is a characteristic of the sole insert 430, and therefore, produces different location ranges than the club head CG 172. The sole insert CG 472 influences the location of the club head CG 172, but the sole insert CG 472 will never be co-located with the fairway-type club head CG 172.

Using the leading edge method, an imaginary box can be defined around the sole insert CG 472 by minimum and maximum $CGX_1$, $CGY_2$, and $CGZ_2$ values. The $CGX_1$ 473 can define the box in the heel-to-toe direction, the $CGY_2$ 480 can define the box in the crown-to-sole direction, and the $CGZ_2$ 481 can define the box in the front-to-rear direction. The imaginary box can define a range of optimal CG 472 values. The CG 472 location ranges defined herein require a high density sole insert having a mass in the range of 70 grams to 90 grams.

According to the leading edge method, the $CGY_2$480 can be in a range of between 0.01 inch to 0.25 inch. For example, the $CGY_2$480 can be between 0.01 inch to 0.05 inch, between 0.025 inch to 0.05 inch, between 0.10 inch to 0.25 inch, or between 0.15 inch to 0.25 inch. The $CGY_2$480 can be approximately 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, 0.21 inch, 0.22 inch, 0.23 inch, 0.24 inch, or 0.25 inch. The $CGZ_2$ 481 can be in a range of between 1.00 inch to 1.50 inches. For example, the $CGZ_2$ 481 can be between 1.00 inch to 1.25 inches, between 1.10 inches to 1.40 inches, between 1.25 inches to 1.50 inches, or between 1.40 inches to 1.50 inches. The $CGZ_2$ 481 can be approximately 1.00 inch, 1.05 inches, 1.10 inches, 1.15 inches, 1.20 inches, 1.25 inches, 1.30 inches, 1.35 inches, 1.40 inches, 1.45 inches, or 1.50 inches. The $CGX_1$ 473 can be between 0.05 inch to 0.25 inch. For example, the $CGX_1$ 473 can be between 0.05 inch to 0.15 inch, between 0.10 inch to 0.25 inch, or between 0.15 inch to 0.25 inch. The $CGX_1$ 473 can be approximately 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, 0.21 inch, 0.22 inch, 0.23 inch, 0.24 inch, or 0.25 inch. In one exemplary embodiment, the $CGY_2$480 is 0.105 inch above the ground plane 1000, the $CGZ_2$ 481 is 1.365 inches rearward of the leading edge 114, and the $CGX_1$ 473 is 0.146 inch toeward of the Y axis 1062.

C. Exit Point Method

The exit point method, as discussed above for locating the fairway-type golf club head CG 172, can be adapted to locate the sole insert CG 472 of a fairway-type club head 100 comprising a sole insert 430. The exit point method for locating the sole insert CG 472 can be the same as the exit point method for locating the fairway-type club head CG 172. However, the sole insert CG 472 is a characteristic of the sole insert 430, and therefore, produces different location ranges than the club head CG 172. The sole insert CG 472 influences the location of the club head CG 172, but the sole insert CG 472 will never be co-located with the fairway-type club head CG 172.

Using the exit point method, an imaginary box can be defined around the sole insert CG 472 by minimum and maximum $CGX_2$, $CGY_2$, and $CGZ_3$ values. The $CGX_2$ 479 can define the box in the heel-to-toe direction, the $CGY_2$ 480 can define the box in the crown-to-sole direction, and the $CGZ_3$ 487 can define the box in the front-to-rear direction. The imaginary box can define a range of optimal CG 472 values. The CG 472 location ranges defined herein require a high density sole insert having a mass in the range of 70 grams to 90 grams.

According to the exit point method, the $CGY_2$480 can be in a range of between 0.01 inch to 0.25 inch. For example, the $CGY_2$480 can be between 0.01 inch to 0.05 inch, between 0.025 inch to 0.05 inch, between 0.10 inch to 0.25 inch, or between 0.15 inch to 0.25 inch. The $CGY_2$480 can be 0.01 inch, 0.02 inch, 0.03 inch, 0.04 inch, 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, 0.21 inch, 0.22 inch, 0.23 inch, 0.24 inch, or 0.25 inch. The $CGZ_3$ 487 can be in a range of between 0.90 inch to 1.10 inches. For example, the $CGZ_3$487 can be between 0.90 inch to 1.10 inches, between 0.95 inch to 1.00 inch, or between 1.00 inch to 1.10 inches. The $CGZ_3$487 can be 0.90 inch, 0.91 inch, 0.92 inch, 0.93 inch, 0.94 inch, 0.95 inch, 0.96 inch, 0.97 inch, 0.98 inch, 0.99 inch, 1.00 inch, 1.01 inches, 1.02 inches, 1.03 inches, 1.04 inches, 1.05 inches, 1.06 inches, 1.07 inches, 1.08 inches, 1.09 inches, or 1.10 inches, The $CGX_2$ 479 can be in a range of between 0.00 inch to 0.25 inch. For example, the $CGX_2$479 can be between 0.00 inch to 0.005 inch, between 0.01 inch to 0.10 inch, or between 0.10 inch to 0.25 inch. In one exemplary embodiment, the $CGY_2$480 is 0.105 inch above the ground plane 1000, the $CGZ_3$ 487 is 1.057 inches forward of the exit point 196, and the $CGX_2$ 479 is 0.146 inch heelward of the exit point 196.

D. FLIP Axis Method

The FLIP axis method, as discussed above for locating the fairway-type golf club head CG 172, can be adapted to locate the sole insert CG 472 of a fairway-type club head 100 comprising a sole insert 430. The FLIP axis method for locating the sole insert CG 472 can be the same as the FLIP axis method for locating the fairway-type club head CG 172. However, the sole insert CG 472 is a characteristic of the sole insert 430, and therefore, produces different location ranges than the club head CG 172. The sole insert CG 472 influences the location of the club head CG 172, but the sole insert CG 472 will never be co-located with the fairway-type club head CG 172.

Using the FLIP axis method, an imaginary cylinder can be defined around the sole insert CG 472 by defining ranges for the $CGF_1$ and $CGF_2$ values. The $CGF_1$ 486 value can define radius of the cylinder, and the $CGF_2$482 value can define the height of the cylinder along the FLIP axis 195. The imaginary cylinder can define a range of optimal CG 472 values. The CG 472 location ranges defined herein require a high density sole insert having a mass in the range of 70 grams to 90 grams.

According to the FLIP Axis Method, the $CGF_2$ 482 can be in a range of between 1.00 inch to 1.50 inches. For example, the $CGF_2$ 482 can be between 1.00 inch to 1.25 inches, between 1.10 inches to 1.40 inches, or between 1.25 inches to 1.50 inches. The $CGF_2$482 can be approximately 1.00 inch, 1.05 inches, 1.10 inches, 1.15 inches, 1.20 inches, 1.25 inches, 1.30 inches, 1.35 inches, 1.40 inches, 1.45 inches, or 1.50 inches. The $CGF_1$486 can be in a range of between 0.01 inch to 0.25 inch. For example, the $CGF_1$486 can be between 0.01 inch to 0.05 inch, between 0.025 inch to 0.05 inch, between 0.10 inch to 0.25 inch, or between 0.15 inch to 0.25 inch. The $CGF_1$486 can be approximately 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, 0.21 inch, 0.22 inch, 0.23 inch, 0.24 inch, or 0.25 inch. In one exemplary embodiment, the $CGF_2$482 is 1.346 inches rearward from the FLIP 190 along the FLIP axis 195, and the $CGF_1$ 486 is 0.212 inch.

E. Relative Method

The relative method of locating CG can be used to locate the sole insert CG 472 of a fairway-type club head 100 comprising a sole insert 430. The relative method assumes that the sole insert 430 is received within the main body 202. The sole insert CG 472 is a characteristic of the sole insert 430, and therefore, produces different location ranges than the club head CG 172. The sole insert CG 472 influences the location of the club head CG 172, but the sole insert CG 472 will never be co-located with the fairway-type club head CG 172. Therefore, the relative method can be used to describe the different locations of the sole insert CG 472 and the fairway-type golf club head CG 172 relative to one another.

Using the relative method, an imaginary box can be defined around the sole insert CG 472 by minimum and maximum $CGX_3$, $CGY_4$, and $CGZ_5$ values. The $CGX_3$ 483 can define the box in the heel-to-toe direction, the $CGY_4$ 477 value can define the box in the crown-to-sole direction, and the $CGZ_5$ 475 value can define the box in the front-to-rear direction. The imaginary box can define a range of optimal CG 472 values. The CG 472 location ranges defined herein require a high density sole insert having a mass in the range of 70 grams to 90 grams.

According to the relative method, the $CGY_4$ 477 can be in a range between 0.10 inch to 0.50 inch, the $CGZ_5$ 475 can be in a range between 0.010 inch to 0.25 inch, and the $CGX_3$ 483 can be in a range of 0.05 inch to 0.25 inch. For example, the $CGY_4$477 can be between 0.10 inch to 0.25 inch, between 0.25 inch to 0.35 inch, between 0.25 inch to 0.40 inch, or between 0.35 inch to 0.50 inch. The $CGY_4$ 477 can be approximately 0.10 inch, 0.15 inch, 0.20 inch, 0.25 inch, 0.30 inch, 0.35 inch, 0.40 inch, 0.45 inch, or 0.50 inch. The $CGZ_5$ 475 can be 0.01 inch to 0.05 inch, between 0.025 inch to 0.05 inch, between 0.10 inch to 0.25 inch, or between 0.15 inch to 0.25 inch. The $CGZ_5$ 475 can be approximately 0.01 inch, 0.02 inch, 0.03 inch, 0.04 inch, 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, 0.21 inch, 0.22 inch, 0.23 inch, 0.24 inch, or 0.25 inch. The $CGX_3$ 483 can be between 0.05 inch to 0.10 inch, between 0.10 inch to 0.15 inch, or between 0.10 inch to 0.25 inch. The $CGX_3$ 483 can be approximately 0.05 inch, 0.06 inch, 0.07 inch, 0.08 inch, 0.09 inch, 0.10 inch, 0.11 inch, 0.12 inch, 0.13 inch, 0.14 inch, 0.15 inch, 0.16 inch, 0.17 inch, 0.18 inch, 0.19 inch, 0.20 inch, 0.21 inch, 0.22 inch, 0.23 inch, 0.24 inch, or 0.25 inch. In one exemplary embodiment, the $CGY_4$ 477 is 0.271 inch below the fairway-type golf club head CG 172, the $CGZ_5$ 475 is 0.044 inch rearward of the fairway-type golf club head CG 172, and the $CGX_3$ 483 is 0.130 inch toeward of the fairway-type golf club head CG 172.

The relative method establishes the importance of the sole insert 430 design in balancing the fairway-type golf club head CG. The sole insert 430 is limited to the specified ranges under the relative method because these ranges position the fairway-type golf club head CG 172 along the FLIP axis 195. In other words, the sole insert 430 is designed with certain characteristics such as the dimensions or the inclusion of a mass pad in order to maintain a fairway-type golf club head CG along the FLIP axis 195.

The careful placement of the sole insert CG 472 permits a fairway-type golf club head CG 172 along the FLIP axis, which allows for optimal force transference to the golf ball. As such, the $CGZ_1$474 can be less than 1.50 inches, and the $CGY_1$476 can be less than 0.75 inch. The $CGZ_5$ 475 can be less than 0.50 inch, and the $CGY_4$477 can be less than 0.50 inch. The $CGF_1$ 486 can be less than 0.25 inch. The sole insert CG 472 can be limited to the ranges discussed above to ensure the fairway-type golf club head CG 172 is located on the FLIP axis 195. A head CG 172 placement along the FLIP axis 195 provides optimal force transference and reduces spin. Should the sole insert CG fall outside of the specified ranges, the fairway-type golf club head CG 172 can move further away from the FLIP axis 195. For example, should the sole insert CG 472 be located at a $CGZ_1$474 larger than 1.50 inches, the fairway-type golf club head 100 would require additional mass towards the front 108 to balance the more rearward sole insert CG 472. While the fairway-type golf club head CG can then be located along the FLIP axis 195, this additional mass can reduce the MOI benefits to the fairway-type golf club head 100. Additionally, the $CGY_2$480 can be less than 0.25 inch, and the $CGF_2$ 482 can be greater than 1.00 inch. The sole insert CG 472 can be further limited by these ranges to ensure a low and rearward CG that benefits MOI and launch characteristics.

The sole insert 430 is formed from a high-density material to maintain a low sole insert CG 472. As such, the sole insert 430 helps maintain a low fairway-type golf club head CG 172. A relationship between the fairway-type golf club head CG and the sole insert CG of any of the sole insert embodiments described herein can be described using various ratios. The relationship can meet one or more of the following requirements:

$$\frac{\text{sole insert CGY2 480}}{\text{club head CGY2 180}} * \text{sole insert mass} \geq 20 \quad (6)$$

$$\frac{\text{sole insert CGY1 476}}{\text{club head CGY1 176}} * \text{sole insert mass} \geq 150 \quad (7)$$

A sixth CG ratio (6) establishes the relationship between the fairway-type golf club head $CGY_2$ 180 and the sole insert $CGY_2$480. The sixth CG ratio (6) is based on the leading edge method of locating CG 172, 472. The sixth CG ratio (6) demonstrates the low CG 172, 472 placement relative to the ground plane 1000 in addition to the sole insert mass 430. The sole insert 430 provides substantial mass near the sole 118 that lowers the overall fairway-type golf club head CG 172. The fairway-type golf club head $CGY_2$ 180 can be between 0.01 inch to 0.25 inch, and the sole insert $CGY_2$ 480 can be between 0.20 inch to 0.50 inch. In one exemplary embodiment, the fairway-type golf club head 100 has a sixth CG ratio (6) of 22.64.

A seventh CG ratio (7) establishes the relationship between the sole insert $CGY_1$ 476 and the fairway-type golf club head $CGY_1$ 176. The seventh CG ratio (7) is based on the geometric center method of locating CG 172, 472. In other words, the seventh CG ratio (7) demonstrates the sole insert CG 472 and the fairway-type golf club head CG 172, relative to the geometric center 140. The seventh CG ratio (7) further demonstrates the relationship between the CG 172, 472, and the sole insert mass 430. The sole insert $CGY_1$476 can be between 0.25 inch to 0.75 inch, and the fairway-type golf club head $CGY_1$ 176 can be between 0.10 inch to 0.40 inch. In one exemplary embodiment, the fairway-type golf club head 100 has a seventh CG ratio (7) of 157.66.

The relationship between the fairway-type golf club head CG 172 and the sole insert CG 472 can be limited to these CG ratios in order to enable a fairway-type golf club head CG 172 along the FLIP axis 195. In addition to satisfying one or more of the CG ratios above. The fairway-type golf club head CG 172 can be located closer to the front 108 than the sole insert CG 472. In other words, the sole insert $CGZ_1$ 474 is greater than the fairway-type golf club head $CGZ_1$174. In some embodiments, the sole insert $CGZ_1$ 474 can be at least 10% greater, at least 20% greater, or at least 30% greater than the fairway-type golf club head $CGZ_1$174. Referring to FIGS. 8A to 8B, the sole insert $CGZ_1$ 474 helps maintain a fairway-type golf club head CG 172 on the FLIP axis 195.

F. Sole Insert Comprising Extensions (530)

Figure 9A:
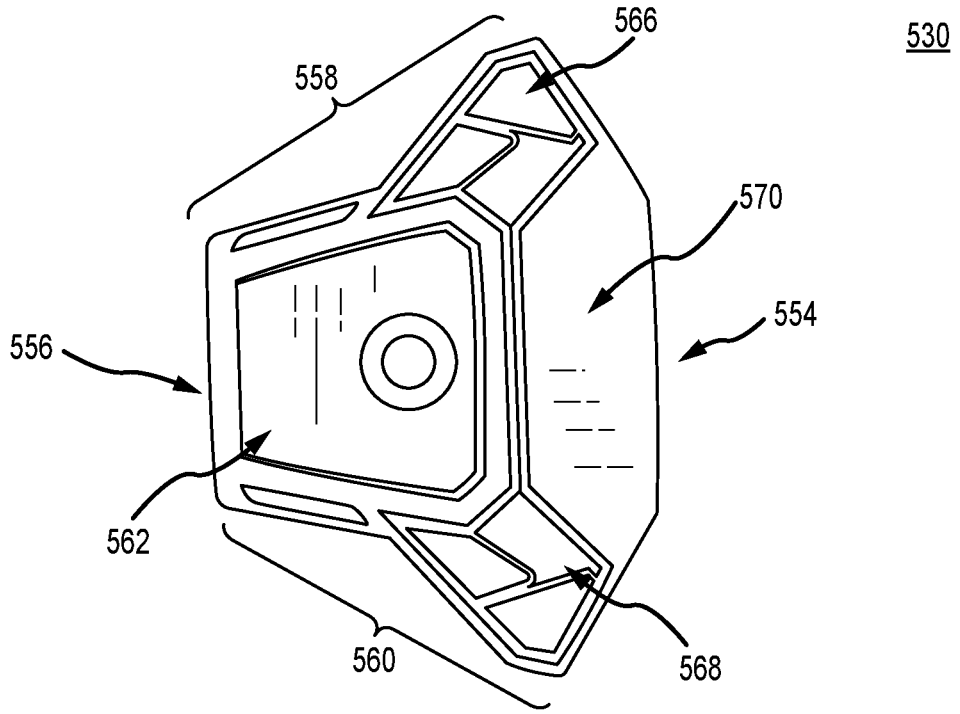
FIG. 9A illustrates a bottom view of a fairway-type golf club head sole insert with an aperture.

FIG. 9A illustrates an embodiment of a sole insert 530 configured to maintain a fairway-type golf club head CG on the FLIP axis 195. The sole insert 530 can comprise elements similar to the sole insert 430 as described in previous embodiments. The sole insert 530 comprises a main body flange 570, a heelward extension 566, and a toeward extension 568. The heelward extension 566 and the toeward extension 568 are positioned near the sole insert front 554 and extend outwardly from the main body flange 570. The heelward extension 566 forms a portion of the heel side edge 558, and the toeward extension 568 forms a portion of the toe side edge 560. The heel ward and toeward extensions 566, 568 are positioned near the insert front 554 to allow more than 50 percent of the mass of the sole insert 530 forward of a mid-line of the sole insert 530. The CG 172 location ranges defined herein require a high density sole insert having a mass in the range of 70 grams to 90 grams.

The heelward extension 566 forward edge slopes rearward from a heelward inflection point 590. The toeward extension 568 forward edge slopes rearward from a toeward inflection point 592. The heelward extension 566 comprises a maximum length measured in a heel-to-toe direction from the heelward inflection point 590 to the most heelward point of the heelward extension. The toeward extension 568 comprises a maximum length measured in a heel-to-toe direction from the toeward inflection point 592 to the most toeward point of the toeward extension. The maximum extension length for each of the heelward extension 566 and the toeward extension 568 is in a range of 0.600 inch to 0.700 inch.

This arrangement of the mass of the sole insert 530 (having more mass forward), along with the higher density steel face cup, will serve to position the CG 172 of the fairway-type golf club head 100 further forward than if the mass of the sole insert 530 was distributed more toward the rear 110 of the golf club 100, or if the face cup were comprised of less dense material. Recalling that the further back the CG 172 is moved, the lower the CG 172 must be placed in order to be on or near the FLIP axis 195. Moving the CG somewhat further forward allows it to be more easily positioned on or near the FLIP axis 195 at a greater height above the sole 118 than would be possible if the CG 172 were located further toward the rear 110 of the golf club 100. The mass distribution of the sole insert 530 can vary to move the location of the CG 172 lower or higher, or more forward, or more rearward.

Figure 9B:
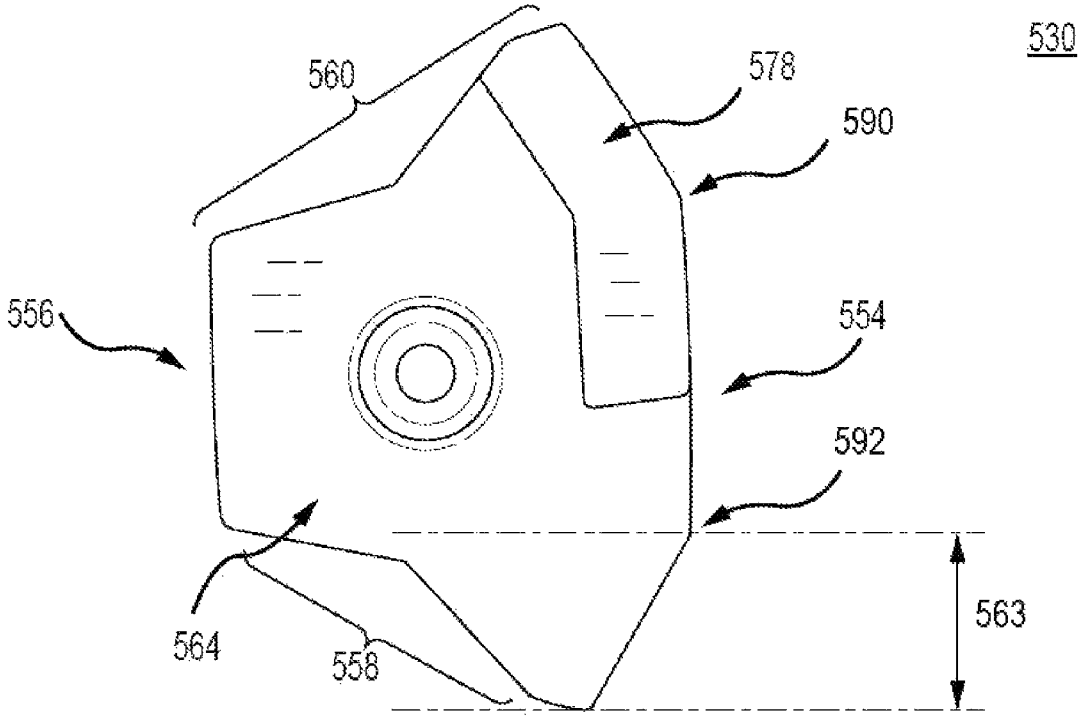
FIG. 9B illustrates a top view of a fairway-type golf club head sole insert with an aperture.
Figure 9C:
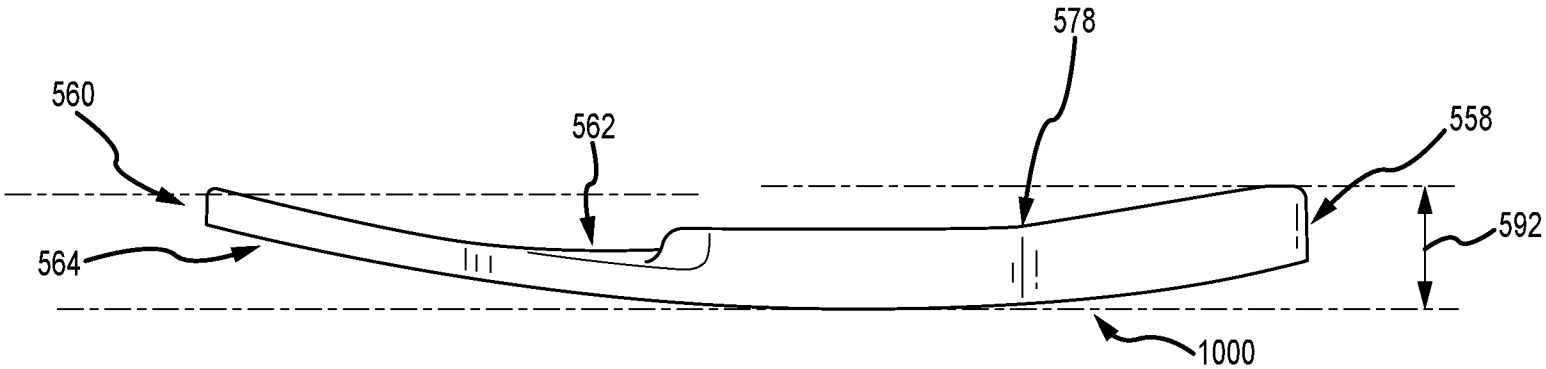
FIG. 9C illustrates a front view of a fairway-type golf club head sole insert with variable thickness.

Referring to FIGS. 9A to 9B, the sole insert 530 comprises a perimeter 520, having a front edge 554, a rear edge 556, a heel side edge 558, and a toe side edge 560. A portion of the front edge 554 and a portion of the rear edge 556 are generally parallel with one another, and the toe side edge 560 and heel side edge 558 are non-parallel with one another. The sole insert 530 further comprises a top surface 562 and a bottom surface 564, wherein the top surface 562 faces the internal cavity, and the bottom surface 564 forms a portion of the sole 118.

The sole insert 530 can be removably received within the sole recess with one or more threaded fasteners 435. The sole insert 530 can define an aperture 545 that can receive a threaded fastener 435.

The sole insert 530 can be relatively large such that it defines a substantial portion of the fairway-type golf club head sole 118. The fairway-type golf club head perimeter 520 is used to define important dimensions of the insert 530, such as length, width, and thickness. The depth 546 is measured from the front edge 554 to the rear edge 556, and the length 547 is measured from the heel side edge 558 to the toe side edge 560, and the thickness 548 is measured from the top surface 562 to the bottom surface 564. The dimensions of the sole insert 530 can be the same as sole insert 430 as previously described and can further follow the ranges specified below.

The sole insert 530 can extend substantially across the sole 118 in a front-to-rear direction such that the depth 546 is greater than 52% of the fairway-type golf club head depth 160. The sole insert depth 546 varies across the sole insert 430 in a heel-to-toe direction. The sole insert depth 546 can range between 0.50 inch to 2.00 inches. The sole insert 530 further defines a maximum depth 546, wherein the maximum depth 546 is greater than 1.50 inches. The maximum depth 546 can range between 1.50 inches to 2.00 inches.

Similar to depth, the sole insert 530 can extend substantially across the sole 118 in a heel-to-toe direction such that length 547 is greater than 58% of the fairway-type golf club head length 162. The sole insert length 547 varies across the sole insert 530 in a front-to-rear direction. The sole insert length 547 can range between 0.90 inches to 2.70 inches. The sole insert 530 further defines a maximum length 547, wherein the maximum length 547 is greater than 2.40 inches. The maximum length 547 can range between 2.40 inches to 2.70 inches.

The sole insert thickness 548 varies across the sole insert 530 in a front-to-rear and heel-to-toe direction. The thickness 4548 can range between 0.080 inch to 0.20 inch. The sole insert 530 further defines a maximum thickness 548, wherein the maximum thickness is greater than 0.15 inch. The maximum thickness 548 can range between 0.15 inch to 0.20 inch.

The dimensions of the sole insert 530 are carefully selected to balance the fairway-type golf club head CG 172 and fairway-type golf club head MOI. The sole insert depth 546 and length 547 are selected such that the insert 530 spans across the sole 118 and defines a substantial portion of the sole 118. The sole insert bottom surface 564 defines a surface area that is visible from an exterior of the fairway-type golf club head 100. The surface area can be greater than 3.00 $in^2$. Alternatively, the surface area can be between 3.00 $in^2$ to 3.50 $in^2$. In one exemplary embodiment, the visible surface area is 3.135 $in^2$. The surface area is determined by the sole insert depth 546 and length 577.

The sole insert depth 546 and length 547 can be restricted to ensure the sole insert 430 remains generally within the central sole portion. Additionally, the sole insert 530 can be located at an offset 549 from the strike face 104 to further ensure the sole insert 530 remains near the central portion of the sole 118. In other words, the sole insert 430 is configured such that it forms only a portion of the sole 518 and does not form a portion of the c fairway-type golf club head perimeter 112 or the strike face 104. This arrangement of the sole insert 530 will serve to position the CG 172 of the golf fairway-type golf club head 100 further back in order to be on or near the FLIP axis 195. If the design consisted of a sole insert 430 forming a portion of the perimeter, the CG 172 would be raised, making it more difficult to position on or near the FLIP axis 195. As such, the maximum sole insert depth 546 can be less than 2.0 inches, the maximum length 547 can be less than 2.70 inches, the thickness 548 can be less than 0.20 inch, and the visible surface area can be less than 3.50 $in^2$.

The sole insert 530 defines a total mass that is relatively large and can be in a range of 80 grams to 85 grams. In one exemplary embodiment, the mass is 81.1 grams. The sole insert 530 can preferably comprise a material having a density equal to or higher than 19 $g/cm^3$.

Referring to FIG. 9B, the sole insert 530 further comprises a forward mass pad 578 positioned near the front edge 554 and the heel side edge 558. The forward mass pad 578 is further positioned such that a portion of the forward mass pad 578 is positioned within the main body flange 570, and a portion is positioned within the heelward extension 566.

The mass pad 578 is positioned to enable a fairway-type golf club head CG 172 located on or near the FLIP axis 195. The sole insert 530 can be partitioned into four: a front-heel quadrant, a front-toe quadrant, a rear-toe quadrant, and a rear-heel quadrant. The four quadrants help illustrate the mass distribution of the sole insert 530. The quadrants are separated by a first imaginary line drawn across the depth 546 of the sole insert 530 at an approximate midline of the length 547 and by a second imaginary line drawn across the length 547 through a point of the heelward and toeward extensions 568 that is nearest the rear edge 566.

The mass pad 578 positions a majority of the sole insert mass 530 within a forward portion of the sole insert 530. More specifically, more than 45% of the mass is located in the front-heel quadrant, and more than 75% of the mass is located in the front-heel and front-toe quadrants. The front-heel quadrant can comprise between 35 grams to 40 grams, the front-toe quadrant can comprise between 25 grams to 30 grams, rear-toe quadrant can comprise between 5 grams to 10 grams, and the rear-heel quadrant can comprise between 5 grams to 10 grams. The forward and heelward mass pad 578 can position the fairway-type golf club head CG 172 near the FLIP axis 195.

As discussed above, the golf fairway-type golf club head 100 defines a perimeter, wherein the perimeter defines an upper portion 152 and a lower portion 156 of the fairway-type golf club head 100. The lower portion 156 comprises the sole 118 and a portion of the perimeter region 112. The lower portion 156 comprises an outer surface, wherein the sole insert bottom surface 564 can define between 15% to 20% of the outer surface. In one exemplary embodiment, the bottom surface 564 defines 21.68% of the lower portion 156. The dimensions of the sole insert 530 are carefully selected to provide a low insert CG 472 that enables a fairway-type golf club head CG 172 near the FLIP axis 195.

The sole insert 530 further defines a low and optimally placed center of gravity (CG) 472. Similar methods are applied to locate the CG 472 of the sole insert comprising wings 530 in comparison to sole insert 430. According to the geometric center method, the $CGZ_1$474 can be in a range of between 1.10 inch to 1.30 inches, the $CGY_1$476 can be in a range of 0.50 inch to 0.70 inch, and the $CGX_1$ 473 can be between 0.10 inch to 0.20 inch. According to the leading edge method, the $CGY_1$480 can be in a range of between 0.05 inch to 0.15 inch, the $CGZ_2$ 481 can be in a range of between 1.30 inch to 1.40 inches, and the $CGX_1$ 473 can be between 0.10 inch to 0.20 inch. According to the exit point method, $CGZ_3$487 can be between 0.90 inch to 1.10 inches, the $CGY_1$480 can be in a range of between 0.05 inch to 0.15 inch, and the $CGX_2$ 479 can be in a range of between 0.10 inch to 0.20 inch. According to the FLIP axis method, the $CGF_2$ 482 can be in a range of between 1.30 inch to 1.40 inches, and the $CGF_1$486 can be in a range of between 0.15 inch to 0.25 inch. According to the relative method, the $CGY_4$ 477 can be in a range between 0.25 inch to 0.30 inch, the $CGZ_5$ 475 can be in a range between 0.030 inch to 0.050 inch, and the $CGX_3$ 483 can be in a range between 0.10 inch to 0.15 inch.

The careful placement of the sole insert CG 472 permits a fairway-type golf club head CG 172 along the FLIP axis which allows for optimal force transference to the golf ball. As such, the $CGZ_1$474 can be less than 1.30 inches, and the $CGY_1$476 can be less than 0.70 inch. The $CGZ_5$ 475 can be less than 0.50 inch, and the $CGY_4$ 477 can be less than 0.30 inch. The $CGF_1$486 can be less than 0.25 inch. The sole insert CG 472 can be limited to the ranges discussed above to ensure the fairway-type golf club head CG 172 is located on the FLIP axis 195. A head CG 172 placement along the FLIP axis 195 provides optimal force transference and reduces spin. Should the sole insert CG fall outside of the specified ranges, the fairway-type golf club head CG 172 can move further away from the FLIP axis 195. For example, should the sole insert CG 472 be located at a $CGZ_1$474 larger than 1.50 inches, the fairway-type golf club head 100 would require additional mass towards the front 108 to balance the more rearward sole insert CG 472. While the fairway-type golf club head CG can then be located along the FLIP axis 195, this additional mass can reduce the MOI benefits to the fairway-type golf club head 100. Additionally, the $CGY_1$480 can be less than 0.25 inch, and the $CGF_2$ 482 can be greater than 1.30 inch. The sole insert CG 472 can be further limited by these ranges to ensure a low and rearward CG that benefits MOI and launch characteristics.

VIII. Face Cup

The face cup 300 can comprise a titanium alloy. The face cup 300 can comprise a steel alloy. The face cup 300 can comprise other metallic alloys. The face cup 300 can comprise a fiber reinforced polymer or fiber reinforced composite.

The face cup 300 comprises a face cup mass in a range of 1.0 grams to 75.0 grams. The mass of face cup 300 is preferably relatively low in comparison to the total mass of the fairway-type golf club head 100. A low mass face cup 300 will allow the fairway-type golf club head to have less mass above the FLIP 190, allowing the CG 172 to be adjusted lower (or not moved higher due to a higher mass in the face cup 300 above the FLIP 190). Similarly, a low mass face cup 300 allows the CG 172 of the fairway-type golf club head to be moved further towards the rear of the fairway-type golf club head (or not moved forward due to a higher mass in the face cup 300). Thus, the use of a low density face cup 300 material preferable.

In some embodiments, the density of the face cup 300 material is preferably less than or equal to 5.00 g/cm$^3$.

Further, the face cup strike face portion 304 comprises a strike face thickness 330 measured from the front, outer surface of the strike face 104 to the rear surface of the strike face 104. The strike face thickness 330 can vary in a toe to heel direction and in a crown to sole direction. The strike face thickness 330 can be in a range of 0.020 inch to 0.050 inch. Again, the constrained thickness of the face cup contributes to having a lower mass forward portion of the fairway-type golf club head.

The face cup strike face portion 304 further comprises a strike face area in a range of 2.00 in$^2$ to 3.00 in$^2$. The face cup strike face portion is not greater than 3.00 in$^2$.

The face cup 300 can be permanently affixed to the main body 202 by welding, brazing, adhesives, mechanical fasteners, or other appropriate means within the mass constraints discussed above. When the face cup 300 is permanently affixed to the main body 202, the main body 202 and face cup 300 form a single, integral structure. An impact of the strike face 204 is transmitted through the face cup 300 to the main body 202.

IX. Crown Insert

The crown insert 800 is preferably a low density material. A low crown insert mass provides the fairway-type golf club head designer with a lower CG 172 placement (or the lower mass crown insert does not force the center of mass higher in the fairway-type golf club head). The crown insert 800 can be comprised of a carbon composite material, a fiber reinforced polymeric material, a natural fiber composite, or other suitable, low density material. The crown insert 800 can be comprised of a composite sandwich material, having hollow interstitial voids with an upper and lower envelope.

The density of the composite material (combined resin and fibers), which forms the second component (200), can range from about 1.15 g/cm$^3$ to about 2.02 g/cm$^3$. In some embodiments, the composite material density ranges between about 1.20 g/cm$^3$ and about 1.90 g/cm$^3$, about 1.25 g/cm$^3$ and about 1.85 g/cm$^3$, about 1.30 g/cm$^3$ and about 1.80 g/cm$^3$, about 1.40 g/cm$^3$ and about 1.70 g/cm$^3$, about 1.30 g/cm$^3$ and about 1.40 g/cm$^3$, or about 1.40 g/cm$^3$ to about 1.45 g/cm$^3$.

The crown insert 800 can be adhesively and permanently affixed within the crown aperture 234. The crown insert 800 can be mechanically affixed within the crown aperture 234. The crown insert 800 can be affixed both adhesively and mechanically with the crown aperture 234.

The crown insert rear weight opening 820 is configured to fit around the rear weight support structure 299 at the rear of the fairway-type golf club head. The crown insert 800 reduces mass near an upper portion of the fairway-type club head 100, allowing more mass to be allocated to the rear weight 1111 and the rear weight support structure 299. It is desirable to provide more mass to the rear weight 1111 and the rear weight support structure 299 to lower the fairway-type club head CG 172 to improve launch characteristics.

X. Rear Weight Support Structure and Rear Weight Assembly

The fairway-type golf club head 100 can further comprise a rear weight support structure 299 and a rear weight 1111 to distribute mass to a lower portion of the fairway-type club head 100. Because the support structure height 293 must encompass the rear weight recess depth 251, the height of the rear weight fastener aperture 255, and the rear flange height 291, the support structure comprises a support structure mass in a range of 10 grams to 50.0 grams. Further, when the rear weight is received in the rear weight recess, the support structure and weight mass is in a range up to 25 grams greater. The combined mass of the rear weight support structure 299 and the removable, adjustable, interchangeable rear weight 1111 mass can provide an important fairway-type golf club head CG positioning tool, allowing the designer to increase the combined mass to move the CG further back and to decrease the combined mass to allow the CG to move further forward.

The support structure mass can be further increased with a permanently affixed tungsten weight, placed above and rearward of the rear weight recess along a rearward edge of the fairway-type golf club head. (Not shown in Figures)

The rear weight 1111 can be composed of a tungsten alloy, tungsten, or a polymeric material mixed with tungsten powder. The rear weight has a rear weight mass in a range of 1 gram to 35 grams.

The combined masses rear weight 1111, and the rear weight assembly 1110 provide a means of placing more fairway-type golf club head mass further rearward. Adjusting the rear weight assembly 1110 dimensions and the rear weight 1111 mass is one method that allows the fairway-type golf club head designer to carefully adjust the front-to-rear position of the fairway-type golf club head CG 172.

In an alternative embodiment, the rear weight support structure 229 comprises a rear weight channel (not shown), further comprising a plurality of attachment points to move and secure the rear weight 1111. The rear weight channel can allow the rear weight 1111 to be moved between a plurality of positions to customize the weighting of the fairway-type golf club head 100.

The largest effect on mass distribution and CG placement is accomplished by placing a large percentage of the fairway-type golf club head mass in the sole. One effective means of increasing sole mass is to provide a large, high-density sole insert received in the sole of the fairway-type golf club head.

G. Moment of Inertia

As noted above, the fairway-type golf club head 100 balanced a low and rearward CG 172 relative to the main body 202. While optimizing the CG location on or near the FLIP axis is important for increasing the force transmitted to a struck golf ball, other mass characteristics also contribute to desirable fairway-type golf club performance. Specifically, the moment of inertia (MOI) affects the forgiveness of the fairway-type golf club head when the golf ball is struck off center. The distribution of the mass of the fairway-type golf club head can be further optimized to provide as high an MOI as possible while optimizing the location of the CG relative to the FLIP axis. A combination of features chosen from a group consisting of a lightweight crown insert 800, main body 202, a high density sole insert 430, and a removable, adjustable, or interchangeable rear weight assembly 1100 also provide mass distributions that contributes to a higher CG 172. The lightweight crown insert wraps into the lower portion of the fairway-type golf club head, and the high density sole insert may have toe and heel extensions that increase MOI by moving some mass towards the periphery of the fairway-type golf club head while keeping more mass lower in the club head. Therefore, the MOI of the fairway-type golf club head can also be in a desirable range.

The fairway-type golf club head 100 comprises a moment of inertia about the x axis Ixx (i.e., crown-to-sole moment of inertia) and a moment of inertia about the y axis Iyy (i.e., heel-to-toe moment of inertia), as illustrated in FIG. 5C. In many embodiments, the crown-to-sole moment of inertia Ixx and the heel-to-toe moment of inertia Iyy are increased or maximized based on various fairway-type golf club head parameters, such as volume and loft angle. The crown-to-sole moment of inertia Ixx can be in a range of 1000 $g*cm^2$ to 1500 $g*cm^2$, and the heel-to-toe moment of inertia Iyy can be in a range of 2000 $g*cm^2$ to 2500 $g*cm^2$.

XI. Equations to Describe CG and FLIP Axis Positional Relationship

The CG 172 position is also heavily influenced by the fairway-type golf club head shape profile. The fairway-type golf club head height or club face height will affect how far above the ground plane mass can be placed, and the higher above the ground plane mass can be placed, the higher the CG 172 will be driven.

In order to place the CG 172 close to or on the FLIP axis 195, the CG 172 position should also satisfy the equation:

$$\frac{CG_z}{\left(\frac{\text{Second } CG \text{ Height } 180}{\text{Face Height } 144}\right)(|\text{CCF1 } 186| + 0.0001)} > 56.0 \quad (1)$$

Equation 1 depicts a relationship between the fairway-type golf club head CG 172 and the face height 144, wherein $CG_2$ is the CG depth located along FLIP axis 195, measured from the FLIP 190, and $CG_2$ has to be greater than 1.150 inches. The $CGY_2$180 is measured perpendicular to the ground plane 1000 and has to be less than 0.50 inch. The $CGF_1$186 is measured perpendicularly from the fairway-type golf club head CG 172 to the FLIP axis 195 and must be less than 0.25 inch. The face height 144 is measured parallel to loft plane 1010 between a top end of the strike face perimeter 142 near the crown 116 and a bottom end of the strike face perimeter 142 near the sole 118. The face height 144 must be less than 2.00 inches.

EXAMPLES

XII. Example 1: Fairway-Type Golf Club Head Having a Sole Insert Comprising Wings We made a first example of the fairway-type golf club head as described above, comprising features and performance as detailed below.

Figure 10A:
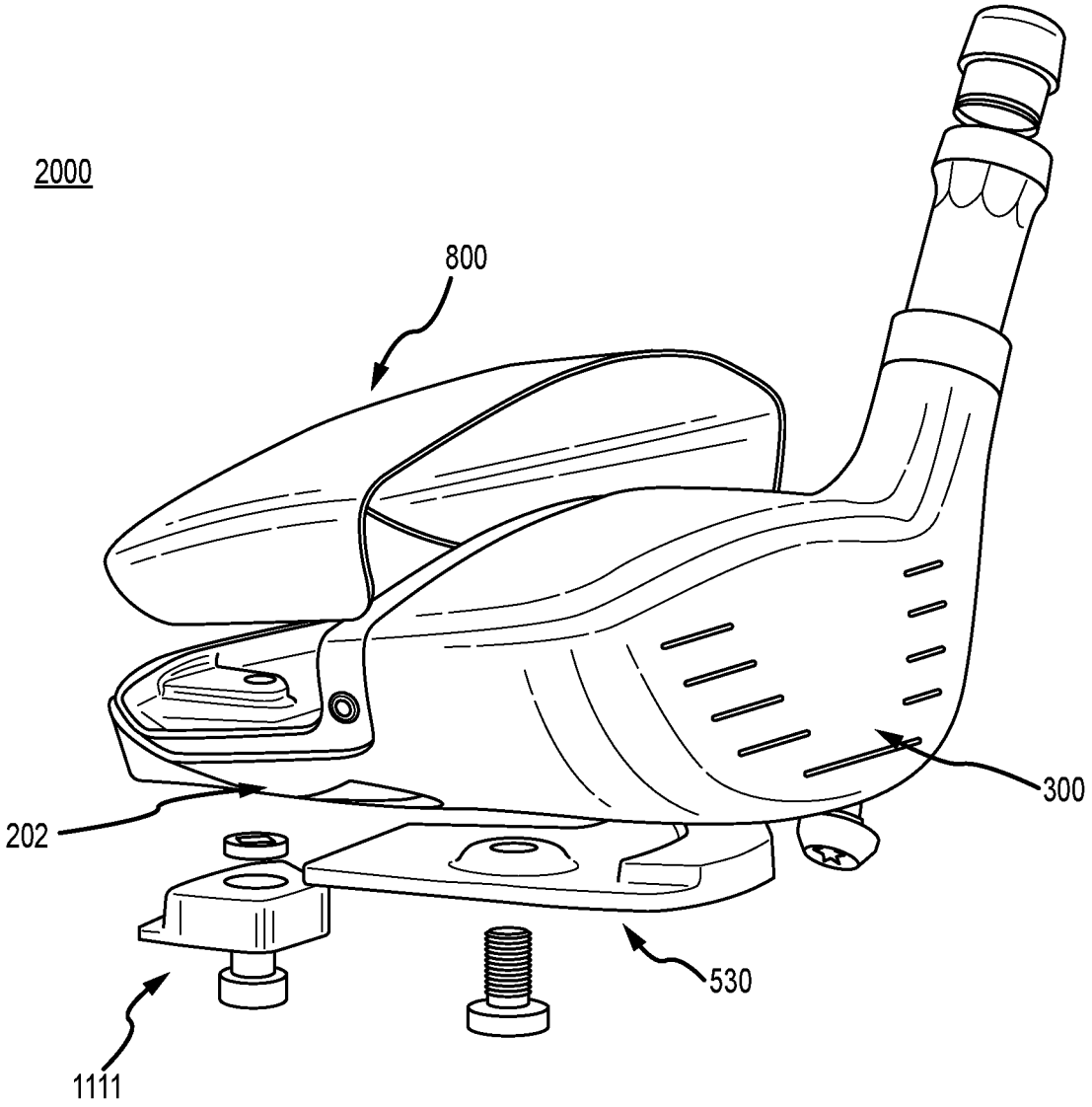
FIG. 10A illustrates an exploded view of a fairway-type golf club head with attachment means for the sole insert.
Figure 10B:
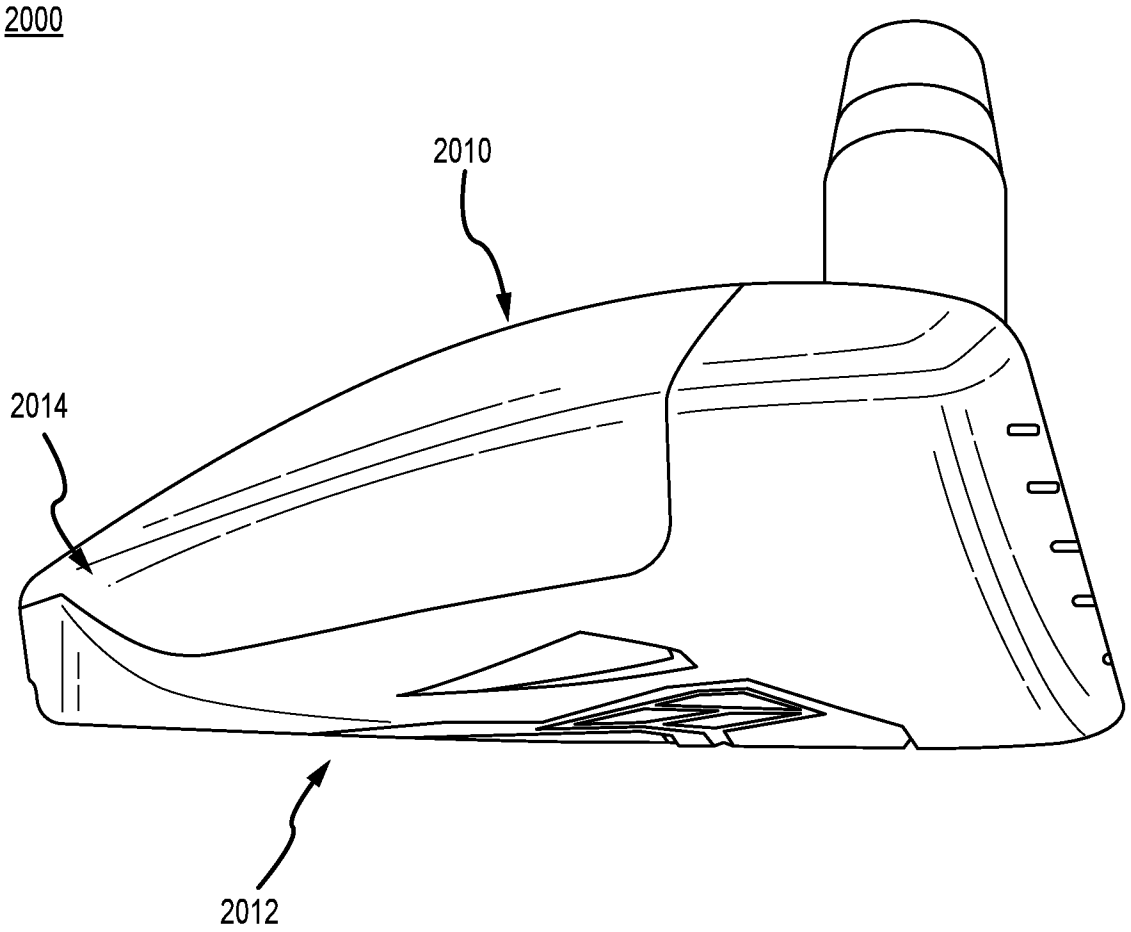
FIG. 10B illustrates a side view of a fairway-type golf club head.

Referring to FIGS. 10A-10B, a first embodiment of the fairway-type golf club described herein comprised multiple components similar to those described above. The fairway-type golf club head 2000 comprised a main body 202, a face cup 300 attached to a front end of the main body 202, a light-weight crown 800 permanently affixed to the main body 202, a large, high-density sole insert 530, and a removably affixed rear weight 1111. The fairway type golf club head 2000 components were carefully arranged to place the center of gravity (CG) 172 of the fairway-type golf club head 2000 on or very near a force line impact point (FLIP axis) 195 extending perpendicular to a loft plane at the force line impact point (FLIP) 190.

The main body 202 comprised a main body front portion 214, a main body rear portion 212, and a sole 218. The main body front portion 214 defined a front aperture 210 opening forward and configured to receive the face cup 300. The main body rear portion 212 defines a crown aperture 234 configured to receive the crown insert 800. The sole 218 defines a sole insert recess 240 where a portion of the sole 218 is recessed into the main body rear portion 212. The sole insert recess 240 was configured to receive the sole insert 530. The sole 218 further defines a rear weight recess 250 where a portion of the sole 218 is recessed into the main body rear portion 212. The rear weight recess 250 was configured to receive the rear weight 1111. The main body 202 comprised a titanium alloy.

The face cup 300 was configured to be received within and permanently affixed to the main body front aperture 210 to form the front 2008 of the golf cub head 2000. When the face cup 300 was affixed to the main body 203, the main body strike face portion 226 and the face cup strike face portion 304 combined to form the fairway-type golf club head strike face 2004. The face cup 300 comprised a face cup rear edge 381 forming a face cup rear perimeter of the face cup 300. The face cup rear edge 381 encompassed the entirety of the rearward edge of the face cup, and also encompassed the heelward edge of the face cup 300. The face cup rear edge was configured to abut the main body front edge 281 when the face cup 300 was affixed to the main body 202. The face cup 300 was permanently affixed to the main body 202 via welding. The face cup 300 comprised a titanium alloy. The face cup 300 comprised a mass of 26.1 grams.

The crown insert 800 was received within the crown aperture 234. The crown insert 800 and a portion of the main body 202 formed the crown 2016. The crown insert 800 comprised a lightweight composite material.

The sole insert 530 was received within the sole insert recess 240 and secured with a threaded fastener. The sole insert 530 was substantially large and comprised a length, a width, and a thickness, measured similarly to sole insert 430. The sole insert depth was 1.76 inches, the length was 2.54 inches, and the thickness was between 0.082 inch to 0.173 inch.

The rear weight assembly 1100 was configured to be received within the sole rear weight recess 250. The rear weight assembly comprised a rear weight 1111, a rear weight threaded fastener 1160, and a rear weight washer 1170. The threaded fastener 1160 was inserted upwards from the bottom surface 1124 into the fastener aperture 1150 until the head of the threaded fastener 1160 abutted the aperture shoulder 1154. The bottom surface 1124 was exposed to the bottom exterior of the fairway-type golf club head. The rear weight protrusion 1130 was exposed to both the bottom and rear exterior of the fairway-type golf club head. The rear weight 1111 comprised a tungsten alloy. The rear weight had a rear weight mass of between 1 to 20 grams.

An imaginary triangle was defined by the sole insert CG 472, the fairway-type golf club head CG 2072, and the rear weight CG. The three legs of the triangle were defined where a first leg was between the sole insert CG 472 and the rear weight CG, a second leg was between the sole insert CG 472 and the fairway-type golf club head CG 2072, and the third leg was between the fairway-type golf club head CG 2072 and the rear weight CG. The length of the first leg was 1.6 inches, the length of the second leg was between 0.3 inch, and the length of the third leg was between 1.5 inches. A first angle was defined between the first leg and the second leg, wherein the first angle was 75 degrees. A second angle was defined between the first leg and the third leg, wherein the second angle was 95 degrees. A third angle was defined between the second leg and the third leg, wherein the third angle was 10 degrees.

The fairway-type golf club head 2000 further defined an upper portion 2010 and a lower portion 2012, wherein the upper portion 2010 was viewed from a top-down view, and the lower portion was viewed from a sole view. The transition between the upper and lower portions 2010, 2012 was defined by a line around the perimeter 2014 of the fairway-type golf club head 2000. The line was further defined wherein when the fairway-type golf club head was at an address position, a plurality of points around the perimeter of the fairway-type golf club head was tangent to lines perpendicular to the ground plane. Referring to FIG. 10B, the perimeter line defined an upper fairway-type golf club head portion 2010 and a lower fairway-type golf club head portion 2012.

The lower portion 2012 comprised the sole and a portion of the perimeter region. The lower portion further comprised the sole insert 530, rear weight, crown extensions, and face cup material. The lower portion 2012 defined a surface area visible from and exterior of the fairway-type golf club head 2000.

The sole insert bottom surface 564 defined a surface area that was visible from an exterior of the fairway-type golf club head 2000 within the lower portion 2012. In the exemplary embodiment, the visible surface area was 3.256 $in^2$. The sole insert bottom surface defined 21.68% of the lower portion surface area 2012. The sole insert 530 defined a substantial surface area of the lower portion 2012 to position mass lower on the fairway-type golf club head to achieve a CG 2072 in a low position along the FLIP axis 195.

The crown insert 800 also defined a surface area of the fairway-type golf club head lower portion 800. The crown insert surface area 800 within the lower portion was 1.461 $in^2$. The crown insert 800 defined 9.73% of the lower portion surface area 2012. The lightweight crown insert 800 formed a portion of the sole 2018 to reduce the mass of the main body 202, which was formed from a denser material. The lightweight crown insert 800 saved mass that can be allocated to the sole insert 530 or the rear weight 1111 to lower the fairway-type golf club head CG 2072.

H. Performance Improvements of the Sole Insert Comprising Wings

The fairway-type golf club head 2000 of Example 1 demonstrated improved performance characteristics. The Strokes Gained concept described in Mark Broadie's book "Every Shot Counts" outlines the average number of strokes for a PGA tour player to hole out from a certain distance. Strokes Gained was broken down into Driving, Approach Shots, Short Game and Putting. It allowed us to better understand the quality of the shot. The Strokes Gained concept quantified the effect of a shot on the score for a hole (e.g., what is the cost of snapping a drive 50 yds left, or by hitting a drive 20 yds further but 10 yds in the rough). The Strokes Gained concept provided a constant unit of measurement across all parts of the golf game, which made it also possible to analyze and compare the quality of different types of shots in an "apples to apples" scenario (e.g., compare a 300 yd drive to a 30 yd bunker shots).

The strokes gained for a shot was the average strokes to hole out from the starting position minus the average strokes to hole out from the end position of the shot, minus 1 for the stroke taken. For example, a tee shot from 400 yds has 3.99 shots left, and the drive was hit down the fairway and finished 100 yds from the hole. That gave 3.99−2.80−1=0.19 strokes gained on the drive.

The long game (all shots outside 100 yds) accounted for two-thirds of the scoring difference of the top 40 pros from the average tour pros. Some 40% of the strokes gained amongst the best players came from approach shots. It was these approach shots that are the typical shot using a fairway-type golf club head.

A player hit the ball farther and sacrificed some additional average offline distance and still "gained strokes." Thus, placing the fairway-type golf club head CG closer to a force line impact point axis (FLIP axis) allowed a golfer to hit the ball further and with less deleterious spin. This was an improvement for the golfer, even if the MOI of the fairway-type golf club head was marginally lower, and its forgiveness to mishits was marginally reduced.

The preferred embodiment satisfied all of the above requirements and had the surprising result of producing significant performance improvements.

TABLE 1

Comparison in Performance Between Prior Art Club Head and Preferred Embodiment

| | CGF2 (182) | CGF1 (186) | Total MOI | Ball Speed | Launch Angle | Spin | Distance |
|---|---|---|---|---|---|---|---|
| Prior Art Club Head | 0.485 | 1.337 | 4876 | | | | |
| Preferred Embodiment | 0.292 | 1.345 | 3940 | "+1.5 mph" | "+1.0 degrees" | "−700 rpm" | "+8-10 yd" |

The CG 172 was placed close to the FLIP axis 195, which caused the ball speed, launch angle, and ball spin to improve. This led to a gain of carry distance, compared to the prior art, mono-material fairway, of 7 to 10 yards. While the total forgiveness of the preferred embodiment was slightly lowered, due to a decrease in fairway-type golf club head total MOI, the carry distance gain was projected to offset the loss of forgiveness and lower the number of strokes made in a golf round for the average golfer.

I. CG Position of the Preferred Embodiment

The fairway-type golf club head of Example 1 had a CG 172 position, which was 0.193 inches lower, and 0.08 inch further towards the rear of the fairway-type golf club head 2000 in comparison to an otherwise identically shaped fairway-type golf club head comprising a single, steel alloy.

For the preferred embodiment, the FLIP 190 was located approximately 0.650 inches above a ground plane 1000, which is tangent to the lowest point of the sole 2018. The FLIP was in a range of 0.550 inches to 0.750 inches above the ground plane 1000. The FLIP 190 location also varied parallel to the X axis 1052 in a range of +/−0.100 inches from the X axis 1052 location of the geometric center 140.

In the first fairway-type golf club head embodiment, as the FLIP axis 195 extended rearwardly from the FLIP 190, the range of desired CG 172 vertical location was also in a range of 0.050 inches higher than the FLIP axis 195 to 0.050 inch lower than the FLIP axis 195. Further, the desired range of CG 172 locations varied in a range of +/−0.100 inches from the FLIP axis 195, parallel to the X axis 1052. Additionally, and referring again to FIG. 5A, the CG 172 had a $CGF_2$182 in a range of 1.15 inches to 1.50 inches.

Mass Sections of the Preferred Embodiment

The fairway-type golf club head 2000 of Example 1 was divided by imaginary planes that defined sections to further describe the distribution of mass. For example, the fairway-type golf club head was divided into ten evenly spaced horizontal sections that are parallel to the ground plane. The first section was located near the ground plane, and the tenth section was located near the crown apex. Table 2 illustrates the distribution of mass throughout the fairway-type golf club head according to these sections. The lowest ten percent of the fairway-type golf club head comprised 48.1 percent of the total mass, the lowest twenty percent comprised 66.4% of the total mass, and the lowest thirty percent comprised 73.3% of the total mass.

TABLE 2

Horizontal Mass Sections

| Horizontal Section | Mass (g) | Percentage of Total Mass | Combined Percentage of Total Mass |
|---|---|---|---|
| 1 | 91.63 | 48.1% | 48.1% |
| 2 | 34.76 | 18.3% | 66.4% |
| 3 | 13.13 | 6.9% | 73.3% |
| 4 | 9.02 | 4.7% | 78.0% |
| 5 | 7.11 | 3.7% | 81.8% |
| 6 | 6.90 | 3.6% | 85.4% |
| 7 | 6.73 | 3.5% | 88.9% |
| 8 | 6.73 | 3.5% | 92.4% |
| 9 | 7.41 | 3.9% | 96.3% |
| 10 | 6.98 | 3.7% | 100.0% |

Alternatively, the fairway-type golf club head was divided into ten evenly spaced vertical sections that are perpendicular to the ground plane. The first section was located near the strike face, and the tenth section was located near the rear. Table 3 illustrates the distribution of mass throughout the fairway-type golf club head according to these sections.

TABLE 3

Vertical Mass Sections

| Vertical Section | Mass (g) | Percentage of Total Mass | Combined Percentage of Total Mass |
|---|---|---|---|
| 1 | 22.27 | 10.5% | 10.5% |
| 2 | 27.21 | 12.8% | 23.3% |
| 3 | 40.63 | 19.2% | 42.5% |
| 4 | 34.70 | 16.4% | 58.9% |
| 5 | 24.88 | 11.7% | 70.6% |
| 6 | 17.88 | 8.4% | 79.1% |
| 7 | 13.62 | 6.4% | 85.5% |
| 8 | 8.11 | 3.8% | 89.3% |
| 9 | 12.45 | 5.9% | 95.2% |
| 10 | 10.22 | 4.8% | 100.0% |

J. Moment of Inertia

In the first fairway-type golf club head example, the crown-to-sole moment of inertia Ixx was 1196 g*cm$^2$, and the heel-to-toe moment of inertia Iyy was 2183 g*cm$^2$. In another exemplary embodiment, the crown-to-sole moment of inertia Ixx was 1203 g*cm2, and the heel-to-toe moment of inertia Iyy was 2191 g*cm2.

XIII. Example 2: Fairway-Type Golf Club Head Having a Rectangular Insert

A second embodiment of the golf club described herein comprised multiple components similar to those described above. The fairway-type golf club head 3000 comprised a main body 202, a face cup 300 attached to a front end of the main body 202, a light-weight crown 800 permanently affixed to the main body 202, a large, high-density sole insert 430, and a removably affixed rear weight 1111. In comparison to a mono-material fairway-type golf club head, having the same shape, dimensions, and total mass, and comprising a steel alloy, the fairway-type golf club head 3000 exhibited significant changes in mass properties. The fairway-type golf club head 3000 comprised a titanium alloy main golf club head body 202, a steel alloy face cup 300, a non-metallic crown insert 800, and a tungsten sole insert 430 received within a sole recess 240. The tungsten sole insert comprised a mass of 80 grams.

K. Resultant Mass Distribution of the Fairway-Type Golf Club Head

The mass distribution of the fairway-type golf club head 3000 of Example 2 was compared to the mass distribution a comparative fairway-type club head. The comparative golf club head was a mono-material, single piece fairway-type golf club head. When both the comparative fairway-type golf club head and the fairway-type golf club head 3000 had a total mass of 213 grams, the face cup 300 was 12.6% of the total mass, versus the comparative fairway-type golf club face comprising of 17.6% of the total mass. Similarly, the comparative fairway-type golf club head crown comprised 11.9% of the total comparative golf club head mass, versus the crown insert 800 having 3.80% of the mass of the fairway-type golf club head 3000. The comparative fairway-type golf club head sole comprised 13.1% of the total comparative golf club head mass, versus the sole 3018 having (a much larger) 47.3% of the mass of the golf club head 3000, and wherein the tungsten sole insert 430 had a mass of approximately 80 grams or 37.6% of the mass of the preferred embodiment fairway-type golf club head 400. Thus, the high-density sole insert 430 contributed significantly to the mass distribution of the fairway-type golf club head 3000 and was necessary to lower the CG 3072 onto or near the FLIP axis 195.

TABLE 4

Fairway-Type Golf Club Comparison

| | Total Mass | % Mass of Face Cup | Mass of Crown Portion | % Mass of Entire Sole Portion | % of Tungsten Sole Insert |
|---|---|---|---|---|---|
| Prior Art Club Head | 213 g | 17.60% | 11.90% | 13.10% | N/A |
| Preferred Embodiment | 213 g | 12.60% | 3.80% | 47.30% | 37.60% |

XIV. Example 3: Fairway-Type Golf Club Head Having a Steel Sole Insert

As an alternate construction, the fairway-type golf club head 4000 has a sole insert 430, 530 comprising a steel alloy. The alternate steel sole insert 430, 530 is removably attached into the sole recess 240, welded into a sole aperture (not shown), or integrally cast into a steel main body 202. The sole insert 430, 530 formed from a steel alloy provides a large mass near the fairway-type club head sole to improve launch characteristics, while lowering the manufacturing costs in comparison to a sole insert 430, 530 formed from a tungsten alloy.

XV. Example 4: Fairway-Type Golf Club Head Having a Steel Face Cup

As an alternate construction, the fairway-type golf club head 600 comprises a face cup 300 formed from a steel alloy. The fairway-type golf club head 600 comprising a steel face cup has more mass towards the front 608 and requires a sole insert 630 having more mass towards the rear 610. In such an embodiment, the sole insert 630 comprises a mass pad or a thickened region 678 located at an offset from the front edge 654. The mass pad 678 positions more mass towards the rear 610 to offset the additional mass of a steel face cup 300 in comparison to a titanium face cup 300. The steel face cup 300 provides a strong strike face capable of increased deformation in comparison to a titanium face cup 300, while lowering manufacturing costs.

XVI. Example 5: Fairway-Type Golf Club Head Without Crown Extensions

As an alternate construction, the fairway-type golf club head 5000 comprises a crown insert 800, wherein the crown insert does not extend to the sole 5018. The crown extensions do not form part of the sole 518 but only extend into a perimeter of the golf club head 5000. The lessor extent of the crown extension in comparison to the preferred embodiment has a minor effect on the CG 172 position of the fairway-type golf club head 5000, causing the CG 172 to be slightly higher. However, the light-weight material of the crown insert 800 is, thereby, also not exposed to on the sole 5018 and not subject to the wear and tear of repeatedly striking the ground while in use. Further, the crown insert 800 adhesive bond is not stressed by the repeated impacts on the ground.

XVII. Example 6: Fairway-Type Golf Club Head Having a Natural Fiber Crown Insert Another alternate embodiment is achieved by changing the material of the crown insert 800 from a composite material to a natural fiber material. A crown insert 800 comprising a natural fiber material reduces the structural mass near an upper portion of the fairway-type club head, which provides additional discretionary mass to be distributed to a lower portion of the club head to further improve performance characteristics.

XVIII. Example 7: Fairway-Type Golf Club Head Having a Steel Main Body

Another alternate embodiment is achieved by changing the material of the main body 202 from a titanium alloy to a steel alloy. The main body 202 formed from a steel alloy provides a strong, rigid framework for attaching various club head components, while lowering the manufacturing costs in comparison to a main body 202 formed from a tungsten alloy.

CLAUSES

Clause 1 A fairway-type golf club head comprising: a club head comprising: a main body portion comprising: a front portion comprising a front opening, a rear portion, a toe portion, and a heel portion; a sole defining an insert recess; a crown return; wherein the rear portion, the toe portion, the heel portion, the sole, and the crown return define a crown aperture; a face cup received within the front opening; wherein the face cup comprises a strike face having a geometric center; a sole insert received within the insert recess, and; a crown insert received within the crown aperture; wherein the crown insert, and the main body crown return define a crown; and a club head center of gravity (CG); wherein the club head defines: a ground plane tangent to the sole of the club head; a loft plane tangent to the strike face at the geometric center; a coordinate system originating at the geometric center of the strike face comprising an X axis, a Y axis, and a Z axis; wherein the Z axis extends in a front-to-rear direction parallel to the ground plane; wherein the Y axis extends in a crown-to-sole direction perpendicular to the Z axis; and wherein the X axis extends in a heel-to-toe direction perpendicular to the Y axis and the Z axis; a YZ plane through the geometric center and along the Y axis and Z axis; a force line impact point (FLIP) located on the strike face at a vertical distance from the ground plane ranging from 0.55 inch to 0.75 inch, and on the YZ plane; and a force line impact point (FLIP) axis extending rearward from the FLIP and perpendicular to the strike-face at the FLIP; wherein: the club head CG is located at a CGX1, a CGY1, and a CGZ1, wherein: the CGX1 is measured parallel to the X axis from the geometric center, and the CGX1 is in a range of 0.010 inch to 0.020 inch; the CGY1 is measured perpendicularly from the to the Z axis, and the CGY1 is in a range of 0.20 inch to 0.30 inch; the CGZ1 is measured parallel to the Z axis and rearward from the geometric center, and the CGZ1 is in a range of 1.00 inch to 1.25 inch; the CGX1, the CGY1, and the CGZ1 define an imaginary rectangular box; the club head CG is located within the imaginary rectangular box, and; wherein: the club head CG is further located at a CGF1 measured perpendicularly from the club head CG to the FLIP axis; and the CGF1 is in a range of 0.000 inch to 0.040 inch.

Clause 2 The fairway-type golf club head of clause 1, wherein the insert recess is recessed into the sole portion towards the crown via an insert recess floor.

Clause 3 The fairway-type golf club head of clause 2, wherein the sole insert comprises: a perimeter having a front edge, a rear edge, a heel side edge, and a toe side edge; a main body flange; a heelward extension; a toeward extension; wherein the heelward extension and the toeward extension are positioned near the front edge and extend outwardly from the main body flange; a top surface; and a bottom surface; wherein the bottom surface forms a portion of the sole.

Clause 4 The fairway-type golf club head of clause 3, wherein: a portion of the front edge is non-parallel to a portion of the rear edge; and a portion of the heel side edge is non-parallel to a portion of the toe side edge.

Clause 5 The fairway-type golf club head of clause 1, wherein the sole insert comprises a mass between 70 grams to 90 grams.

Clause 6 The fairway-type golf club head of clause 5, wherein the sole insert further comprises a sole insert center of gravity (CG); wherein the sole insert CG is located a sole insert CGY2 measured perpendicular to the ground plane; wherein the sole insert CGY2 is between 0.05 inch to 0.15 inch.

Clause 7 The fairway-type golf club head of clause 6, wherein the club head CG is further located at a club head CGY2 measured perpendicular to the ground plane; wherein the club head CGY2 is between 0.30 inch to 0.40 inch; and wherein a first CG ratio between the club head CGY2 and the sole insert CGY2 satisfies the following:

$$2.00 \leq \frac{\text{Club Head Height (164)}}{\text{Geometric Center Height (146)}} \leq 2.30 \quad (1)$$

Clause 8 The fairway-type golf club head of clause 1, wherein the vertical distance from the ground plane is 0.65 inch.

Clause 9 The fairway-type golf club head of clause 1, wherein the main body is formed from a titanium alloy.

Clause 10 The fairway-type golf club head of clause 1, wherein the main body is formed from a fiber reinforced plastic.

Clause 11 The fairway-type golf club head of clause 1, wherein the face cup is formed from a steel alloy.

Clause 12 The fairway-type golf club head of clause 1, wherein the crown insert has a lower density than a main body density and a face cup density.

Clause 13 The fairway-type golf club head of clause 1, wherein the crown insert wraps around the main body and forms a portion of the sole.

Clause 14 The fairway-type golf club head of clause 1, further comprising: a perimeter defined by a series of points around the golf club head; wherein the series of points are each tangent to lines drawn perpendicular to the ground plane when the golf club head is in an address position; wherein the perimeter is a sum of the series of points; wherein the perimeter defines an upper portion and a lower portion of the golf club head; wherein the upper portion is defined as a portion of the golf club head, excluding the strike face, above the perimeter; and wherein the lower portion is defined as a portion of the golf club head, excluding the strike face, that is below the perimeter.

Clause 15 The fairway-type golf club head of clause 14, wherein the lower portion comprises at least three different materials.

Clause 16 The fairway-type golf club head of clause 14, wherein the sole insert forms at least 20% of a lower portion outer surface.

Clause 17 The fairway-type golf club head of clause 1, wherein the golf club head further comprises a removeable rear weight.

Clause 18 The fairway-type golf club head of clause 17, wherein the rear weight comprises a mass in a range of 1 grams to 35 grams.

Clause 19 The fairway-type golf club head of clause 1, wherein the CGX1 defines the imaginary rectangular box in the heel-to-toe direction, CGY1 defines the imaginary rectangular box in the crown-to-sole direction, and the CGZ1 defines the imaginary rectangular box in the front-to-rear direction.

The invention claimed is:

1. A fairway-type golf club head comprising:

a club head comprising:

a main body comprising:

a front portion comprising a front opening, a rear portion, a toe portion, and a heel portion;

a sole defining an insert recess;

a crown return;

wherein the rear portion, the toe portion, the heel portion, the sole, and the crown return define a crown aperture;

a face cup received within the front opening;

wherein the face cup comprises a strike face having a geometric center;

a sole insert received within the insert recess;

wherein the insert recess is recessed into the sole towards the crown return via an insert recess floor;

wherein the sole insert is formed from a material having a sole insert density greater than 15 g/cm$^3$;

wherein the sole insert comprises a mass between 70 grams to 90 grams;

wherein the sole insert defines a surface area visible from an exterior of the club head;

wherein the surface area is between 3.00 in$^2$ to 3.50 in$^2$;

a crown insert received within the crown aperture;

wherein the crown insert, and the crown return define a crown;

a club head volume of less than 200 cm$^3$;

a loft angle between 14 degrees and 35 degrees; and a club head center of gravity (CG);

wherein the club head defines:

a ground plane tangent to the sole of the club head;

a loft plane tangent to the strike face at the geometric center;

a coordinate system originating at the geometric center of the strike face comprising an X axis, a Y axis, and a Z axis;

wherein the Z axis extends in a front-to-rear direction parallel to the ground plane;

wherein the Y axis extends in a crown-to-sole direction perpendicular to the Z axis; and wherein the X axis extends in a heel-to-toe direction perpendicular to the Y axis and the Z axis;

a YZ plane through the geometric center and along the Y axis and Z axis;

a force line impact point (FLIP) located on the strike face at a vertical distance from the ground plane ranging from 0.55 inch to 0.75 inch, and on the YZ plane; and a force line impact point (FLIP) axis extending rearward from the FLIP and perpendicular to the strike face at the FLIP;

wherein:

the club head CG is located at a CGX1, a CGY1, and a CGZ1, wherein:

the CGX1 is measured parallel to the X axis from the geometric center, and the CGX1 is in a range of 0.010 inch to 0.020 inch;

the CGY1 is measured perpendicularly from the Z axis, and the CGY1 is in a range of 0.20 inch to 0.30 inch;

the CGZ1 is measured parallel to the Z axis and rearward from the geometric center, and the CGZ1 is in a range of 1.00 inch to 1.25 inch;

the CGX1, the CGY1, and the CGZ1 define an imaginary rectangular box;

the club head CG is located within the imaginary rectangular box, and;

wherein:

the club head CG is further located at a CGF1 measured perpendicularly from the club head CG to the FLIP axis; and the CGF1 is in a range of 0.000 inch to 0.040 inch.

2. The fairway-type golf club head of claim 1, wherein the sole insert comprises:

a perimeter having a front edge, a rear edge, a heel side edge, and a toe side edge;

a main body flange;

a heelward extension;

a toeward extension;

wherein the heelward extension and the toeward extension are positioned near the front edge and extend outwardly from the main body flange;

a top surface; and a bottom surface;

wherein the bottom surface forms a portion of the sole.

3. The fairway-type golf club head of claim 2, wherein:

a portion of the front edge is non-parallel to a portion of the rear edge; and a portion of the heel side edge is non-parallel to a portion of the toe side edge.

4. The fairway-type golf club head of claim 1, wherein the sole insert further comprises a sole insert center of gravity (CG);

wherein the sole insert CG is located a sole insert CGY2 measured perpendicular to the ground plane;

wherein the sole insert CGY2 is between 0.05 inch to 0.15 inch.

5. The fairway-type golf club head of claim 4, wherein the club head CG is further located at a club head CGY2 measured perpendicular to the ground plane;

wherein the club head CGY2 is between 0.30 inch to 0.40 inch; and wherein a first CG ratio between the club head CGY2 and the sole insert CGY2 satisfies the following:

$$\frac{\text{sole insert } CGY2}{\text{club head } CGY2} * \text{sole insert mass} \geq 20.$$

6. The fairway-type golf club head of claim 1, wherein the vertical distance from the ground plane is 0.65 inch.

7. The fairway-type golf club head of claim 1, wherein the main body is formed from a titanium alloy.

8. The fairway-type golf club head of claim 1, wherein the main body is formed from a fiber reinforced plastic.

9. The fairway-type golf club head of claim 1, wherein the face cup is formed from a steel alloy.

10. The fairway-type golf club head of claim 1, wherein the crown insert has a lower density than a main body density and a face cup density.

11. The fairway-type golf club head of claim 1, wherein the crown insert wraps around the main body and forms a portion of the sole.

12. The fairway-type golf club head of claim 1, further comprising:

a perimeter defined by a series of points around the golf club head;

wherein the series of points are each tangent to lines drawn perpendicular to the ground plane when the golf club head is in an address position;

wherein the perimeter is a sum of the series of points;

wherein the perimeter defines an upper portion and a lower portion of the golf club head;

wherein the upper portion is defined as a portion of the golf club head, excluding the strike face, above the perimeter; and wherein the lower portion is defined as a portion of the golf club head, excluding the strike face, that is below the perimeter.

13. The fairway-type golf club head of claim 12, wherein the lower portion comprises at least three different materials.

14. The fairway-type golf club head of claim 12, wherein the sole insert forms at least 20% of a lower portion outer surface.

15. The fairway-type golf club head of claim 1, wherein the golf club head further comprises a removeable rear weight.

16. The fairway-type golf club head of claim 15, wherein the removable rear weight comprises a mass in a range of 1 gram to 35 grams.

17. The fairway-type golf club head of claim 1, wherein the CGX1 defines the imaginary rectangular box in the heel-to-toe direction, CGY1 defines the imaginary rectangular box in the crown-to-sole direction, and the CGZ1 defines the imaginary rectangular box in the front-to-rear direction.

18. A fairway-type golf club head comprising:

a club head comprising:

a main body comprising:

a front portion comprising a front opening, a rear portion, a toe portion, and a heel portion;

a sole defining an insert recess;

a crown return;

wherein the rear portion, the toe portion, the heel portion, the sole, and the crown return define a crown aperture;

a face cup received within the front opening;

wherein the face cup comprises a strike face having a geometric center;

a sole insert received within the insert recess;

wherein the insert recess is recessed into the sole towards the crown return via an insert recess floor;

wherein the sole insert is formed from a material having a sole insert density greater than 15 g/cm$^3$;

wherein the sole insert comprises a mass between 70 grams to 90 grams;

wherein the sole insert defines a surface area visible from an exterior of the club head;

wherein the surface area is between 3.00 in$^2$ to 3.50 in$^2$;

wherein the sole insert defines a sole insert length measured in a front-to-rear direction;

wherein the sole insert length is between 2.4 inches to 2.7 inches;

a crown insert received within the crown aperture;

wherein the crown insert, and the crown return define a crown;

a club head volume of less than 200 cm$^3$; and a loft angle between 14 degrees and 35 degrees.

* * * * *